US010174498B2

(12) United States Patent
Winter

(10) Patent No.: US 10,174,498 B2
(45) Date of Patent: Jan. 8, 2019

(54) DECK COMPONENT WITH POST SLEEVE AND FLANGES

(71) Applicant: Roger Winter, St. John, IN (US)

(72) Inventor: Roger Winter, St. John, IN (US)

( * ) Notice: Subject to any disclaimer, the term of this patent is extended or adjusted under 35 U.S.C. 154(b) by 0 days.

(21) Appl. No.: 15/497,986

(22) Filed: Apr. 26, 2017

(65) Prior Publication Data

US 2018/0094426 A1 Apr. 5, 2018

Related U.S. Application Data

(63) Continuation-in-part of application No. 15/284,061, filed on Oct. 3, 2016, now Pat. No. 9,932,734.

(51) Int. Cl.
*E04B 1/24* (2006.01)
*E04B 1/41* (2006.01)
(Continued)

(52) U.S. Cl.
CPC ..... *E04B 1/40* (2013.01); *E04B 1/003* (2013.01); *E04B 1/2403* (2013.01);
(Continued)

(58) Field of Classification Search
CPC ..... E04B 1/40; E04B 1/003; E04B 2103/06; E04B 2001/405; E04F 11/1817
(Continued)

(56) References Cited

U.S. PATENT DOCUMENTS 949,394 A 2/1910 Daly
1,915,023 A 6/1933 Lizaso et al.
(Continued)

FOREIGN PATENT DOCUMENTS

JP 2006-328676 A 12/2006

OTHER PUBLICATIONS

AS&D Railing Systems, Fascia Mount Brackets, downloaded Sep. 21, 2016 from http://www.thedeckstoreonline.com/step-1-fascia-mount-brackets.html#.WHfsyVPaeUk, website order form (3 pages).
(Continued)

*Primary Examiner* — Brent W Herring
(74) *Attorney, Agent, or Firm* — McDonnell Boehnen Hulbert & Berghoff LLP

(57) ABSTRACT

Deck components comprising a post sleeve and flanges extending away from side walls of the post sleeve are described. The post sleeve includes a rectangular cross section. Interior flanges can comprise attachment holes for affixing the interior flanges to box-frame-segments having square-cut edges. Box-frame-segments and box-frame-segment attachments with square-cut edges can abut the exterior surface of a post sleeve side wall. Use of the post sleeve can reduce or eliminate the need to produce beveled joints box-frame-segments and box-frame-segment attachments. Post sleeves can comprise a post sleeve extension extending above box-frame-segments that attach to the flanges of the post sleeve. The post sleeve and post sleeve extension can comprise a single metal extrusion. Alternatively, the post sleeve extension can be attached to the post sleeve. In one example, a post sleeve extender is placed into a post sleeve and the post sleeve extension is placed onto the post sleeve extender.

21 Claims, 30 Drawing Sheets

(51) Int. Cl.
*E04B 1/00* (2006.01)
*E04F 11/18* (2006.01)
*E04B 1/38* (2006.01)

(52) U.S. Cl.
CPC ... *E04F 11/1817* (2013.01); *E04B 2001/2406* (2013.01); *E04B 2001/2421* (2013.01); *E04B 2001/2451* (2013.01); *E04B 2001/2475* (2013.01); *E04B 2001/2484* (2013.01); *E04B 2001/405* (2013.01); *E04B 2103/06* (2013.01)

(58) Field of Classification Search
USPC ..... 52/848, 586.1
See application file for complete search history.

(56) References Cited

U.S. PATENT DOCUMENTS 2,315,516 A 4/1943 Gray
3,592,493 A 7/1971 Goose
3,632,147 A * 1/1972 Finger ..... A47F 5/14 403/171
3,786,612 A 1/1974 Baker
4,092,079 A 5/1978 Swanson
4,125,973 A 11/1978 Lendrihas
4,212,564 A 7/1980 Kay
4,270,872 A * 6/1981 Kiyosawa ..... F16B 7/0446 403/170
4,359,851 A 11/1982 Daniels
4,577,449 A 3/1986 Celli
4,614,502 A * 9/1986 Nelson ..... A63F 9/0876 135/121
4,936,068 A * 6/1990 VictorSchonfeld ... B21C 35/026 52/100
5,289,665 A * 3/1994 Higgins ..... E04B 1/2403 211/191
5,315,796 A 5/1994 Gruhlke
5,363,625 A 11/1994 Philippi
5,494,370 A 2/1996 Habicht et al.
5,618,127 A 4/1997 Tönsmann et al.
5,642,595 A * 7/1997 Daniels ..... A47H 1/02 160/330
6,219,989 B1 4/2001 Tumura
6,408,587 B2 * 6/2002 Cronin ..... E04C 3/04 182/178.1
6,516,583 B1 2/2003 Houghton
6,837,016 B2 1/2005 Simmons et al.
7,021,020 B2 4/2006 Simmons et al.
7,743,538 B2 6/2010 Parenti et al.
7,806,630 B2 10/2010 Hawkins et al.
7,883,288 B2 * 2/2011 Jorna ..... F16B 7/0453 403/171
8,157,480 B2 4/2012 Hawkins et al.
8,297,023 B2 10/2012 Collins
8,322,091 B2 12/2012 Smith et al.
8,453,414 B2 6/2013 Simmons
8,745,954 B2 6/2014 Simmons
8,782,994 B1 7/2014 Simmons
8,863,466 B1 10/2014 Winter
8,966,837 B2 3/2015 Knudsen
8,998,527 B2 4/2015 Clark
9,057,190 B1 6/2015 Winter
9,234,365 B2 1/2016 Knudsen
9,272,226 B2 * 3/2016 Samlaska ..... A63H 23/005
9,394,679 B2 7/2016 Tanaka et al.
9,422,959 B2 8/2016 Clark
9,765,805 B2 * 9/2017 Pond ..... F16B 17/00
9,932,734 B1 * 4/2018 Winter ..... E04B 1/2403
2003/0041549 A1 3/2003 Simmons et al.
2003/0177735 A1 * 9/2003 Seeba ..... E04C 3/06 52/848
2006/0091372 A1 5/2006 Rosian
2006/0144006 A1 7/2006 Suzuki et al.
2006/0150562 A1 7/2006 Simmons et al.
2006/0165482 A1 * 7/2006 Olberding ..... E04B 1/24 403/381
2006/0265992 A1 11/2006 Hiragaki
2007/0245645 A1 10/2007 Nesbitt
2010/0071305 A1 3/2010 Collins
2010/0170184 A1 7/2010 Gadd et al.
2010/0175344 A1 7/2010 Gadd et al.
2012/0110947 A1 5/2012 Simmons
2012/0131879 A1 5/2012 Bergman
2012/0167518 A1 7/2012 Hawkins et al.
2013/0212958 A1 8/2013 Knudsen
2014/0123588 A1 5/2014 Hawkins et al.
2014/0182233 A1 7/2014 Simmons
2014/0338280 A1 11/2014 Tanaka et al.
2014/0373461 A1 12/2014 Rodriguez
2015/0321111 A1 * 11/2015 Samlaska ..... A63H 23/005 446/124
2018/0094418 A1 * 4/2018 Winter ..... E04B 1/2403

OTHER PUBLICATIONS

Lowe's Fiberon HomeSelect White Composite Deck Post Sleeve, downloaded Sep. 21, 2016 from https://www.lowes.com/pd/Fiberon-HomeSelect-White-Composite-Deck-Post-Sleeve-Fits-Common-Post-Measurement-4-in-x-4-in-Actual-4-1-in×-4-1-in--33 -48-in/4196241, website order form (3 pages).
New England Arbors, Bolt Down Bracket System for pergolas, downloaded Sep. 21, 2016 from http://store.newenglandarbors.com/products/bolt-down-bracket-system, website order form, 2016 (5 pages).
Profile Mouldings.com Aluminum Deck Post Wraps, downloaded Sep. 21, 2016 from http://www.profilemouldings.com/Alumnimum-Deck-Post-Wraps-Various-Sizes.aspx, website order form (2 pages).
Simpson Strong-Tie 12-Gauge Black Powder-Coated E-Z Base, downloaded Sep. 21, 2016 from http://www.homedepot.com/p/Simpson-Strong-Tie-12-Gauge-Black-Powder-Coated-E-Z-Base-FPBB44/100655350#!bvstate=ct:r/og:1/st:p/id:100655350, website order form (4 pages).
U.S. Patent Office: Office Action dated May 18, 2017 in parent case U.S. Appl. No. 15/284,061, filed Oct. 3, 2016 (13 pages).
InspectAPedia, Guardrails: Guide to Guard Railing Codes, Specifications, Heights, Construction & Inspection, website downloaded Oct. 11, 2017 from the world wide web at https://inspectapedia.com/Stairs/Guardrailing_Codes.php (15 pages).
U.S. Department of Labor, OSHA, letter dated Oct. 28, 2004 from Director of Construction R. Swanson to H. Haydl re stair rail and hand rail heights; §1926.1052(c)(6) and 1926.1052(c)(7) (2 pages).
U.S. Department of Labor, OSHA, memorandum dated Apr. 17, 2006 from Director of Construction R. Swanson to K. Gereke and J. McFee re guardrail height requirements for construction activities in General Industry facilities (2 pages).
Versadeck Decking, Inc., Railing Systems brochure and technical specifications, downloaded Apr. 13, 2017 from the world wide web at http://versadeck.com/products/aluminum_railing.php (6 pages).
Versadeck Decking, Inc., Standard Picket Rail Powder Coated Aluminum Railing System, brochure and technical specifications, Feb. 2, 2014 (9 pages).

* cited by examiner

DECK COMPONENT WITH POST SLEEVE AND FLANGES

REFERENCE TO RELATED APPLICATION

This application is a continuation-in-part application of U.S. patent application Ser. No. 15/284,061 filed Oct. 3, 2016. U.S. patent application Ser. No. 15/284,061 is incorporated herein by reference.

BACKGROUND

A deck is a structure typically built outdoors. A deck may be connected to a building. A deck usually has a flat surface similar to a floor and can be built at a given elevation above the ground. A deck can support a load consisting of people, deck furniture, or other items. The supportable load can vary from deck to deck based on such items as the size and type of material used to build the deck.

Some decks, such as decks described in U.S. Pat. No. 9,057,190, are built using box-frame-segments and angle clips. The ends of the box-frame-segments are cut with a bevel so that two of the ends can abut one another to form a bevel or miter joint. Each angle clip can be arranged as an L-shaped clip having angle clip segments that extend from a joint or bend. Each angle clip segment can comprise at least one attachment hole, which can be a through-hole. Each attachment hole within an angle clip segment can correspond to a respective attachment hole within a box-frame-segment. Each angle clip segment can slide or otherwise be inserted into a respective box-frame-segment.

Cutting box-frame-segments with a bevel cut may be tedious and may result in wasting time and material if the bevel cut of the box-frame-segments to be joined together are not performed properly. It would be desirable to be able to join box-frame-segments together without having to join box-frame-segments with bevel cuts.

Many decks are built with guard rails. Attaching a guard rail can include attaching one or more vertical posts using fasteners. In many instances, the vertical posts are attached to a deck frame after the deck frame has been built. In those and other instances, the fasteners used to attach the vertical posts to the deck frame are visible. To some people, visible fasteners are unsightly.

OVERVIEW

Example embodiments pertaining to or including components of decks, as well as example embodiments of assembling and dissembling deck systems and components are described. The described components include box-frame-segments, and deck components that comprise post sleeves and flanges extending from two or more walls of the post sleeves. The post sleeves can comprise one piece post sleeves or multi-piece post sleeves. The post sleeves, one piece or multi-piece, can comprise a post sleeve base and a post sleeve extension. The post sleeve extension comprises a portion of the post sleeve that extends vertically upwards above a location at which a top horizontal element of box-frame-segments contact the post sleeve when the flanges extending from a side wall of the post sleeve are positioned within the box-frame-segment.

In one aspect, an example embodiment can take the form of a deck component comprising: (i) a post sleeve comprising a post sleeve base and a post sleeve extension, wherein the post sleeve base comprise a first side wall, a second side wall, a third side wall, and a fourth side wall, wherein the first side wall abuts the second side wall and the third side wall, wherein the second side wall abuts the first side wall and the fourth side wall, wherein the third side wall abuts the first side wall and the fourth side wall, wherein the fourth side wall abuts the second side wall and the third side wall, and wherein a top of the post sleeve and a bottom of the post sleeve are open; (ii) a first flange extending from the first side wall; (iii) a second flange extending from the first side wall; (iv) a third flange extending from one of the second side wall, the third side wall, or the fourth side wall; and (iv) a fourth flange extending from the one of the second side wall, the third side wall, or the fourth side wall.

These as well as other aspects and advantages will become apparent to those of ordinary skill in the art by reading the following description with reference where appropriate to the accompanying drawings. Further, it should be understood that the embodiments described in this overview and elsewhere are intended to be examples only and do not necessarily limit the scope of the invention.

BRIEF DESCRIPTION OF THE DRAWINGS

Example embodiments are described herein with reference to the drawings.

FIG. 5 is a plan view of an example post sleeve.

DETAILED DESCRIPTION

I. Introduction

Figures 1, 2:
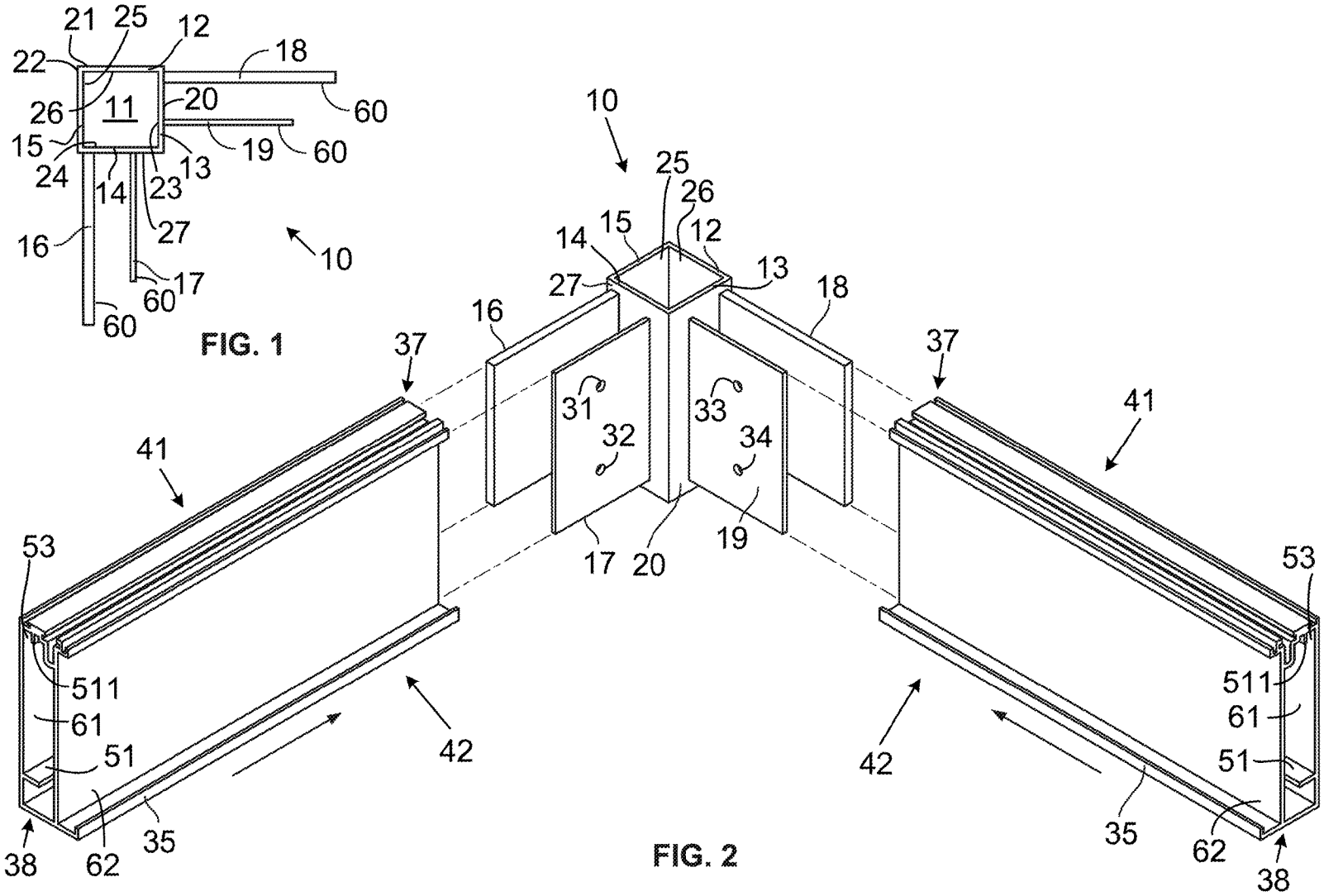
FIG. 1 is a plan view of an example post sleeve.
FIG. 2 is an isometric view of the post sleeve shown in FIG. 1 and attachable box-frame-segments.

This description describes a variety of components that can be used as part of a structure. The structure can comprise a load-bearing structure such as a deck (e.g., a free-standing deck or a deck attached to another structure such as a house) or a pier (e.g., a pier that is located in a body of water). A pier can comprise a portion that is within a body of water and a portion that is outside of the body of water. The water level with respect to a pier can change. In some instances, a body of water in which a pier is located can be at least partially drained such that the entire pier is outside of a body of water. In such situation, the pier could be considered a deck. Accordingly, for simplicity, the term "deck" in this description means "deck" or "pier." The drawings show a variety of deck components. Some aspects in the drawings are not drawn to the same scale. For example, some deck components in the example embodiments can have lengths of about 15.24 centimeters (cm) (i.e., 6 inches) and other components can have lengths of 243.84 cm (i.e., 96 inches) or longer.

A post is a rigid support for a structure, such as a deck. A post is typically relatively slender in proportion to its height. A post, or a portion of a post, can be positioned in the ground or upon a footer, such as a concrete footer, within the ground. A post can be positioned upon a lower level story within a multi-story structure. A post can be made from a variety of materials, such as wood, metal (e.g., steel or aluminum), or some other material suitable for supporting the load of a structure within which the post is used. As an example, a post can comprise a wooden post commonly referred to in the United States as a "four by four," A four by four (or 4×4) has a nominal size of 4 by 4 inches (i.e., 10.16 cm by 10.16 cm) and an actual size of 3.5 inches by 3.5 inches (i.e., 8.89 cm by 8.89 cm).

The described components comprise a variety of post sleeves. The post sleeves allow for joining two or more box-frame-segments together without having to cut the box-frame-segments to have beveled edges. The box-frame-segments joined at the post sleeves can comprise square cut edges. Cutting the box-frame-segments to have square cut edges is typically easier than cutting box-frame-segments to have beveled edges. The post sleeve includes side walls. The side walls can have dimensions for allowing a post (e.g., a 10.16 cm by 10.16 cm post (i.e., a 4 inch by 4 inch post), or a 15.24 cm by 15.24 cm post (i.e., a 6 inch by 6 inch post)) to be inserted into the post sleeve with sufficient clearance such that the post does not have to be pressed into the post sleeve, yet in proximity to the side walls for affixing the post to the side walls of the post sleeve using fasteners.

The example embodiments described in this description pertain to the deck systems and components and methods of assembling and disassembling deck systems and components described in U.S. Pat. No. 8,863,466, which issued on Oct. 21, 2014 from U.S. patent application Ser. No. 13/973,757 filed Aug. 22, 2013, and described in U.S. Pat. No. 9,057,190, which issued on Jun. 16, 2015 from U.S. patent application Ser. No. 14/598,539 filed Jan. 16, 2015. U.S. Pat. No. 8,863,466 and U.S. Pat. No. 9,057,190 are incorporated herein by reference.

II. Deck Components

FIG. 1 is a plan view of an example deck component 10. The deck component 10 may be used within a single story structure, such as a single story deck that attaches to a house via a ledger board or on a cantilevered deck. The deck component 10 may also be used in a multi-story structure, such as a multi-story deck.

The deck component 10 comprises a post sleeve 11. The post sleeve 11 comprises side walls 12, 13, 14, and 15 (or more simply, "side walls 12 to 15"). The deck component 10 comprises flanges 16 and 17 that extend from the side wall 14, and flanges 18 and 19 that extend from the side wall 13. The flanges 16 and 17 can abut the side wall 14 at an exterior surface of the side wall 14 or within a slot within the side wall 14. The flanges 18 and 19 can abut the side wall 13 at an exterior surface of the side wall 13 or within a slot within the side wall 13.

The post sleeve 11 is open above the side walls 12 to 15. The post sleeve 11 is open below the side walls 12 to 15. A post can enter the post sleeve 11 from above the side walls 12 to 15 or from below the side walls 12 to 15. A post sleeve extender retainer of a post sleeve extender, such as the post sleeve extender 920 shown in FIG. 44, can be positioned within the post sleeve 11 from above the side walls 12 to 15. Each side wall in the post sleeve 11 comprises an interior surface and an exterior surface. In particular, the side wall 12 includes an interior surface 26 and an exterior surface 21, the side wall 13 includes an interior surface 23 and an exterior surface 20, the side wall 14 includes an interior surface 24 and an exterior surface 27, and the side wall 15 includes an interior surface 25 and an exterior surface 22.

As an example, the post sleeve 11 and the flanges 16, 17, 18, and 19 (or more simply "flanges 16 to 19") can be formed by extruding a metal billet through a die as a single extruded deck component comprising the post sleeve 11 and the flanges 16 to 19. The flanges 16 to 19 formed by extrusion can be milled to lower the top surfaces of the flanges 16 to 19 below the top surface of the post sleeve 11 and to raise the bottom surfaces of the flanges 16 to 19 above the bottom surface of the post sleeve 11. Milling the flanges 16 to 19 formed by extrusion allows the flanges 16 and 17 to be positioned within one box-frame-segment 35 shown in FIG. 2 and the flanges 18 and 19 to be positioned within another box-frame-segment 35 shown in FIG. 2.

As another example, the post sleeve 11 and the flanges 16 to 19 can be formed by casting a metal as a single cast deck component comprising the post sleeve 11 and the flanges 16 to 19. The mold used to form the single cast deck component can be formed to minimize or eliminate the need to mill the flanges 16 to 19 to fit within the box-frame-segment 35.

As yet another example, the post sleeve 11 can be formed by extruding or casting a metal and the flanges 16 to 19 can be formed by extruding, casting or rolling a metal. In this example, the deck component 10 can be formed by affixing the flanges 16 to 19 to the post sleeve 11. The flanges 16 and 17 can be affixed to the post sleeve 11 by welding the flanges 16 and 17 to the exterior surface 27 of the post sleeve 11. The flanges 18 and 19 can be affixed to the post sleeve 11 by welding the flanges 18 and 19 to the exterior surface 20 of the post sleeve 11. FIG. 1 shows weld sides 60 of the flanges 16 to 19 for box-frame segments configured like the box-frame segment 35. Slots can be formed or machined in post sleeve 11 and the flanges 16 to 19 can be positioned within the slots prior to being welded to the post sleeve 11.

Welding the weld sides 60 of the flanges 16 and 18 without welding the opposing sides of the flanges 16 and 18 allows the flanges 16 and 18 to be installed within the box-frame-segment 35 flush against the surfaces 62 of the box-frame-segment 35. Similarly, welding the weld sides 60 of the flanges 17 and 19 without welding the opposing sides of the flanges 17 and 19 allows the flanges 17 and 19 to be installed within the box-frame-segment 35 flush against the surfaces 61 of the box-frame-segment 35.

The welds on the flanges 16 to 19 can stop short of the tops and bottoms of the flanges 16 to 19 so that the welds do not interfere with positioning the flanges 16 to 19 within the box-frame-segment 35. For example, the welds for attaching the flanges 16 and 18 may stop short of the tops of flanges 16 and 18 so that the welds do not interfere with the vertical element 511 of the box-frame-segment 35.

As an example, the metal used to form any of the deck components or the individual components (e.g., post sleeves or flanges) of any of the deck components discussed in this description can comprise aluminum. In additional examples, the metal can comprise a different metal, such as stainless steel or some other alloy. Furthermore, the deck components can be uncoated or coated (e.g., painted).

The deck component 10 can be manufactured with various dimensions. This paragraph lists example dimensions with respect to the deck component 10. A height of the side walls 12 to 15 can be 13.335 cm (i.e., 5.25 inches) and a length of the exterior surface of the side walls 12 to 15 can be 5.08 cm (i.e., 2 inches). Accordingly, the post sleeve 11 can comprise a rectangular cross section. A thickness of the side walls 12 to 15 can be 0.3175 cm (i.e., 0.125 inches) such that a length of the interior surface of the side walls can be 4.445 cm (i.e., 1.75 inches), or 0.3048 cm (i.e., 0.12 inches) such that a length of the interior surface of the side walls can be 4.470 cm (i.e., 1.76 inches). The flanges 16 and 18 can extend away from the exterior surface 5.08 cm (i.e., 2 inches), have heights of 10.16 cm (i.e., 4 inches) and have thicknesses of 0.635 cm (i.e., 0.25 inches). The flanges 17 and 19 can extend away from the exterior surface 5.715 cm (i.e., 2.25 inches), have heights of 10.795 cm (i.e., 4.25 inches) and have thicknesses of 0.47625 cm (i.e., 0.1875 inches). A shortest distance between two flanges extending from the same side wall (e.g., a distance between two flanges extending from the same exterior surface) can be 1.74625 cm (i.e., 0.6875 inches). A distance from a top of the flanges 16 and 18 to the top of the post sleeve 11 can be 0.635 cm (i.e., 0.25 inches). A distance from a bottom of the flanges 16 and 18 to bottom of the post sleeve 11 can be 2.54 cm (i.e., 1 inch). A distance from a top of the flanges 17 and 19 to the top of the post sleeve 11 can be 0.9525 cm (i.e., 0.375 inches). A distance from a bottom of the flanges 17 and 19 to bottom of the post sleeve 11 can be 1.5875 cm (i.e., 0.625 inches). Other examples of one or more the dimensions for the described components in this paragraph are possible.

The flange installed into the box-frame segment 35 closer to an exterior side of the box-frame-segment 35 can be thicker and longer to provide support for more lateral and vertical load as compared to the flange that is installed into the box-frame segment 35 closer to the interior side of the box-frame-segment 35. The flange installed into the box-frame segment 35 closer to an exterior side of the box-frame-segment 35 can be offset from a vertical edge of the side wall to which the flange abuts to account for a thickness of a vertical element 524 of a box-frame segment 35 (shown in FIG. 18) yet allow the exterior side 42 of the box-frame-segment 35 to be flush with an edge of the side wall adjacent to the side wall to which the flanges positioned within the box-frame-segment 35 abut.

Next, FIG. 2 is an isometric drawing showing two box-frame-segments 35 and additional details of the deck component 10. Each box-frame-segment 35 (shown in any drawing of this application) comprises an exterior side 41 and an interior side 42. The exterior sides 42 of the box-frame-segments 35 are the outermost sides of the box-frame-segments 35 when assembled as a box-frame perimeter, such as the box-frame perimeter 200 shown in FIG. 9, the box-frame perimeter 225 shown in FIG. 10, the box-frame perimeter 680 shown in FIG. 27, or the box-frame perimeter 685 shown in FIG. 28. The interior sides 42 of the box-frame-segments 35 are the innermost sides of the box-frame-segments 35 when assembled as a box-frame perimeter.

FIG. 2 shows the exterior surface 27 of the side wall 14 and the exterior surface 20 of the side wall 13, as well as the interior surface 25 of the side wall 15 and the interior surface 26 of the side wall 12.

The box-frame-segments 35 comprise an edge 37 and an edge 38. The edges 37 and 38 are square cut. The flanges 16 and 17 can be positioned within one of the box-frame-segments 35. The flanges 18 and 19 can be positioned within the other box-frame-segment 35. The edge 37 being square cut allows for the edge 37 to contact the exterior surface of a side wall, such as the exterior surface 20 or 27. The edge 38 being square cut allows for the edge 38 to contact the exterior surface of the side wall of another deck component comprising a post sleeve. The flanges of the other post sleeve can be positioned within the box-frame-segment 35 at the edge 38. A top portion of the edges 37 and 38 contact the post sleeve 10 at an upper box-frame-segment contact point of the post sleeve 10. In this way, deck boards can be positioned flatly upon the post sleeve 10 and the box-frame-segments 35.

The flange 17 comprises attachment holes 31 and 32. The flange 19 comprises attachment holes 33 and 34. The attachment holes 31, 32, 33, and 34 can comprise through-holes. The flanges 17 and 19 can comprise a different number of attachment holes. The flanges 16 and 18 may not comprise any attachment holes because it may preferable to not mill attachment holes within the exterior sides 41 of the box-frame-segments 35 for aesthetic reasons. In an alternative arrangement, attachment holes could be milled into the flanges 16 and 18 for placement of fasteners through attachment holes milled into the exterior sides 41.

After the flanges 16 and 17 are positioned within the box-frame-segment 35, fasteners 50 (not shown in FIG. 2) can affix the deck component 10 to the box-frame-segments 35 in which the flanges 16 and 17 have been installed. The attachment holes 31 and 32 can be used as guides to drill corresponding attachment holes within the box-frame-segment 35. The fasteners 50 that affix the deck component 10 to the box-frame-segment 35 can comprise self-tapping screws or another type of fastener. The attachment holes in the box-frame-segment 35 for receiving fasteners placed through attachment holes 31 and 32 could be drilled before the flanges 16 and 17 are positioned within the box-frame-segment 35.

Similarly, after the flanges 18 and 19 are positioned within the box-frame-segment 35, fasteners 50 (not shown in FIG. 2) can affix the deck component 10 to the box-frame-segment 35 in which the flanges 18 and 19 have been installed. The attachment holes 33 and 34 can be used as guides to drill corresponding attachment holes within the box-frame-segment 35. The fasteners 50 that affix the deck component 10 to the box-frame-segment 35 can comprise self-tapping screws or another type of fastener. The attachment holes in the box-frame-segment 35 for receiving fasteners placed through attachment holes 33 and 34 could be drilled before the flanges 18 and 19 are positioned within the box-frame-segment 35.

The box-frame-segments 35 comprise a reinforcement shelf 51 to support a flange, such as flange 16 or 18. The box-frame-segments 35 comprise a flange guide 53 for guiding a flange, such as the flange 16 or 18, within the box-frame-segments 35 during installation of a flange into the box-frame-segments 35.

Figure 3:
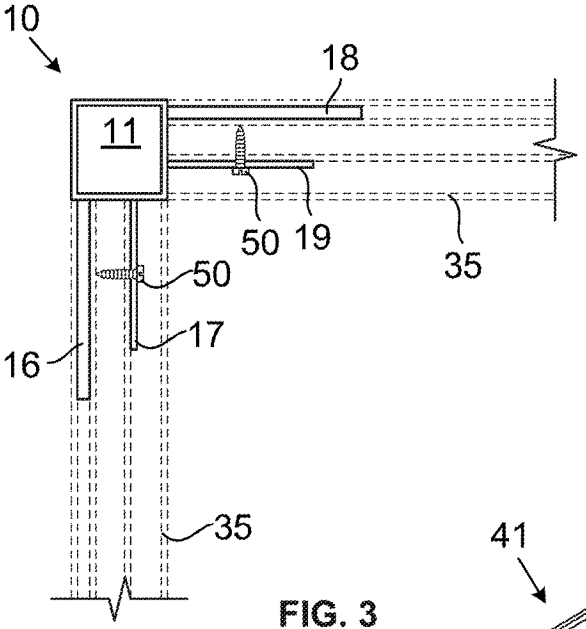
FIG. 3 is a plan view of the post sleeve shown in FIG. 1 with the box-frame-segments shown in FIG. 2 attached to the post sleeve.

Next, FIG. 3 is a plan view of the deck component 10 with the flanges 16 and 17 positioned within one box-frame-segment 35 and the flanges 18 and 19 positioned within another box-frame-segment 35, and fasteners 50 that affix the deck component 10 to the box-frame-segments 35.

Figure 4:
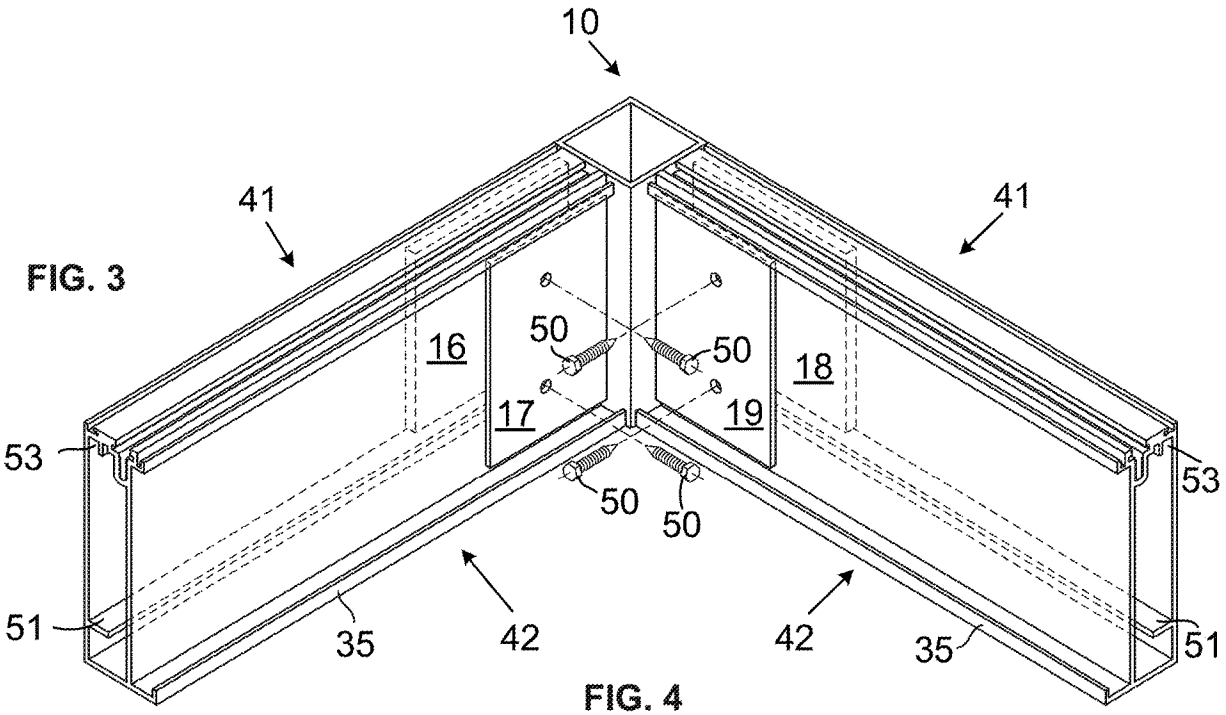
FIG. 4 is an isometric view of the post sleeve and the box-frame-segments shown in FIG. 3.

Next, FIG. 4 is an isometric view of the deck component 10 with the flanges 16 and 17 positioned within one box-frame-segment 35 and the flanges 18 and 19 positioned within another box-frame-segment 35, and fasteners 50 that affix the deck component 10 to the box-frame-segments 35.

The post sleeve 11 can be used as a post sleeve base within a multi-piece post sleeve. In this case, a post sleeve extender retainer of a post sleeve extender, such as the post sleeve extender 920 shown in FIG. 44, can be installed into the top of the post sleeve 11 and a post sleeve extension, such as the post sleeve extension 924 shown in FIG. 45.

FIG. 5 is a plan view of an example deck component 110. The deck component 110 may be used within a multi-story structure, such as a multi-story deck or a single story deck.

The deck component 110 comprises a post sleeve 111. The post sleeve 111 comprises side walls 112, 113, 114, and 115 (or more simply, "side walls 112 to 115"). The deck component 110 comprises flanges 116 and 117 that extend from the side wall 114, and flanges 118 and 119 that extend from the side wall 113. The flanges 116 and 117 can abut the side wall 114 at an exterior surface of the side wall 114 or within a slot within the side wall 114. The flanges 118 and 119 can abut the side wall 113 at an exterior surface of the side wall 113 or within a slot within the side wall 113.

The post sleeve 111 is open above the side walls 112 to 115. The post sleeve 111 is open below the side walls 112 to 115. A post can enter the post sleeve 111 from above the side walls 112 to 115 or from below the side walls 112 to 115. A post sleeve extender retainer of a post sleeve extender, such as the post sleeve extender 920 shown in FIG. 44, can be positioned within the post sleeve 111 from above the side walls 112 to 115. Each side wall in the post sleeve 111 comprises an interior surface and an exterior surface. In particular, the side wall 112 includes an interior surface 126 and an exterior surface 121, the side wall 113 includes an interior surface 123 and an exterior surface 120, the side wall 114 includes an interior surface 124 and an exterior surface 127, and the side wall 115 includes an interior surface 125 and an exterior surface 122.

As an example, the post sleeve 111 and the flanges 116, 117, 118, and 119 (or more simply, "116 to 119") can be formed by extruding a metal billet through a die as a single extruded deck component comprising the post sleeve 111 and the flanges 116 to 119. The flanges 116 to 119 formed by extrusion can be milled to lower the top surfaces of the flanges 116 to 119 below the top surface of the post sleeve 111 and to raise the bottom surfaces of the flanges 116 to 119 above the bottom surface of the post sleeve 111. Milling the flanges 116 to 119 formed by extrusion allows the flanges 116 and 117 to be positioned within one box-frame-segment 35 shown in FIG. 6 and the flanges 118 and 119 to be positioned within another box-frame-segment 35 shown in FIG. 6.

As another example, the post sleeve 111 and the flanges 116 to 119 can be formed by casting a metal as a single cast deck component comprising the post sleeve 111 and the flanges 116 to 119. The mold used to form the single cast deck component can be formed to minimize or eliminate the need to mill the flanges 116 to 119 to fit within the box-frame-segment 35.

As yet another example, the post sleeve 111 can be formed by extruding or casting a metal and the flanges 116 to 119 can be formed by extruding, casting or rolling a metal. In this example, the deck component 110 can be formed by affixing the flanges 116 to 119 to the post sleeve 111. The flanges 116 and 117 can be affixed to the post sleeve 111 by welding the flanges 116 and 117 to the exterior surface 127 of the post sleeve 111. The flanges 118 and 119 can be affixed to the post sleeve 111 by welding the flanges 118 and 119 to the exterior surface 120 of the post sleeve 111. FIG. 5 shows weld sides 60 of the flanges 116 to 119 for box-frame segments configured like the box-frame segment 35. Slots can be formed or machined in post sleeve 111 and the flanges 116 to 119 can be positioned within the slots prior to being welded to the post sleeve 111.

Welding the weld sides 60 of the flanges 116 and 118 without welding the opposing sides of the flanges 116 and 118 allows the flanges 116 and 118 to be installed within the box-frame-segment 35 flush against the surfaces 62 of the box-frame-segment 35. Similarly, welding the weld sides 60 of the flanges 117 and 119 without welding the opposing sides of the flanges 117 and 119 allows the flanges 117 and 119 to be installed within the box-frame-segment 35 flush against the surfaces 61 of the box-frame-segment 35.

The welds on the flanges 116 to 119 can stop short of the tops and bottoms of the flanges 116 to 119 so that the welds do not interfere with positioning the flanges 116 to 119 within the box-frame-segment 35. For example, the welds for attaching the flanges 116 and 118 may stop short of the tops of flanges 116 and 118 so that the welds do not interfere with the vertical element 511 of the box-frame-segment 35.

The deck component 110 can be manufactured with various dimensions. This paragraph lists example dimensions with respect to the deck component 110. A height of the side walls 112 to 115 can be 13.335 centimeters (cm) (i.e., 5.25 inches) and a length of the exterior surface of the side walls 112 to 115 can be 10.16 cm (i.e., 4 inches).

Accordingly, the post sleeve 111 can comprise a rectangular cross section. A thickness of the side walls 112 to 115 can be 0.3175 cm (i.e., 0.125 inches) such that a length of the interior surface of the side walls can be 9.525 cm (i.e., 3.75 inches), or 0.508 cm (i.e., 0.20 inches) such that a length of the interior surface of the side walls can be 9.144 cm (i.e., 3.60 inches). The flanges 116 and 118 can extend away from the exterior surface 5.08 cm (i.e., 2 inches), have heights of 10.16 cm (i.e., 4 inches) and have thicknesses of 0.635 cm (i.e., 0.25 inches). The flanges 117 and 119 can extend away from the exterior surface 5.715 cm (i.e., 2.25 inches), have heights of 10.795 cm (i.e., 4.25 inches) and have thicknesses of 0.47625 cm (i.e., 0.1875 inches). A shortest distance between two flanges extending from the same side wall (e.g., a distance between two flanges extending from the same exterior surface) can be 1.74625 cm (i.e., 0.6875 inches). A distance from a top of the flanges 116 and 118 to the top of the post sleeve 111 can be 0.635 cm (i.e., 0.25 inches). A distance from a bottom of the flanges 116 and 118 to bottom of the post sleeve 111 can be 2.54 cm (i.e., 1 inch). A distance from a top of the flanges 117 and 119 to the top of the post sleeve 111 can be 0.9525 cm (i.e., 0.375 inches). A distance from a bottom of the flanges 117 and 119 to bottom of the post sleeve 111 can be 1.5875 cm (i.e., 0.625 inches). Other examples of one or more the dimensions for the described components in this paragraph are possible.

Figure 6:
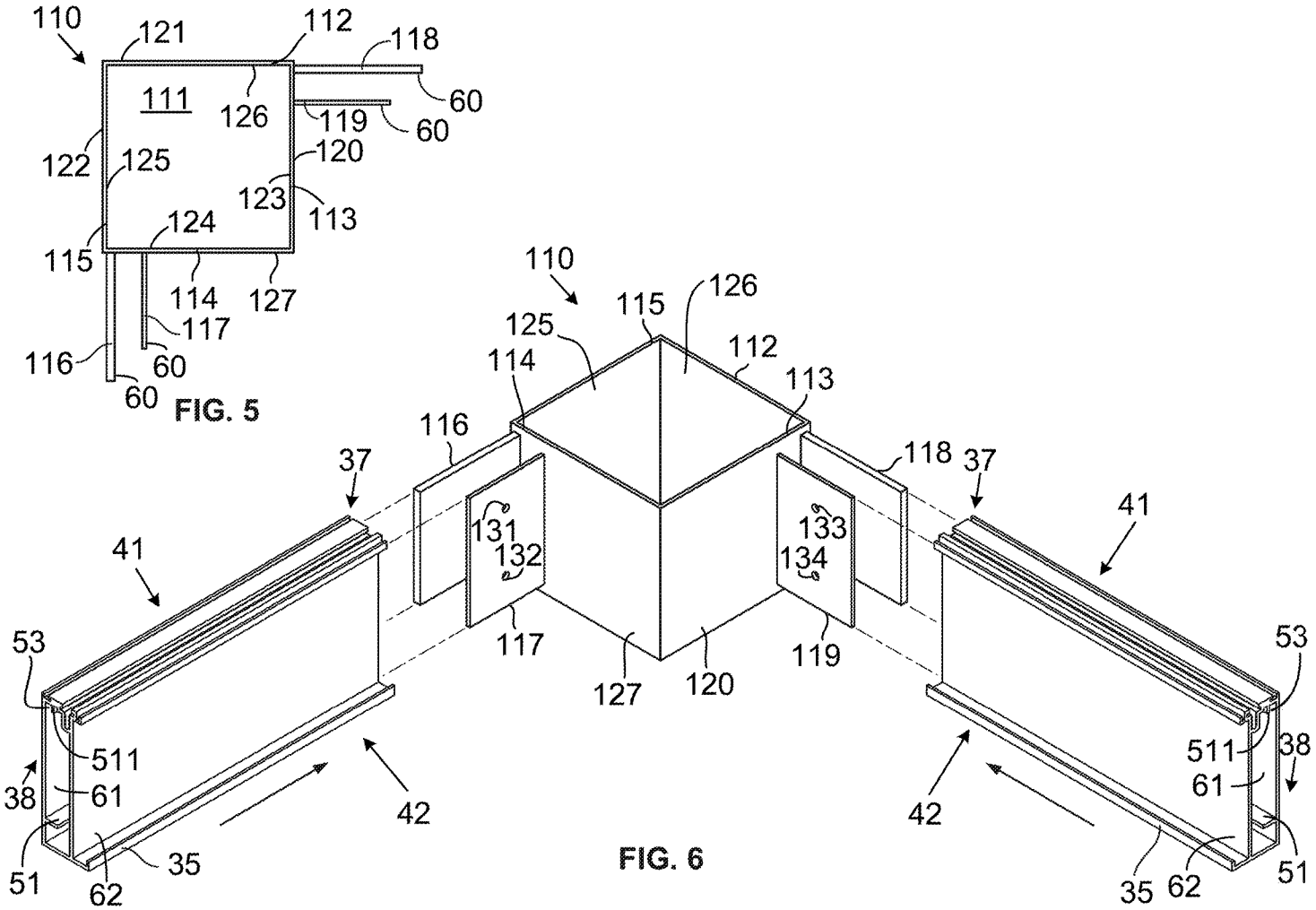
FIG. 6 is an isometric view of the post sleeve shown in FIG. 5 and attachable box-frame-segments.

Next, FIG. 6 is an isometric drawing showing two box-frame-segments 35 and additional details of the deck component 110, such as the exterior surface 127 of the side wall 114 and the exterior surface 120 of the side wall 113, as well as the interior surface 125 of the side wall 115 and the interior surface 126 of the side wall 112.

The flanges 116 and 117 can be positioned within one of the box-frame-segments 35. The flanges 118 and 119 can be positioned within the other box-frame-segment 35. The edge 37 being square cut allows for the edge 37 to contact the exterior surface of a side wall, such as the exterior surface 120 or 127. The edge 38 being square cut allows for the edge 38 to contact the exterior surface of the side wall of another deck component comprising a post sleeve. The flanges of the other post sleeve can be positioned within the box-frame-segment 35 at the edge 38. A top portion of the edges 37 and 38 contact the post sleeve 110 at an upper box-frame-segment contact point of the post sleeve 110. In this way, deck boards can be positioned flatly upon the post sleeve 110 and the box-frame-segments 35.

The flange 117 comprises attachment holes 131 and 132. The flange 119 comprises attachment holes 133 and 134. The attachment holes 131, 132, 133, and 134 can comprise through-holes. The flanges 117 and 119 can comprise a different number of attachment holes. The flanges 116 and 118 may not comprise any attachment holes because it may preferable to not mill attachment holes within the exterior sides 41 of the box-frame-segments 35 for aesthetic reasons. In an alternative arrangement, attachment holes could be milled into the flanges 116 and 118 for placement of fasteners through attachment holes milled into the exterior sides 41.

After the flanges 116 and 117 are positioned within the box-frame-segment 35, fasteners 50 (not shown in FIG. 6) can affix the deck component 110 to the box-frame-segments 35 in which the flanges 116 and 117 have been installed. The attachment holes 131 and 132 can be used as guides to drill corresponding attachment holes within the box-frame-segment 35. The fasteners 50 that affix the deck component 110 to the box-frame-segment 35 can comprise self-tapping screws or another type of fastener. The attachment holes in the box-frame-segment 35 for receiving fasteners placed through attachment holes 131 and 132 could be drilled before the flanges 116 and 117 are positioned within the box-frame-segment 35.

Similarly, after the flanges 118 and 119 are positioned within the box-frame-segment 35, fasteners 50 (not shown in FIG. 6) can affix the deck component 110 to the box-frame-segment 35 in which the flanges 118 and 119 have been installed. The attachment holes 133 and 134 can be used as guides to drill corresponding attachment holes within the box-frame-segment 35. The fasteners 50 that affix the deck component 110 to the box-frame-segment 35 can comprise self-tapping screws or another type of fastener. The attachment holes in the box-frame-segment 35 for receiving fasteners placed through attachment holes 133 and 134 could be drilled before the flanges 118 and 119 are positioned within the box-frame-segment 35.

The reinforcement shelf 51 can support the flange 116 or 118. The flange guide 53 can guide the flange 116 or 118 during installation of the flange 116 or 118 into the box-frame-segments 35.

Figure 7:
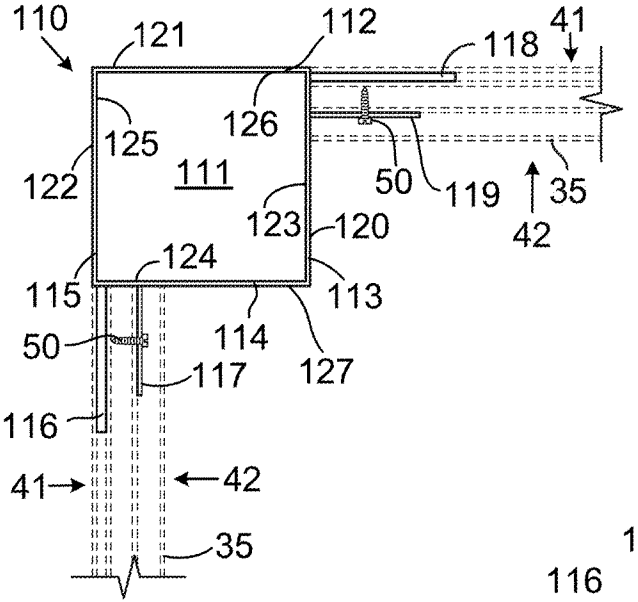
FIG. 7 is a plan view of the post sleeve shown in FIG. 5 with the box-frame-segments shown in FIG. 6 attached to the post sleeve.

Next, FIG. 7 is a plan view of the deck component 110 with the flanges 116 and 117 positioned within one box-frame-segment 35 and the flanges 118 and 119 positioned within another box-frame-segment 35, and fasteners 50 that affix the deck component 110 to the box-frame-segments 35.

Figure 8:
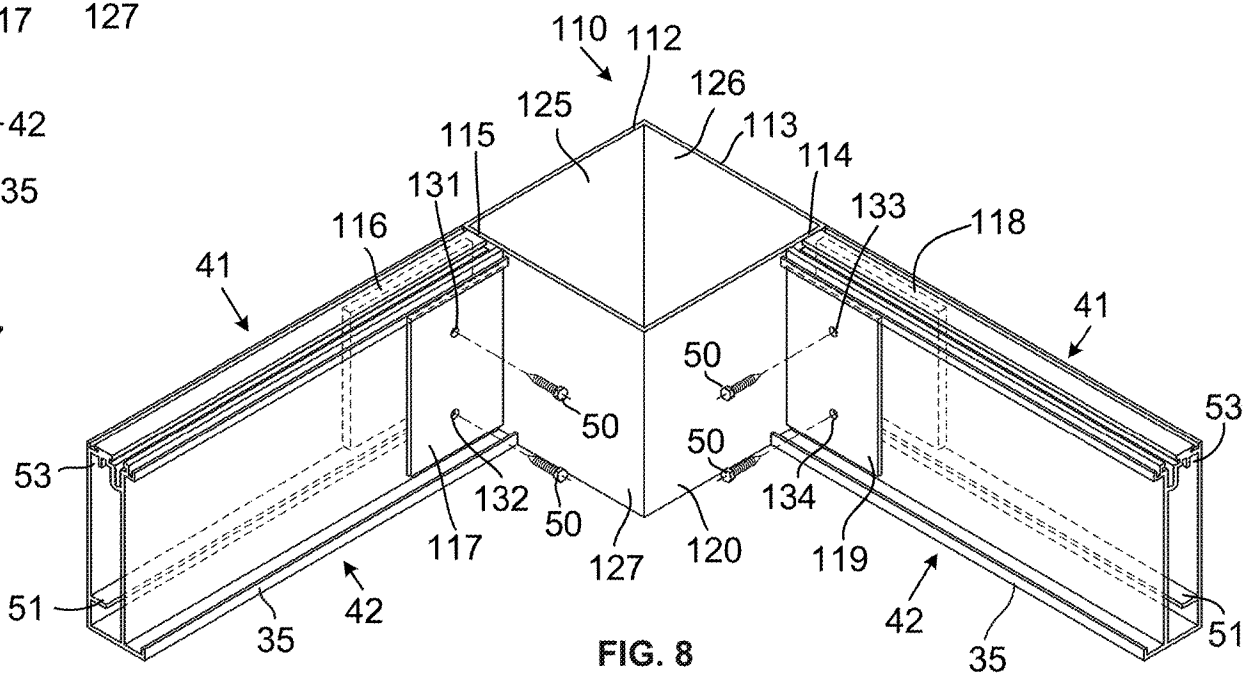
FIG. 8 is an isometric view of the post sleeve and the box-frame-segments shown in FIG. 7.

Next, FIG. 8 is an isometric view of the deck component 110 with the flanges 116 and 117 positioned within one box-frame-segment 35 and the flanges 118 and 119 positioned within another box-frame-segment 35, and fasteners 50 that affix the deck component 110 to the box-frame-segments 35.

The post sleeve 111 can be used as a post sleeve base within a multi-piece post sleeve. In this case, a post sleeve extender retainer of a post sleeve extender, such as the post sleeve extender 920 shown in FIG. 44, can be installed into the top of the post sleeve 111 and a post sleeve extension, such as the post sleeve extension 924 shown in FIG. 45.

Figure 9:
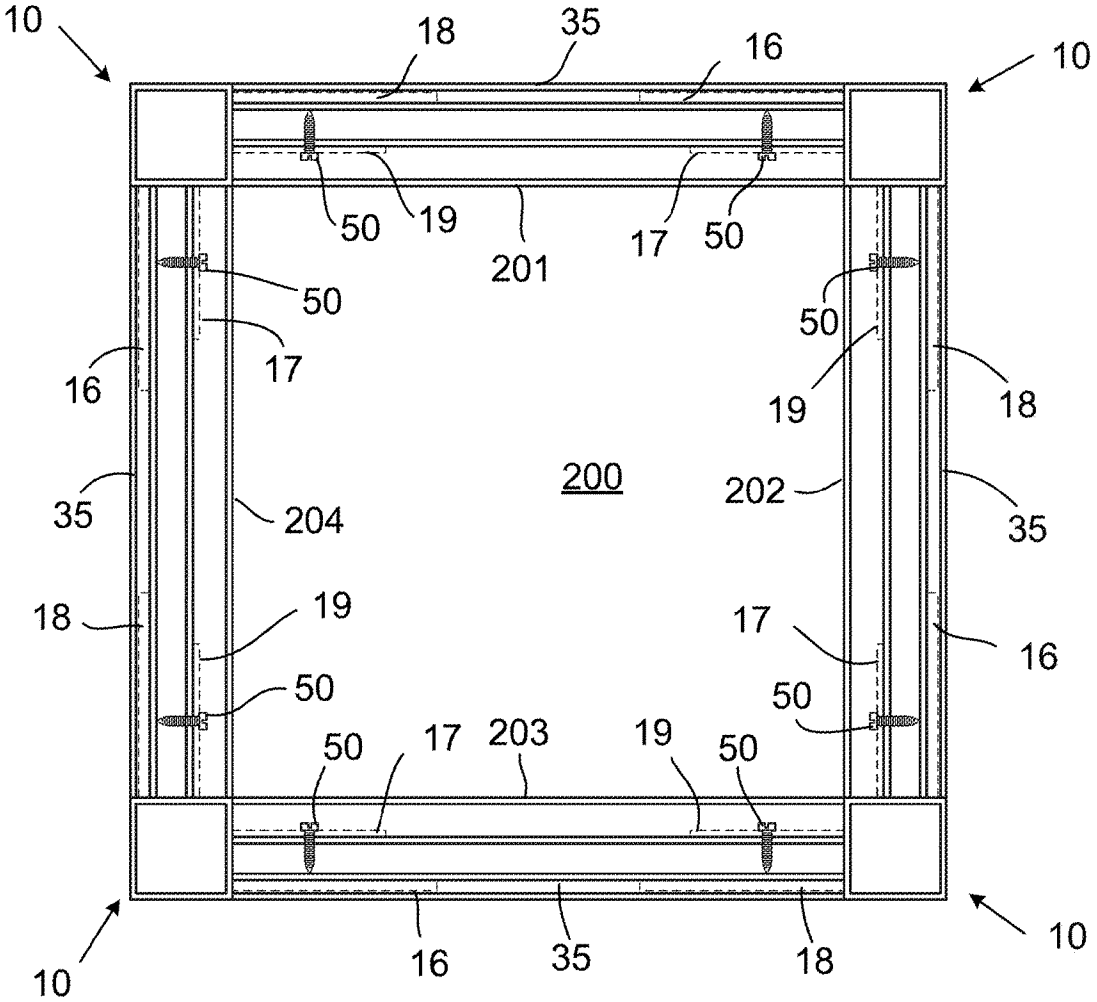
FIG. 9 and FIG. 10 are plan views of a box-frame perimeter comprising multiple post sleeves and box-frame-segments.

Next, FIG. 9 is a plan view of a box-frame-perimeter 200. The box-frame-perimeter 200 comprises four deck components 10 and four box-frame-segments 35. Each of the box-frame segments 35 of the box-frame-perimeter 200 connects to two of the deck components 10. Each of the box-frame-segments 35 of the box-frame-perimeter 200 includes a box-frame-segment attachment 201, 202, 203, or 204 attached. Each of the box-frame-segment attachments 201, 202, 203, or 204 can comprise one or more box-frame-segment attachments. Each box-frame-segment attachment of the box-frame-segment attachments 201, 202, 203, or 204 can be configured like the box-frame-segment attachment 526 show in FIG. 18. Joists (not shown) can be attached to two opposing box-frame-segment attachments, such as the box-frame-segment attachments 202 and 204. Deck boards (not shown) can be affixed to the box-frame-perimeter 200. The deck boards can be positioned flatly upon the deck components 10, the box-frame-segments 35 of the box-frame-perimeter 200, and the box-frame-segment attachments 201, 202, 203, or 204 in embodiments in which the deck components 10 do not include post sleeve extensions above the upper box-frame-segment contact point of the post sleeves 11.

A box-frame perimeter including deck components 10 could include other deck components including a post sleeve. For example, a box-frame perimeter could comprise a deck component 75 (shown in FIG. 11) to connect the upper box-frame segment 35 shown in FIG. 9 and another deck component 75 to connect the lower box-frame-segment 35 shown in FIG. 9 if a span of the upper and lower box-frame-segments 35 require additional posts to support the box-frame-segments due to the length of a span of the upper and lower box-frame-segments shown in FIG. 9. In this regard, the upper and lower box-frame-segments 35 can be cut into multiple box-frame-segments with square cut edges for connection to a deck component 10 and a deck component 75, or a deck component 125 shown in FIG. 12 or a deck component 260 shown in FIG. 13.

Figure 10:
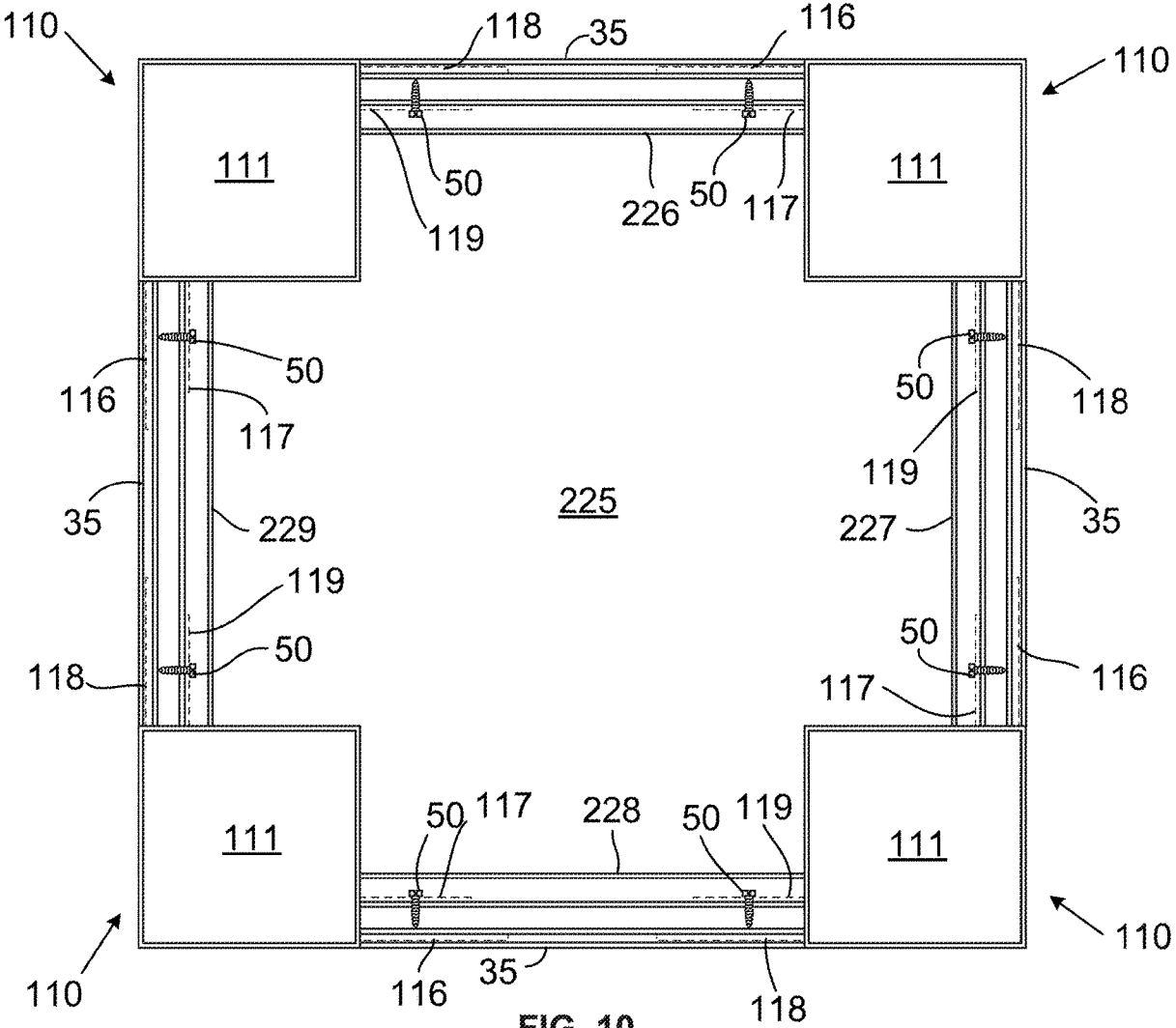

Next, FIG. 10 is a plan view of a box-frame-perimeter 225. The box-frame-perimeter 225 comprises four deck components 110 and four box-frame-segments 35. Each of the box-frame segments 35 of the box-frame-perimeter 225 connects to two of the deck components 110. Each of the box-frame-segments 35 of the box-frame-perimeter 225 includes a box-frame-segment attachment 226, 227, 228, or 229 attached. Each of the box-frame-segment attachments 226, 227, 228, or 229 can comprise one or more box-frame-segment attachments. Each box-frame-segment attachment of the box-frame-segment attachments 226, 227, 228, or 229 can be configured like the box-frame-segment attachment 526 show in FIG. 18. Joists (not shown) can be attached to two opposing box-frame-segment attachments, such as the box-frame-segment attachments 227 and 229. Deck boards (not shown) can be affixed to the box-frame-perimeter 225. The deck boards can be positioned flatly upon the deck components 110, the box-frame-segments 35 of the box-frame-perimeter 225, and the box-frame-segment attachments 226, 227, 228, or 229 in embodiments in which the deck components 110 do not include post sleeve extensions above the upper box-frame-segment contact point of the post sleeves 111.

A box-frame perimeter including deck components 110 could include other deck components including a post sleeve. For example, a box-frame perimeter could comprise a deck component 315 (shown in FIG. 14) to connect the upper box-frame segment 35 shown in FIG. 10 and another deck component 315 to connect the lower box-frame-segment 35 shown in FIG. 10 if a span of the upper and lower box-frame-segments 35 require additional posts to support the box-frame-segments due to the length of a span of the upper and lower box-frame-segments shown in FIG. 10. In this regard, the upper and lower box-frame-segments 35 can be cut into multiple box-frame-segments with square cut edges for connection to a deck component 110 and a deck component 315, or a deck component 350 shown in FIG. 15 or a deck component 400 shown in FIG. 16.

Figure 11:
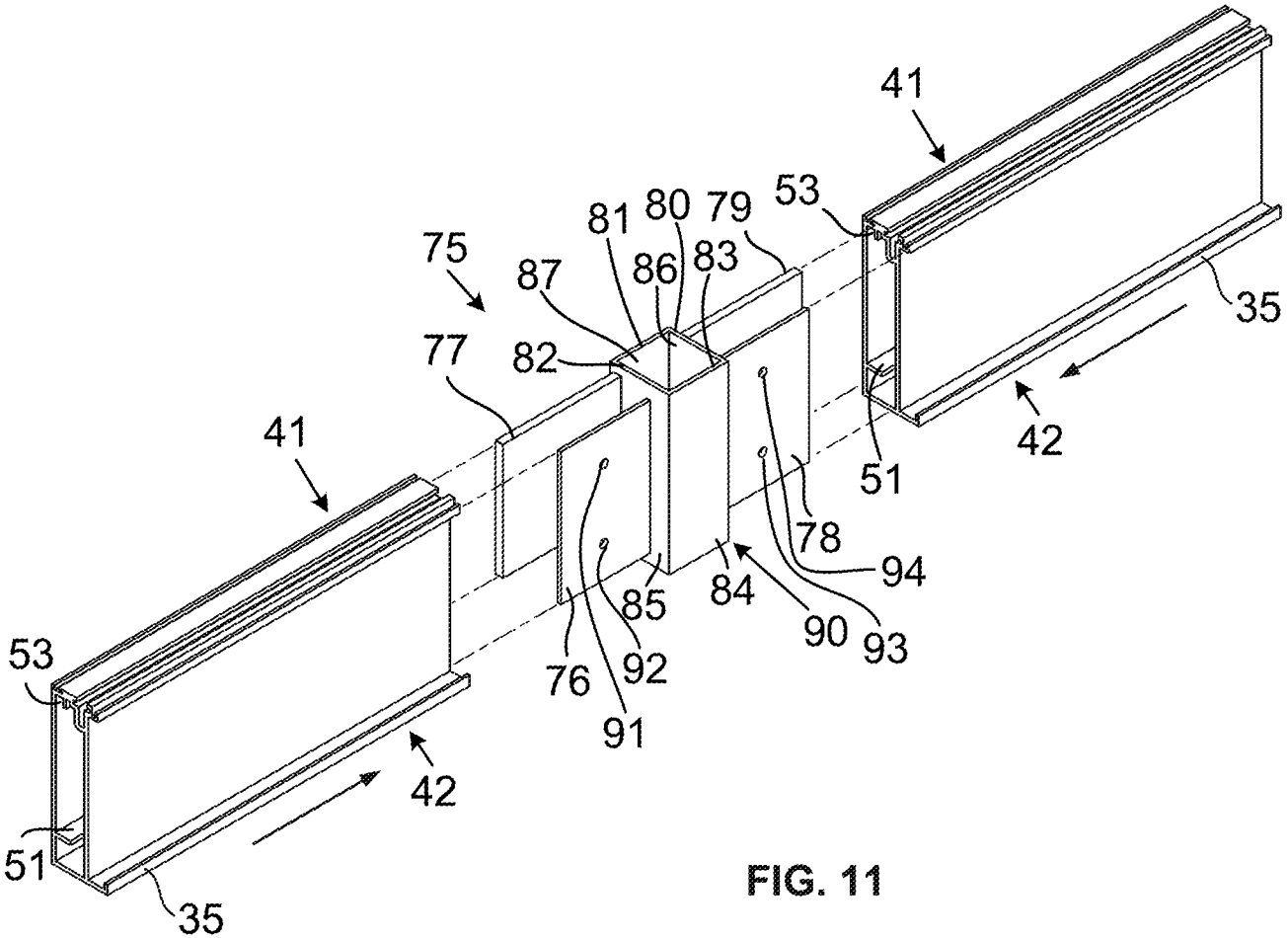
FIG. 11, FIG. 12, FIG. 13, FIG. 14, FIG. 15, FIG. 16, and FIG. 17 are isometric views of example post sleeves and the box-frame-segments.
Figure 12:
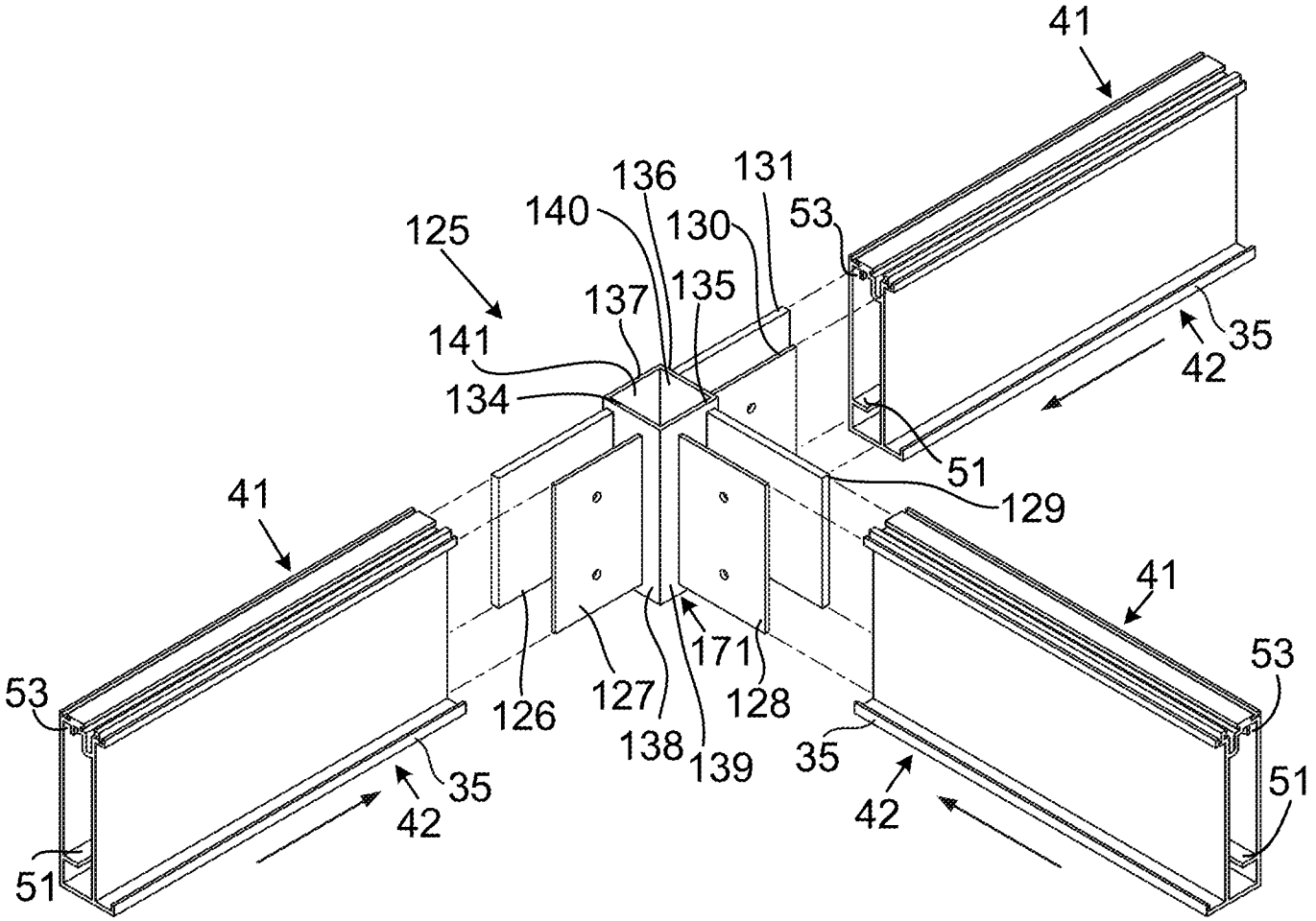
Figure 13:
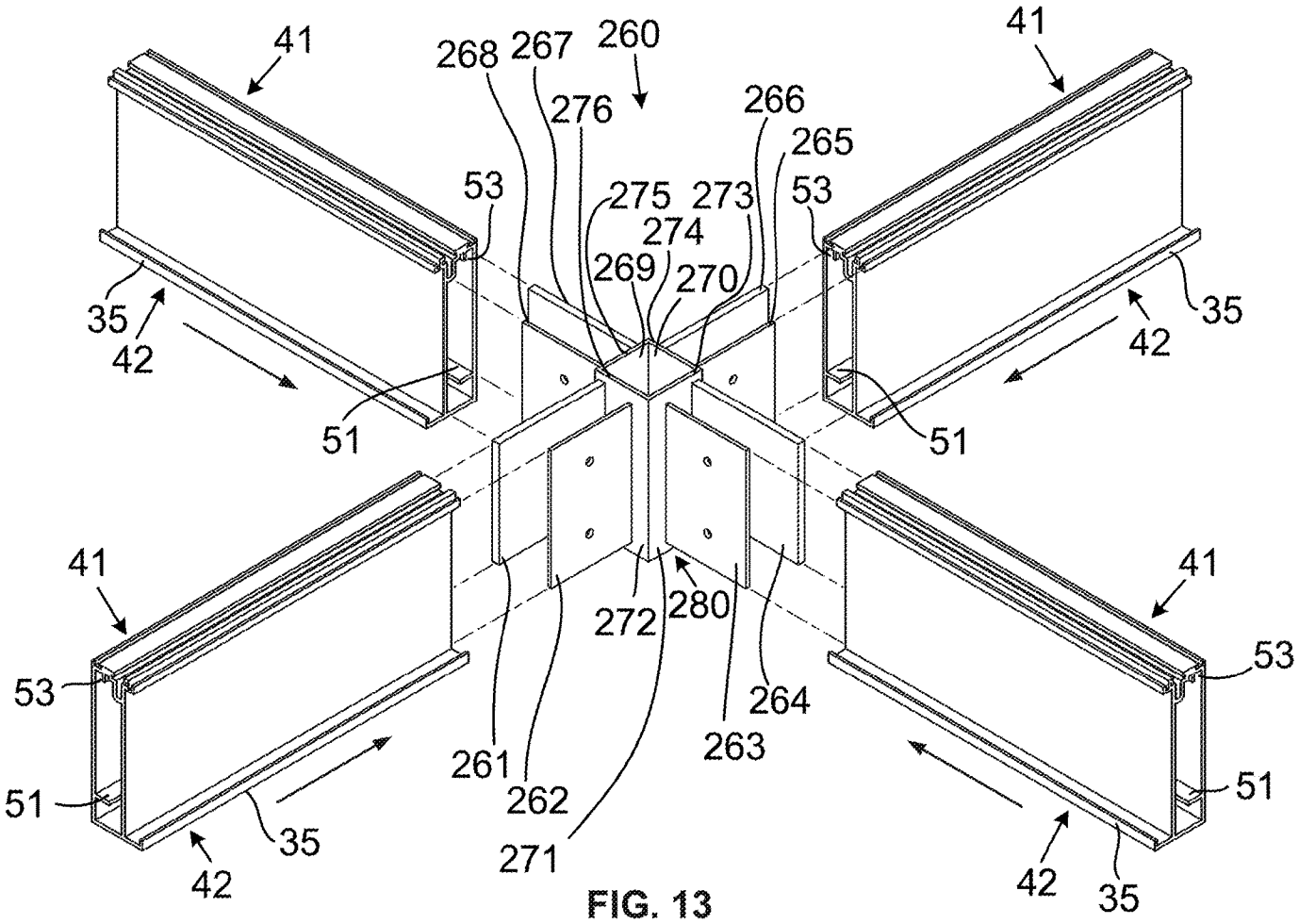

Next, FIG. 11, FIG. 12, and FIG. 13 depict additional example embodiments of deck components comprising a post sleeve and flanges on multiple side walls of the post sleeve. The dimensions of the post sleeves and flanges shown in FIG. 11, FIG. 12, and FIG. 13 can be the same as example dimensions discussed with respect to the deck component 10. Alternatively, one or more of the post sleeves or the flanges of the deck components shown in FIG. 11, FIG. 12, and FIG. 13 can have dimensions different than the example dimension described with respect to the deck component 10. The post sleeves shown in FIG. 11, FIG. 12, and FIG. 13 can be used as a post sleeve base of a multi-piece post sleeve that also include a post sleeve extender and a post sleeve extension.

In particular, FIG. 11 shows a deck component 75 with flanges on two opposing side walls of four side walls of a post sleeve, FIG. 12 shows a deck component 125 with flanges on three of four side walls of a post sleeve, and FIG. 13 shows a deck component 260 with flanges on each of four side walls of a post sleeve. These embodiments differ from the deck component 10 that has flanges on two adjacent side walls only. The flanges on the deck components 75, 125, and 260 are configured for being positioned within box-frame-segments 35. The exterior surfaces of the side walls for the deck components 10, 75, 125 and 260 are flat so that a square-cut edge of the box-frame-segment 35 can be positioned flush against a side wall (i.e., in contact with each other).

As shown in FIG. 11, the deck component 75 includes a post sleeve 90. The post sleeve 90 comprises side walls 80, 81, 82, and 83 (or more simply, "side walls 80 to 83"). The deck component 75 comprises flanges 76 and 77 that extend from the side wall 82, and flanges 78 and 79 that extend from the side wall 80. The flanges 75 and 76 can abut the side wall 82 at an exterior surface of the side wall 82 or within a slot within the side wall 82. The flanges 78 and 79 can abut the side wall 80 at an exterior surface of the side wall 80 or within a slot within the side wall 80.

The post sleeve 90 is open above the side walls 80 to 83. The post sleeve 90 is open below the side walls 80 to 83. A post can enter the post sleeve 90 from above the side walls 80 to 83 or from below the side walls 80 to 83. A post sleeve extender retainer of a post sleeve extender, such as the post sleeve extender 920 shown in FIG. 44, can be positioned within the post sleeve 90 from above the side walls 80 to 83. Each side wall in the post sleeve 90 comprises an interior surface and an exterior surface. FIG. 11 shows an interior surface 86 of the side wall 80, an interior surface 87 of the side wall 82, an exterior surface 85 of the side wall 82, and an exterior surface 84 of the side wall 83.

As an example, the post sleeve 90 and the flanges 76, 77, 78, and 79 (or more simply, "flanges 76 to 79") can be formed by extruding a metal billet through a die as a single extruded deck component comprising the post sleeve 90 and the flanges 76 to 79. The flanges 76 to 79 formed by extrusion can be milled to lower the top surfaces of the flanges 76 to 79 below the top surface of the post sleeve 90 and to raise the bottom surfaces of the flanges 76 to 79 above the bottom surface of the post sleeve 90. Milling the 76 to 79 formed by extrusion allows the flanges 76 and 77 to be positioned within one box-frame-segment 35 shown in FIG. 11 and the flanges 78 and 79 to be positioned within another box-frame-segment 35 shown in FIG. 11.

As another example, the post sleeve 90 and the flanges 76 to 79 can be formed by casting a metal as a single cast deck component comprising the post sleeve 90 and the flanges 76 to 79. The mold used to form the single cast deck component can be formed to minimize or eliminate the need to mill the flanges 76 to 79 to fit within the box-frame-segment 35.

As yet another example, the post sleeve 90 can be formed by extruding or casting a metal and the flanges 76 to 79 can be formed by extruding, casting or rolling a metal. In this example, the deck component 75 can be formed by affixing the flanges 76 to 79 to the post sleeve 90. The flanges 76 and 77 can be affixed to the post sleeve 90 by welding the flanges 76 and 77 to the exterior surface 85 of the post sleeve 90. The flanges 78 and 79 can be affixed to the post sleeve 90 by welding the flanges 78 and 79 to the exterior surface of the side wall 80. Slots can be formed or machined in post sleeve 90 and the flanges 76 to 79 can be positioned within the slots prior to being welded to the post sleeve 90.

The flange 76 comprises attachment holes 91 and 92 for affixing the flange 76 to one of the box-frame-segments 35 shown in FIG. 11 using fasteners 50 (not shown). The flange 78 comprises attachment holes 93 and 94 for affixing the flange 78 to another of the box-frame-segments 35 shown in FIG. 11 using fasteners 50 (not shown).

Next, as shown in FIG. 12, the deck component 125 includes a post sleeve 171. The post sleeve 171 comprises side walls 134, 135, 136, and 137 (or more simply, "side walls 134 to 137"). The deck component 125 comprises flanges 126 and 127 that extend from the side wall 134, flanges 128 and 129 that extend from the side wall 135, and flanges 130 and 131 that extend from the side wall 136. The flanges 126 and 127 can abut the side wall 134 at an exterior surface of the side wall 134 or within a slot within the side wall 134. The flanges 128 and 129 can abut the side wall 135 at an exterior surface of the side wall 135 or within a slot within the side wall 135. The flanges 130 and 131 can abut the side wall 136 at an exterior surface of the side wall 136 or within a slot within the side wall 136.

The post sleeve 171 is open above the side walls 134 to 137. The post sleeve 171 is open below the side walls 134 to 137. A post can enter the post sleeve 171 from above the side walls 134 to 137 or from below the side walls 134 to 137. A post sleeve extender retainer of a post sleeve extender, such as the post sleeve extender 920 shown in FIG. 44, can be positioned within the post sleeve 171 from above the side walls 134 to 137. Each side wall in the post sleeve 171 comprises an interior surface and an exterior surface. FIG. 12 shows an interior surface 140 of the side wall 136, an interior surface 141 of the side wall 137, an exterior surface 138 of the side wall 134, and an exterior surface 139 of the side wall 135.

As an example, the post sleeve 171 and the flanges 126, 127, 128, 129, 130, and 131 (or more simply, "flanges 126 to 131") can be formed by extruding a metal billet through a die as a single extruded deck component comprising the post sleeve 171 and the flanges 126 to 131. The flanges 126 to 131 formed by extrusion can be milled to lower the top surfaces of the flanges 126 to 131 below the top surface of the post sleeve 171 and to raise the bottom surfaces of the flanges 126 to 131 above the bottom surface of the post sleeve 171. Milling the flanges 126 to 131 formed by extrusion allows the flanges 126 and 127 to be positioned within one box-frame-segment 35 shown in FIG. 12, the flanges 128 and 129 to be positioned within another box-frame-segment 35 shown in FIG. 12, and the flanges 130 and 131 to be positioned within yet another box-frame-segment 35 shown in FIG. 12.

As another example, the post sleeve 171 and the flanges 126 to 131 can be formed by casting a metal as a single cast deck component comprising the post sleeve 171 and the flanges 126 to 131. The mold used to form the single cast deck component can be formed to minimize or eliminate the need to mill the flanges 126 to 131 to fit within the box-frame-segments 35.

As yet another example, the post sleeve 171 can be formed by extruding or casting a metal and the flanges 126 to 131 can be formed by extruding, casting or rolling a metal. In this example, the deck component 125 can be formed by affixing the flanges 126 to 131 to the post sleeve 171. The flanges 126 and 127 can be affixed to the post sleeve 171 by welding the flanges 126 and 127 to the exterior surface 138 of the post sleeve 171. The flanges 128 and 129 can be affixed to the post sleeve 171 by welding the flanges 128 and 129 to the exterior surface of the side wall 135. The flanges 130 and 131 can be affixed to the post sleeve 171 by welding the flanges 130 and 131 to the exterior surface of the side wall 136.

The flange 127, the flange 128, and the flange 130 comprise attachment holes for affixing the flanges 127, 128, and 130 to a respective box-frame-segment 35 shown in FIG. 12 using fasteners 50 (not shown). The flanges 127, 128, and 129 can comprise a different number of attachment holes than shown in FIG. 12. The flanges 126, 129, and 130 may not comprise any attachment holes because it may preferable to not mill attachment holes within the exterior sides 41 of the box-frame-segments 35 for aesthetic reasons. In an alternative arrangement, attachment holes could be milled into the flanges 126, 129, and 130 for placement of fasteners through attachment holes milled into the exterior sides 41.

Next, as shown in FIG. 13, the deck component 260 includes a post sleeve 280. The post sleeve 280 comprises side walls 273, 274, 275, and 276 (or more simply, "side walls 273 to 276"). The deck component 260 comprises flanges 261 and 262 that extend from the side wall 276, flanges 263 and 264 that abut the side wall 273, flanges 265 and 266 that extend from the side wall 273, and the flanges 267 and 268 that extend from the side wall 275. The flanges 261 and 262 can abut the side wall 276 at an exterior surface of the side wall 276 or within a slot within the side wall 276. The flanges 263 and 264 can abut the side wall 273 at an exterior surface of the side wall 273 or within a slot within the side wall 273. The flanges 265 and 266 can abut the side wall 275 at an exterior surface of the side wall 275 or within a slot within the side wall 275.

The post sleeve 280 is open above the side walls 273 to 276. The post sleeve 280 is open below the side walls 273 to 276. A post can enter the post sleeve 280 from above the side walls 273 to 276 or from below the side walls 273 to 276. A post sleeve extender retainer of a post sleeve extender, such as the post sleeve extender 920 shown in FIG. 44, can be positioned within the post sleeve 280 from above the side walls 273 to 276. Each side wall in the post sleeve 280 comprises an interior surface and an exterior surface. FIG. 13 shows an interior surface 270 of the side wall 274, an interior surface 269 of the side wall 275, an exterior surface 272 of the side wall 276, and an exterior surface 271 of the side wall 273.

As an example, the post sleeve 280 and the flanges 261, 262, 263, 264, 265, 266, 267, and 268 (or more simply, "flange 261 to 268") can be formed by extruding a metal billet through a die as a single extruded deck component comprising the post sleeve 280 and the flanges 261 to 268. The flanges 261 to 268 formed by extrusion can be milled to lower the top surfaces of the flanges 261 to 268 below the top surface of the post sleeve 280 and to raise the bottom surfaces of the flanges 261 to 268 above the bottom surface of the post sleeve 280. Milling the flanges 261 to 268 formed by extrusion allows the flanges 261 and 262 to be positioned within one box-frame-segment 35 shown in FIG. 13, the flanges 263 and 264 to be positioned within another box-frame-segment 35 shown in FIG. 13, the flanges 265 and 266 to be positioned within yet another box-frame-segment 35 shown in FIG. 13, and the flanges 267 and 268 to be positioned within still yet another box-frame-segment 35 shown in FIG. 13.

As another example, the post sleeve 280 and the flanges 261 to 268 can be formed by casting a metal as a single cast deck component comprising the post sleeve 280 and the flanges 261 to 268. The mold used to form the single cast deck component can be formed to minimize or eliminate the need to mill the flanges 261 to 268 to fit within the box-frame-segments 35.

As yet another example, the post sleeve 280 can be formed by extruding or casting a metal and the flanges 261 to 268 can be formed by extruding, casting or rolling a metal. In this example, the deck component 260 can be formed by affixing the flanges 261 to 268 to the post sleeve 280. The flanges 261 and 262 can be affixed to the post sleeve 280 by welding the flanges 261 and 262 to the exterior surface 272 of the post sleeve 280. The flanges 263 and 264 can be affixed to the post sleeve 280 by welding the flanges 263 and 264 to the exterior surface 280. The flanges 265 and 266 can be affixed to the post sleeve 280 by welding the flanges 265 and 266 to the exterior surface of the side wall 274. The flanges 267 and 268 can be affixed to the post sleeve 280 by welding the flanges 267 and 268 to the exterior surface of the side wall 275.

The flange 262, the flange 263, the flange 265, and the flange 267 comprise attachment holes for affixing the flanges 262, 263, 265, and 267 to a respective box-frame-segment 35 shown in FIG. 13 using fasteners 50 (not shown). The flanges 262, 263, 265, and 267 can comprise a different number of attachment holes than shown in FIG. 13. The flanges 261, 264, 266, and 267 may not comprise any attachment holes because it may preferable to not mill attachment holes within the exterior sides 41 of the box-frame-segments 35 for aesthetic reasons. In an alternative arrangement, attachment holes could be milled into the flanges 261, 264, 266, and 267 for placement of fasteners through attachment holes milled into the exterior sides 41.

Figure 14:
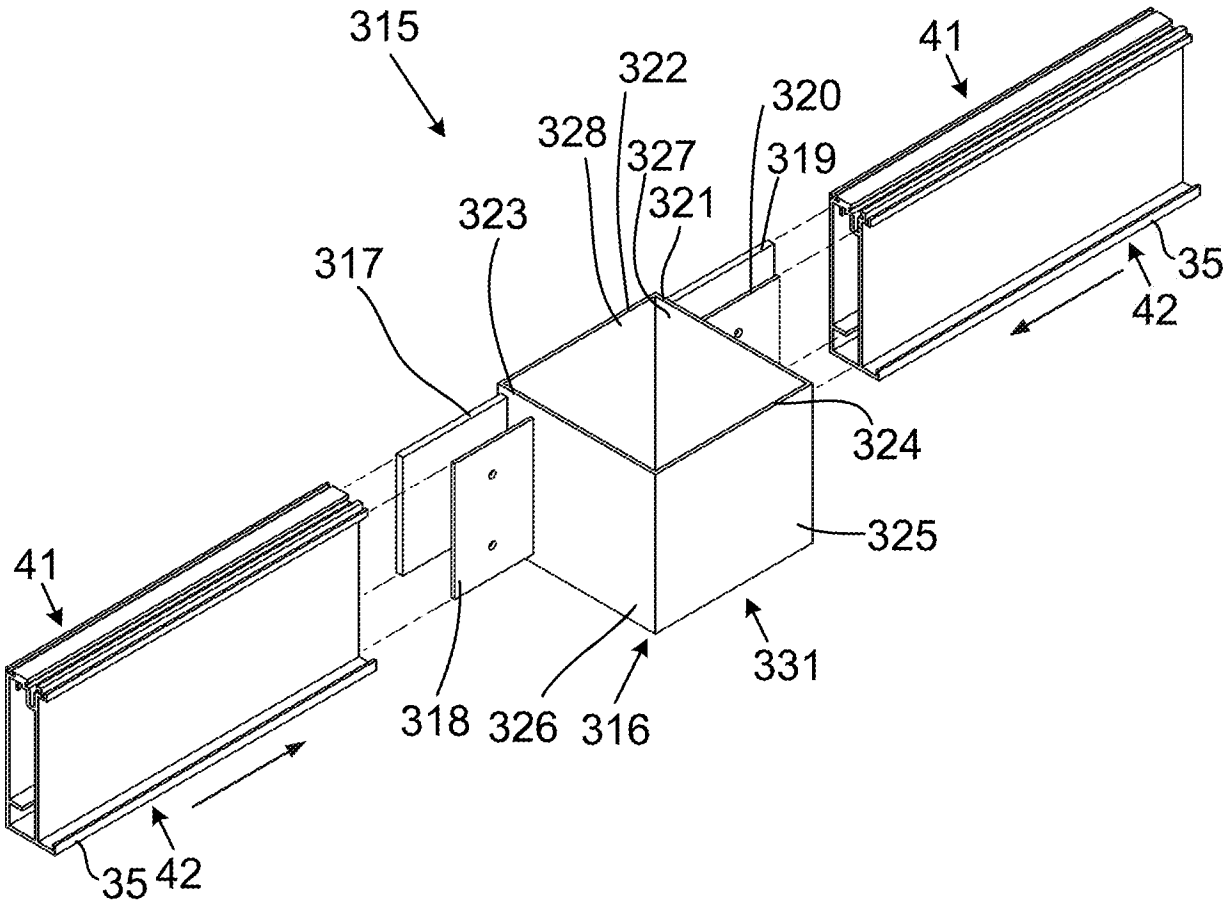
Figure 15:
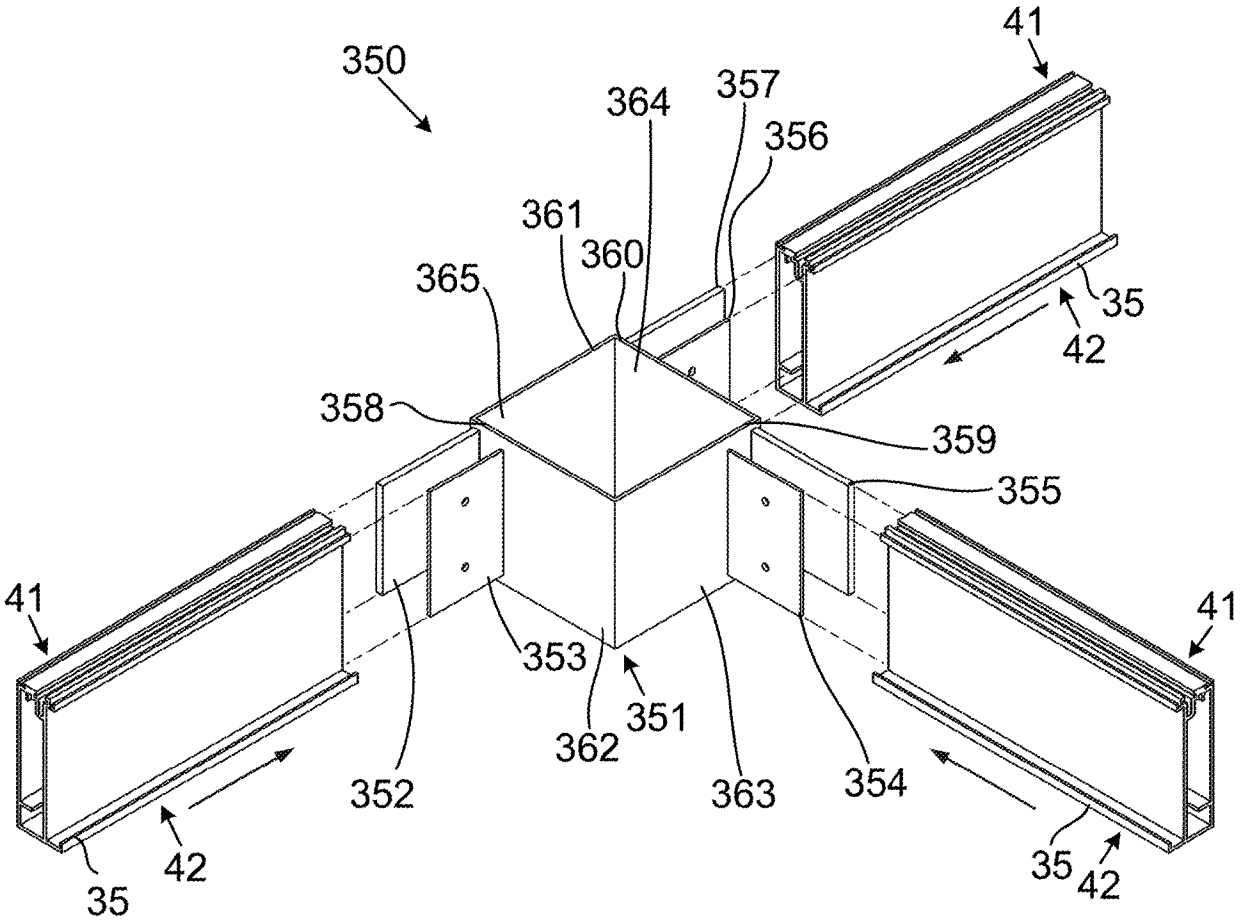
Figure 16:
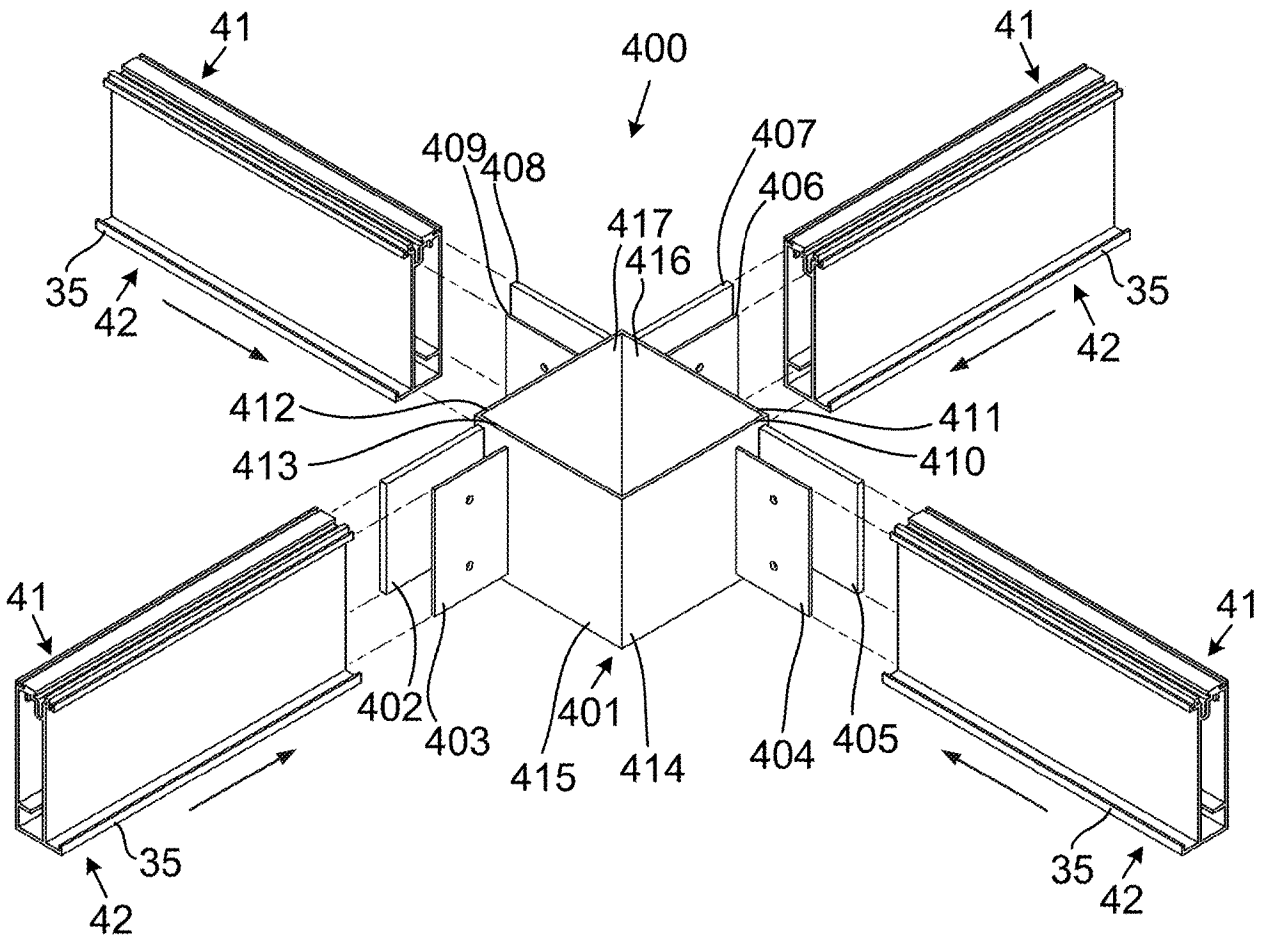

Next, FIG. 14, FIG. 15, and FIG. 16 depict additional example embodiments of deck components comprising a post sleeve and flanges on multiple side walls of the post sleeve. The dimensions of the post sleeves and flanges shown in FIG. 14, FIG. 15, and FIG. 16 can be the same as example dimensions discussed with respect to the deck component 110. Alternatively, one or more of the post sleeves or the flanges of the deck components shown in FIG. 14, FIG. 15, and FIG. 16 can have dimensions different than the example dimension described with respect to the deck component 110. The post sleeves shown in FIG. 14, FIG. 15, and FIG. 16 can be used as a post sleeve base of a multi-piece post sleeve that also include a post sleeve extender and a post sleeve extension.

In particular, FIG. 14 shows a deck component 315 with flanges on two opposing side walls of four side walls of a post sleeve, FIG. 15 shows a deck component 350 with flanges on three of four side walls of a post sleeve, and FIG. 16 shows a deck component 400 with flanges on each of four side walls of a post sleeve. These embodiments differ from the deck component 110 that has flanges on two adjacent side walls only. The flanges on the deck components 315, 350, and 400 are configured for being positioned within box-frame-segments 35. The exterior surfaces of the side walls for the deck components 110, 315, 300, and 400 are flat so that a square-cut edge of the box-frame-segment 35 can be positioned flush against a side wall (i.e., in contact with each other).

As shown in FIG. 14, the deck component 315 includes a post sleeve 331. The post sleeve 331 comprises side walls 321, 322, 323, and 324 (or more simply "side walls 321 to 324"). The deck component 315 comprises flanges 317 and 318 that extend from the side wall 323, and flanges 319 and 320 that extend from the side wall 321. The flanges 317 and 318 can abut the side wall 323 at an exterior surface of the side wall 323 or within a slot within the side wall 323. The flanges 319 and 320 can abut the side wall 321 at an exterior surface of the side wall 321 or within a slot within the side wall 321.

The post sleeve 331 is open above the side walls 321 to 324. The post sleeve 331 is open below the side walls 321 to 324. A post can enter the post sleeve 331 from above the side walls 321 to 324 or from below the side walls 321 to 324. A post sleeve extender retainer of a post sleeve extender, such as the post sleeve extender 920 shown in FIG. 44, can be positioned within the post sleeve 331 from above the side walls 321 to 324. Each side wall in the post sleeve 331 comprises an interior surface and an exterior surface. FIG. 14 shows an interior surface 327 of the side wall 321, an interior surface 328 of the side wall 322, an exterior surface 326 of the side wall 323, and an exterior surface 325 of the side wall 324.

As an example, the post sleeve 331 and the flanges 317, 318, 319, and 320 (or more simply "flanges 317 to 320") can be formed by extruding a metal billet through a die as a single extruded deck component comprising the post sleeve 331 and the flanges 317 to 320. The flanges 317 to 320 formed by extrusion can be milled to lower the top surfaces of the flanges 317 to 320 below the top surface of the post sleeve 331 and to raise the bottom surfaces of the flanges 317 to 320 above the bottom surface of the post sleeve 331. Milling the flanges 317 to 320 formed by extrusion allows the flanges 317 and 318 to be positioned within one box-frame-segment 35 shown in FIG. 14 and the flanges 319 and 320 to be positioned within another box-frame-segment 35 shown in FIG. 14.

As another example, the post sleeve 331 and the flanges 317 to 320 can be formed by casting a metal as a single cast deck component comprising the post sleeve 331 and the flanges 317 to 320. The mold used to form the single cast deck component can be formed to minimize or eliminate the need to mill the flanges 317 to 320 to fit within the box-frame-segment 35.

As yet another example, the post sleeve 331 can be formed by extruding or casting a metal and the flanges 317 to 320 can be formed by extruding, casting or rolling a metal. In this example, the deck component 315 can be formed by affixing the flanges 317 to 320 to the post sleeve 331. The flanges 317 and 318 can be affixed to the post sleeve 331 by welding the flanges 317 and 318 to the exterior surface 326 of the post sleeve 331. The flanges 319 and 320 can be affixed to the post sleeve 331 by welding the flanges 319 and 320 to the exterior surface of the side wall 321.

The flange 318 and the flange 320 comprise attachment holes for affixing the flanges 318 and 320 to a respective box-frame-segment 35 shown in FIG. 14 using fasteners 50 (not shown). The flanges 318 and 320 can comprise a different number of attachment holes than shown in FIG. 14. The flanges 317 and 319 may not comprise any attachment holes because it may preferable to not mill attachment holes within the exterior sides 41 of the box-frame-segments 35 for aesthetic reasons. In an alternative arrangement, attachment holes could be milled into the flanges 317 and 319 for placement of fasteners through attachment holes milled into the exterior sides 41.

Next, as shown in FIG. 15, the deck component 350 includes a post sleeve 351. The post sleeve 351 comprises side walls 358, 359, 360, and 361 (or more simply, "side walls 358 to 361"). The deck component 350 comprises flanges 352 and 353 that extend from the side wall 358, flanges 354 and 355 that extend from the side wall 359, and flanges 356 and 357 that abut the side wall 360. The flanges 352 and 353 can abut the side wall 358 at an exterior surface of the side wall 358 or within a slot within the side wall 358. The flanges 354 and 355 can abut the side wall 359 at an exterior surface of the side wall 359 or within a slot within the side wall 359. The flanges 356 and 357 can abut the side wall 358 at an exterior surface of the side wall 358 or within a slot within the side wall 358.

The post sleeve 351 is open above the side walls 358 to 361. The post sleeve 351 is open below the side walls 358 to 361. A post can enter the post sleeve 351 from above the side walls 358 to 361 or from below the side walls 358 to 361. A post sleeve extender retainer of a post sleeve extender, such as the post sleeve extender 920 shown in FIG. 44, can be positioned within the post sleeve 351 from above the side walls 358 to 361. Each side wall in the post sleeve 351 comprises an interior surface and an exterior surface. FIG. 15 shows an interior surface 364 of the side wall 360, an interior surface 365 of the side wall 361, an exterior surface 362 of the side wall 358, and an exterior surface 363 of the side wall 359.

As an example, the post sleeve 351 and the flanges 352, 353, 354, 355, 356, and 357 (or more simply, "flanges 352 to 357") can be formed by extruding a metal billet through a die as a single extruded deck component comprising the post sleeve 351 and the flanges 352 to 357. The flanges 352 to 357 formed by extrusion can be milled to lower the top surfaces of the flanges 352 to 357 below the top surface of the post sleeve 351 and to raise the bottom surfaces of the flanges 352 to 357 above the bottom surface of the post sleeve 351. Milling the flanges 352 to 357 formed by extrusion allows the flanges 352 and 353 to be positioned within one box-frame-segment 35 shown in FIG. 15, the flanges 354 and 355 to be positioned within another box-frame-segment 35 shown in FIG. 15, and the flanges 356 and 357 to be positioned within yet another box-frame-segment 35 shown in FIG. 15.

As another example, the post sleeve 351 and the flanges 352 to 357 can be formed by casting a metal as a single cast deck component comprising the post sleeve 351 and the flanges 352 to 357. The mold used to form the single cast deck component can be formed to minimize or eliminate the need to mill the flanges 352 to 357 to fit within the box-frame-segments 35.

As yet another example, the post sleeve 351 can be formed by extruding or casting a metal and the flanges 352 to 357 can be formed by extruding, casting or rolling a metal. In this example, the deck component 350 can be formed by affixing the flanges 352 to 357 to the post sleeve 351. The 352 and 353 can be affixed to the post sleeve 351 by welding the flanges 352 and 353 to the exterior surface 362 of the post sleeve 351. The flanges 354 and 355 can be affixed to the post sleeve 351 by welding the flanges 354 and 355 to the exterior surface 363. The flanges 356 and 357 can be affixed to the post sleeve 351 by welding the flanges 356 and 357 to the exterior surface of the side wall 360.

The flange 353, the flange 354, and the flange 356 comprise attachment holes for affixing the flanges 353, 354, and 356 to a respective box-frame-segment 35 shown in FIG. 15 using fasteners 50 (not shown). The flanges 353, 354, and 356 can comprise a different number of attachment holes than shown in FIG. 15. The flanges 352, 355, and 357 may not comprise any attachment holes because it may preferable to not mill attachment holes within the exterior sides 41 of the box-frame-segments 35 for aesthetic reasons. In an alternative arrangement, attachment holes could be milled into the flanges 352, 355, and 357 for placement of fasteners through attachment holes milled into the exterior sides 41.

Next, as shown in FIG. 16, the deck component 400 includes a post sleeve 401. The post sleeve 401 comprises side walls 410, 411, 412, and 413 (or more simply, "side walls 410 to 413"). The deck component 400 comprises flanges 402 and 403 that extend from the side wall 413, flanges 404 and 405 that extend from the side wall 410, flanges 406 and 407 that extend from the side wall 411, and the flanges 408 and 409 that extend from the side wall 412. The flanges 402 and 403 can abut the side wall 413 at an exterior surface of the side wall 413 or within a slot within the side wall 413. The flanges 404 and 405 can abut the side wall 410 at an exterior surface of the side wall 410 or within a slot within the side wall 410. The flanges 406 and 407 can abut the side wall 411 at an exterior surface of the side wall 411 or within a slot within the side wall 411. The flanges 408 and 409 can abut the side wall 412 at an exterior surface of the side wall 412 or within a slot within the side wall 412.

The post sleeve 401 is open above the side walls 410 to 413. The post sleeve 401 is open below the side walls 410 to 413. A post can enter the post sleeve 401 from above the side walls 410 to 413 or from below the side walls 410 to 413. A post sleeve extender retainer of a post sleeve extender, such as the post sleeve extender 920 shown in FIG. 44, can be positioned within the post sleeve 401 from above the side walls 410 to 413. Each side wall in the post sleeve 401 comprises an interior surface and an exterior surface. FIG. 16 shows an interior surface 416 of the side wall 411, an interior surface 417 of the side wall 412, an exterior surface 415 of the side wall 413, and an exterior surface 414 of the side wall 410.

As an example, the post sleeve 401 and the flanges 402, 403, 404, 405, 406, 407, 408, and 409 (or more simply, "flanges 402 to 409") can be formed by extruding a metal billet through a die as a single extruded deck component comprising the post sleeve 401 and the flanges 402 to 409. The flanges 402 to 409 formed by extrusion can be milled to lower the top surfaces of the flanges 402 to 409 below the top surface of the post sleeve 401 and to raise the bottom surfaces of the flanges 402 to 409 above the bottom surface of the post sleeve 401. Milling the flanges 402 to 409 formed by extrusion allows the flanges 402 and 403 to be positioned within one box-frame-segment 35 shown in FIG. 16, the flanges 404 and 405 to be positioned within another box-frame-segment 35 shown in FIG. 16, the flanges 406 and 407 to be positioned within yet another box-frame-segment 35 shown in FIG. 16, and the flanges 408 and 409 to be positioned within still yet another box-frame-segment 35 shown in FIG. 16.

As another example, the post sleeve 401 and the flanges 402 to 409 can be formed by casting a metal as a single cast deck component comprising the post sleeve 401 and the flanges 402 to 409. The mold used to form the single cast deck component can be formed to minimize or eliminate the need to mill the flanges 402 to 409 to fit within the box-frame-segments 35.

As yet another example, the post sleeve 401 can be formed by extruding or casting a metal and the flanges 402 to 409 can be formed by extruding, casting or rolling a metal. In this example, the deck component 400 can be formed by affixing the flanges 402 to 409 to the post sleeve 401. The flanges 402 and 403 can be affixed to the post sleeve 401 by welding the flanges 402 and 403 to the exterior surface 415 of the post sleeve 401. The flanges 404 and 405 can be affixed to the post sleeve 401 by welding the flanges 404 and 405 to the exterior surface 414. The flanges 406 and 407 can be affixed to the post sleeve 401 by welding the flanges 406 and 407 to the exterior surface of the side wall 411. The flanges 408 and 409 can be affixed to the post sleeve 401 by welding the flanges 408 and 409 to the exterior surface of the side wall 412.

The flange 403, the flange 404, the flange 406, and the flange 409 comprise attachment holes for affixing the flanges 403, 404, 406, and 409 to a respective box-frame-segment 35 shown in FIG. 16 using fasteners 50 (not shown). The flanges 403, 404, 406, and 409 can comprise a different number of attachment holes than shown in FIG. 16. The flanges 402, 405, 407, and 408 may not comprise any attachment holes because it may preferable to not mill attachment holes within the exterior sides 41 of the box-frame-segments 35 for aesthetic reasons. In an alternative arrangement, attachment holes could be milled into the flanges 402, 405, 407, and 408 for placement of fasteners through attachment holes milled into the exterior sides 41.

Figure 17:
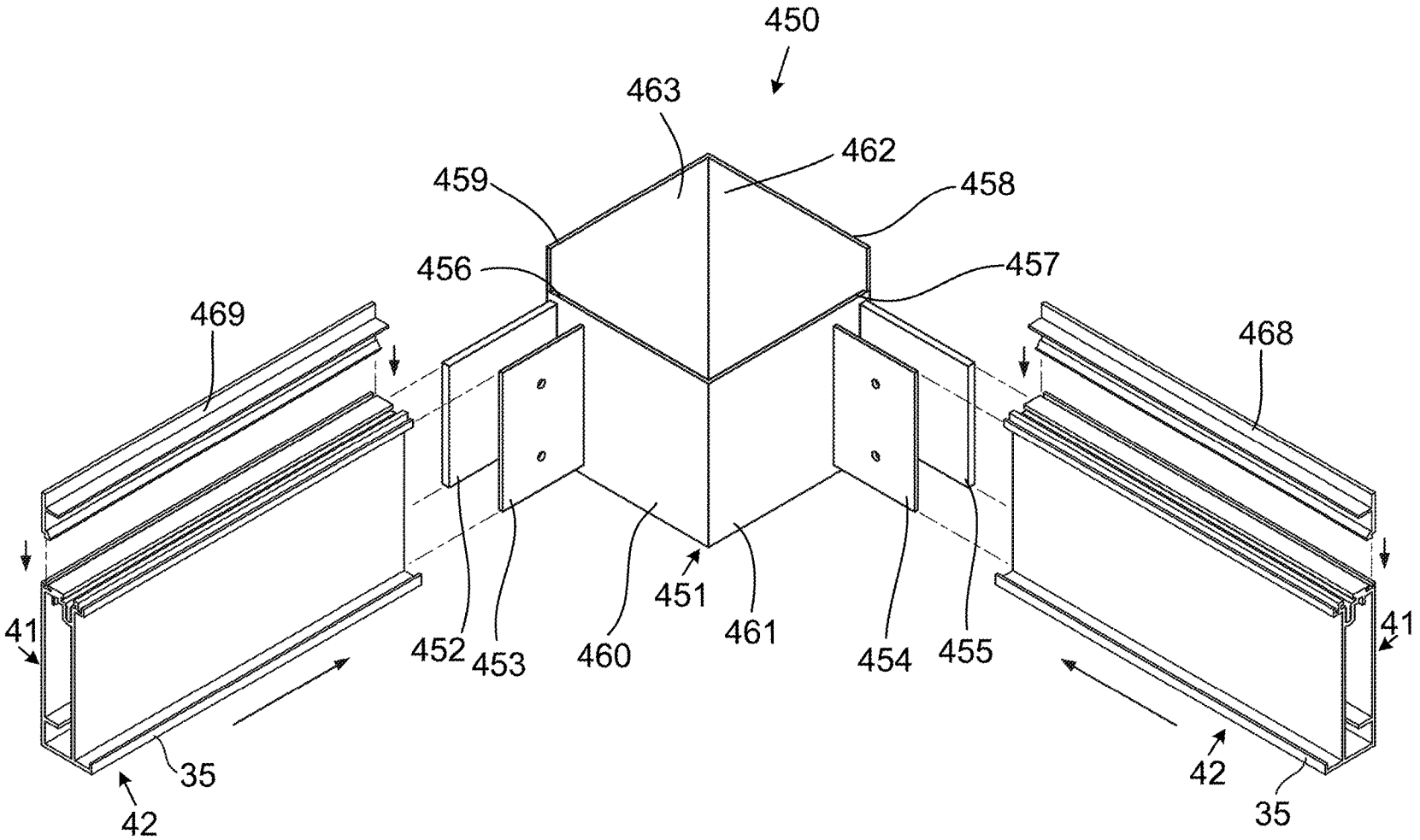

Next, FIG. 17 is an isometric view of a deck component 450, two box-frame-segments 35, and a perimeter-trim-piece 468 and a perimeter-trim-piece 469 that can be attached to two box-frame-segments 35. The deck component 450 comprises a post sleeve 451. The post sleeve 451 comprises side walls 456, 457, 458, and 459 (or more simply, "side walls 456 to 459"). The deck component 450 comprises flanges 452 and 453 that extend from the side wall 456, and flanges 454 and 455 that extend from the side wall 457. The flanges 452 and 453 can abut the side wall 456 at an exterior surface of the side wall 456 or within a slot within the side wall 456. The flanges 454 and 455 can abut the side wall 457 at an exterior surface of the side wall 457 or within a slot within the side wall 457.

The post sleeve 451 is open above the side walls 456 to 459. The post sleeve 451 is open below the side walls 456 to 459. A post can enter the post sleeve 451 from above the side walls 456, 457, 458, and 459 or from below the side walls 456 to 459. Each side wall in the post sleeve 451 comprises an interior surface and an exterior surface. In particular, the side wall 458 includes an interior surface 462 and an exterior surface (not shown), the side wall 459 includes an interior surface 463 and an exterior surface (not shown), the side wall 460 includes an interior surface (not shown) and an exterior surface 460, and the side wall 457 includes an interior surface (not shown) and an exterior surface 461.

As an example, the post sleeve 451 and the flanges 452, 453, 454, and 455 (or more simply, "flanges 452 to 455") can be formed by extruding a metal billet through a die as a single extruded deck component comprising the post sleeve 451 and the flanges 452 to 455. The flanges 452 to 455 formed by extrusion can be milled to lower the top surfaces of the flanges 452, 453, 454, and 455 below the top surface of the side walls 456 and 457 and to raise the bottom surfaces of the flanges 452 to 455 above the bottom surface of the post sleeve 451. Milling the flanges 452 to 455 formed by extrusion allows the flanges 452 and 453 to be positioned within one box-frame-segment 35 shown in FIG. 17 and the flanges 454 and 455 to be positioned within another box-frame-segment 35 shown in FIG. 17.

The side walls 456 and 457 can be milled so that a distance from the bottoms of the side walls 456 and 457 to the tops of the side walls 456 and 457 is shorter than a distance from the bottom of the side walls 458 and 459 to a top of the side walls 458 and 459. The difference in those two distances can be equal to a height of a deck board to be installed upon a box-frame perimeter using the deck component 450. As an example, the deck board height can be 2.54 cm (i.e., 1 inch), 3.175 cm (i.e., 1.25 inches) or some other dimension of deck boards. The deck boards can be made of wood, a composite material or some other material.

As another example, the post sleeve 451 and the flanges 452 to 455 can be formed by casting a metal as a single cast deck component comprising the post sleeve 451 and the flanges 452 to 455. The mold used to form the single cast deck component can be formed to minimize or eliminate the need to mill the flanges 452 to 455 to fit within the box-frame-segment 35.

As yet another example, the post sleeve 451 can be formed by extruding or casting a metal and the flanges 452 to 455 can be formed by extruding, casting or rolling a metal. In this example, the deck component 450 can be formed by affixing the flanges 452 to 455 to the post sleeve 451. The flanges 452 and 453 can be affixed to the post sleeve 451 by welding the flanges 452 and 453 to the exterior surface 460. The flanges 454 and 455 can be affixed to the post sleeve 451 by welding the flanges 454 and 455 to the exterior surface 461.

The welds on the flanges 452 to 455 can stop short of the tops and bottoms of the flanges 452 to 455 so that the welds do not interfere with positioning the flanges 452 to 455 within the box-frame-segment 35. For example, the welds for attaching the flanges 452 and 453 may stop short of the tops of flanges 452 and 453 so that the welds do not interfere with the vertical element 511 of the box-frame-segment 35.

The deck component 450 can be manufactured with various dimensions. For example, the dimensions of the deck component 450 can be the same as the dimensions discussed with respect to the deck component 110 except that the height of the side walls 458 and 459 are greater than the height of the side walls 456 and 457. As another example, the dimensions of the deck component 450 can be the same as the dimensions discussed with respect to the deck component 10 except that the height of the side walls 458 and 459 are greater than the height of the side walls 456 and 457. As discussed the different in the height of the side walls 458 and 459 with respect to the height of the side walls 456 and 457 can be equal to the height of a deck board to be installed onto a deck using the deck component 450.

The flanges 453 and 454 comprise attachment holes. The attachment holes can comprise through-holes. The flanges 453 and 454 can comprise a different number of attachment holes than shown in FIG. 17. The flanges 452 and 455 may not comprise any attachment holes because it may preferable to not mill attachment holes within the exterior sides 41 of the box-frame-segments 35 for aesthetic reasons. In an alternative arrangement, attachment holes could be milled into the flanges 452 and 455 for placement of fasteners through attachment holes milled into the exterior sides 41.

After the flanges 454 and 455 are positioned within the box-frame-segment 35, fasteners 50 (not shown in FIG. 17) can affix the deck component 450 to the box-frame-segments 35 in which the flanges 454 and 455 have been installed. The attachment holes in the flange 454 can be used as guides to drill corresponding attachment holes within the box-frame-segment 35. The fasteners 50 that affix the deck component 450 to the box-frame-segment 35 can comprise self-tapping screws or another type of fastener. The attachment holes in the box-frame-segment 35 for receiving fasteners placed through attachment holes in the flange 454 could be drilled before the flanges 454 and 455 are positioned within the box-frame-segment 35.

Similarly, after the flanges 452 and 453 are positioned within the box-frame-segment 35, fasteners 50 (not shown in FIG. 17) can affix the deck component 450 to the box-frame-segment 35 in which the flanges 452 and 453 have been installed. The attachment holes within the flanges 453 can be used as guides to drill corresponding attachment holes within the box-frame-segment 35. The fasteners 50 that affix the deck component 450 to the box-frame-segment 35 can comprise self-tapping screws or another type of fastener. The attachment holes in the box-frame-segment 35 for receiving fasteners placed through attachment holes within the flange 453 could be drilled before the flanges 452 and 453 are positioned within the box-frame-segment 35.

One or more of the deck components 110 in the box-frame-perimeter 225 could be replaced by the deck component 450.

Figure 18:
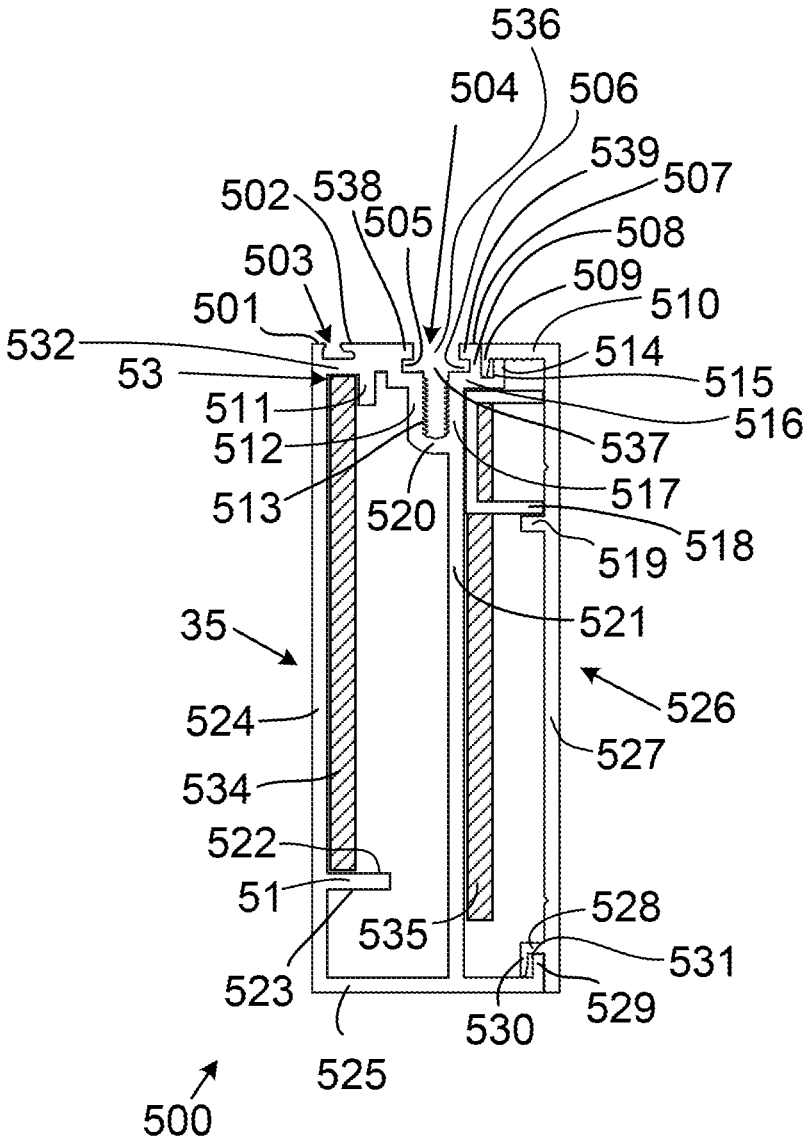
FIG. 18 shows a sectional view of a box-frame-segment with a box-frame segment attached and flanges positioned within the box-frame-segment.

Next, FIG. 18 shows a section view of a box-frame-segment assembly 500 that can form part of a deck system, such as a box-frame within a deck system. The box-frame-segment assembly 500 comprises a box-frame-segment 35, a box-frame-segment attachment 526, and an uplift clip 518. The section view of FIG. 18 shows a flange 534 and a flange 535 that can be positioned within the box-frame-segment assembly 500.

The box-frame-segment 35, the box-frame-segment attachment 526, and the uplift clip 518 can comprise an extruded or cast metal. Each of those extrusions or castings can be made with uniform features over an entire extrusion or casting prior to performance of any milling, drilling or other operation to the extrusion or casting. The following description of the box-frame-segment 35 and the box-frame-segment attachment 526 refers to various elements, splines, fins, shelves, and tabs. Each of those elements, splines, fins, shelves, and tabs comprises a portion of the extruded or cast metal.

The box-frame-segment 35 comprises a vertical element 524, a base horizontal element 525, a top horizontal element 501, a top horizontal element 502, a top horizontal element 507, a locking-tab 514, a deck-clip slot 504, and deck screw splines 513. The top horizontal element 502 comprises a tab 538 positioned above a recessed portion 505 of the deck-clip slot 504. The top horizontal element 507 comprises a tab 539 positioned above a recessed portion 506 of the deck-clip slot 504.

The deck screw splines 513 are accessible through the deck-clip slot 504 between the top horizontal element 502 and the top horizontal element 507. The deck-clip slot 504 comprises a narrow slot 536 extending from the top horizontal element 502 to the top horizontal element 507. The deck-clip slot 504 comprises a wide slot 537 below the narrow slot 536 and above the deck screw splines 513. The wide slot 537 comprises the recessed area 505 below the tab 538 and the recessed area 506 below the tab 539. The wide slot 507 allows for positioning a base of a deck clip (or the base and a lower portion of a vertical element of the deck-clip) and the narrow slot 536 allows for positioning a narrow portion of the deck clip.

The recessed areas 505 and 506 allow a deck-clip installed into the deck-clip slot 504 to be slid axially within the deck-clip slot 504. The tabs 538 and 539 correspond to notches of a notched area of a deck-clip. Portions of the tabs 538 and 539 (at a location where the deck-clip is positioned) can extend within notches of the notched area of a deck-clip. The tabs 538 and 539 prevent an installed deck-clip from being lifted upward out of the deck-clip slot 504 as portions of the base of the deck-clip are positioned below the tabs 538 and 539.

The box-frame-segment 35 comprises a vertical element 512, a vertical element 517, and a horizontal element 520. The horizontal element 520 extends between lower portions of the vertical element 512 and the vertical element 513. The deck screw splines 513 are formed into the vertical element 512 and the vertical element 513.

The box-frame-segment comprises a locking-tap slot 515 adjacent to the top horizontal element 507. The locking-tab slot 515 is adapted to accept a locking-tab 509 on the box-frame-segment attachment 526. The box-frame-segment 35 comprises a locking-tab 529 at an end of the horizontal element 525 adapted to be positioned within a locking-tab slot 531 on the box-frame-segment attachment 526.

The box-frame-segment comprises a perimeter-trim-piece slot 503 positioned between the top horizontal element 501 and the top horizontal element 502. The perimeter-trim-piece slot 503 comprises a vertical slot extending from between the top horizontal elements 501 and 502 and a horizontal slot extending from the vertical slot to beneath the top horizontal element 502. As an example, the vertical slot can be 0.125 inches and the horizontal slot can be 0.25 inches. A perimeter-trim-piece, such as the perimeter-trim-piece 468 shown in FIG. 17, can be inserted into the perimeter-trim-piece slot 503 to cover edges of deck boards positioned upon a deck system including the box-frame-segment assembly 500.

The box-frame-segment 35 comprises a reinforcement shelf 51 to support the flange 534 within the box-frame-segment assembly 500. As an example, the flange 534 can comprise: (i) the flange 16 or 18 of the deck component 10, (ii) the flange 116 or 118 of the deck component 110, (iii) the flange 77 or 79 of the deck component 75, (iv) the flange 126, 129, or 131 of the deck component 125, (v) the flange 261, 264, 266 or 267 of the deck component 260, (vi) the flange 317 or 319 of the deck component 315, (vii) the flange 352, 355, or 357 of the deck component 350, (viii) the flange 402, 405, 407, or 408 of the deck component 400, (ix) the flange 452 or 455 of the deck component 450, (x) the flange 606 or 608 of the deck component 600, (xi) the flange 656 or 658 of the deck component 650, (xii) the flange 702 or 704 of the deck component 700, (xiii) the flange 732, 735, or 737 of the deck component 730, (xiv) the flange 803 or 805 of the deck component 800, or (xv) the flange 832, 835, or 837 of the deck component 830.

An upper portion of the flange 534 can be positioned within a flange guide 53 formed, in part, by and between the vertical element 524 and a vertical element 511, and below a horizontal element 532 that is below the perimeter-trim-piece slot 503 and that extends from the vertical element 524 to the recessed portion 505. The flange 534 extends from an upper surface 522 of the reinforcement shelf 51 to a position within the flange guide 53. The reinforcement shelf 51 comprises a lower surface 523.

The box-frame-segment 35 comprises a horizontal element 516 that extends from the vertical element 517 to the locking-tab 514. The box-frame-segment 35 comprises a vertical element 508 that extends from the top horizontal element 507 to the horizontal element 516.

The box-frame-segment 35 comprises a reinforcement fin 521. The reinforcement fin 521 extends from the vertical element 517 down to the horizontal element 525. As an example, the reinforcement fin 521 can have a thickness of 0.125 inches and a length of 4.125 inches.

The box-frame-segment attachment 526 comprises a vertical element 527, a top horizontal element 510 extending from the vertical element 527 to the locking-tab 509. The box-frame-segment attachment 526 comprises a horizontal element 528 extending away from the vertical element 527 and the locking-tab 530 extending away from the horizontal element 528 so as to form the locking-tab slot 531. The box-frame-segment attachment 526 comprises an uplift clip shelf 519 for supporting the uplift clip 518. Positioning the uplift clip 518 within the box-frame-segment assembly 500 can prevent removal of the box-frame-segment attachment 526 from the box-frame-segment 35. Removing the uplift clip 518 from the box-frame-segment assembly 500 allows for the box-frame-segment attachment 526 to be removed from the box-frame-segment 35.

The flange 535 can be positioned within the box-frame-segment assembly 500. The flange 535 can be affixed to the reinforcement fin 521 using fasteners 50. As an example, the flange 535 can comprise: (i) the flange 17 or 19 of the deck component 10, (ii) the flange 117 or 119 of the deck component 110, (iii) the flange 76 or 78 of the deck component 75, (iv) the flange 127, 128, or 130 of the deck component 125, (v) the flange 262, 263, 265 or 268 of the deck component 260, (vi) the flange 318 or 320 of the deck component 315, (vii) the flange 353, 354, or 356 of the deck component 350, (viii) the flange 403, 404, 406, or 408 of the deck component 400, (ix) the flange 453 or 454 of the deck component 450, (x) the flange 607 or 609 of the deck component 600, (xi) the flange 657 or 659 of the deck component 650, (xii) the flange 701 or 703 of the deck component 700, (xiii) the flange 733, 734, or 736 of the deck component 730, (xiv) the flange 802 or 804 of the deck component 800, or (xv) the flange 833, 834, or 836 of the deck component 830.

B. Post Sleeves with Post Sleeve Extensions

Figures 19, 20:
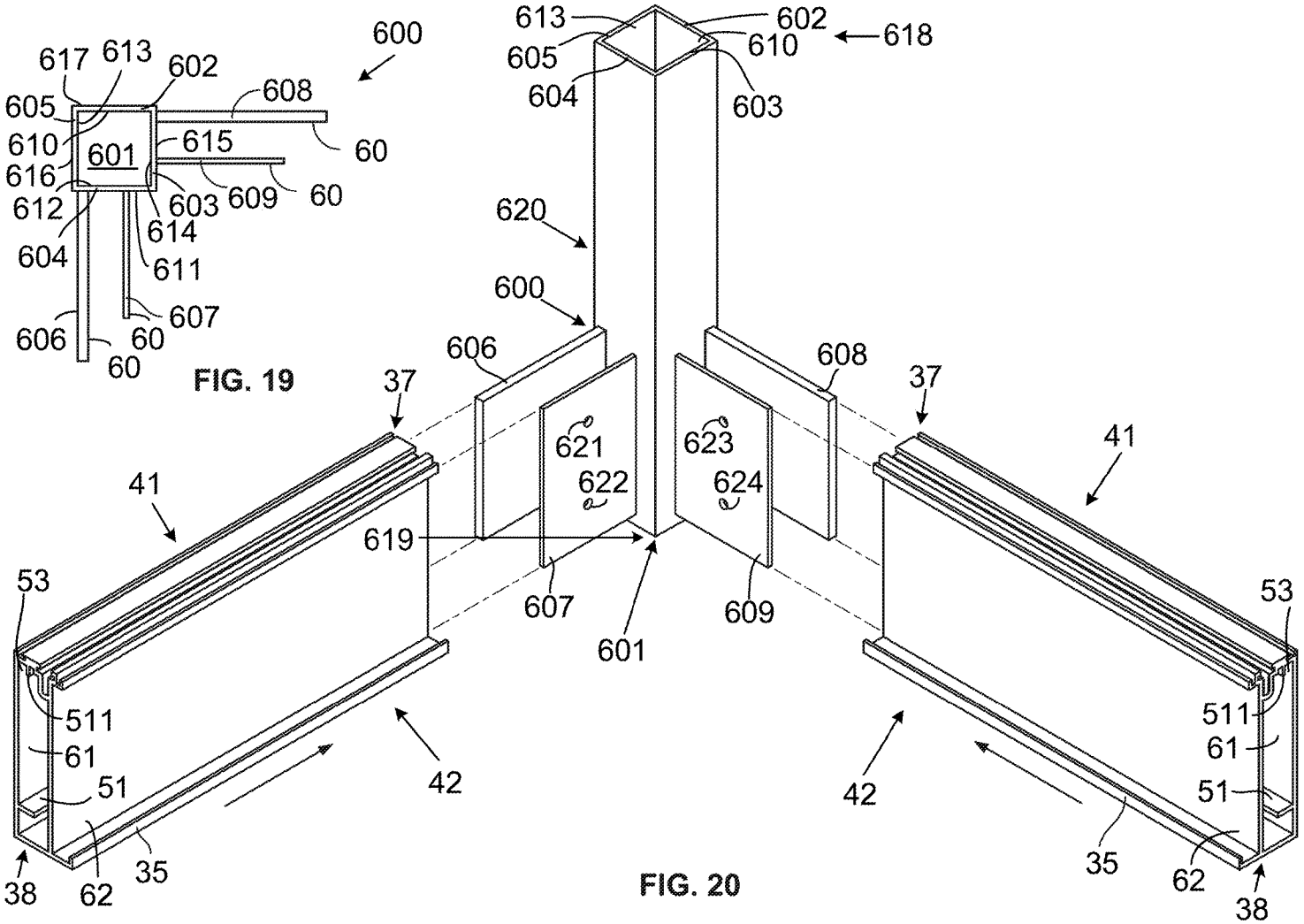
FIG. 19 is a plan view of an example post sleeve.
FIG. 20 is an isometric view of the post sleeve shown in FIG. 19 and attachable box-frame-segments.
Figure 37:
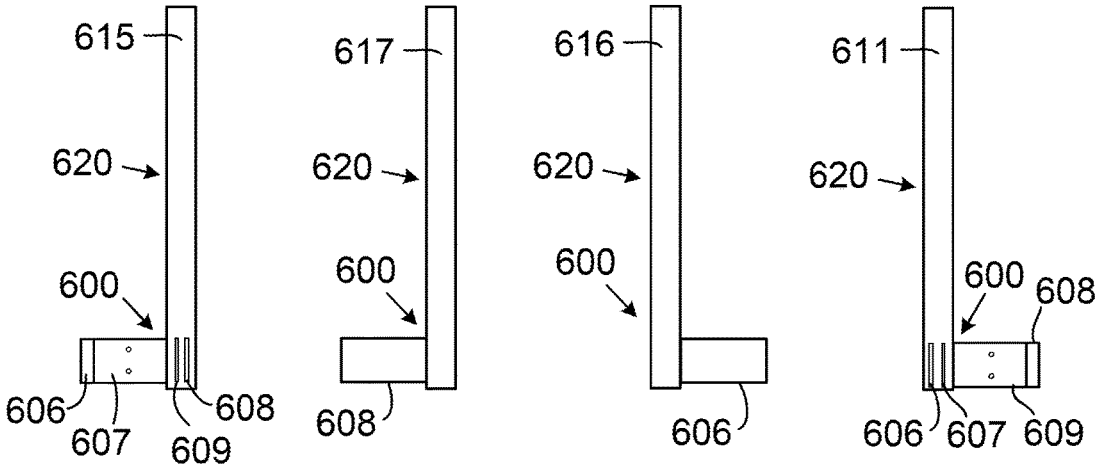
FIG. 37, FIG. 38, FIG. 39, FIG. 40, FIG. 41, and FIG. 42 are elevation views of the example deck components including post sleeves.

FIG. 19 is a plan view of a deck component 600. The deck component 600 may be used within a single story structure, such as a single story deck that attaches to a house via a ledger board or on a cantilevered deck. Alternatively, the deck component 600 may also be used in a multi-story structure, such as a multi-story deck. FIG. 20 is an isometric drawing showing two box-frame-segments 35 and additional details of the deck component 600. FIG. 37 shows elevation views of the deck component 600.

The deck component 600 comprises a post sleeve 601 with a post sleeve extension 620 that extends vertically above the box-frame-segments 35 when attached to the deck component 600. The post sleeve 601 comprises side walls 602, 603, 604, and 605 (or more simply, "side walls 602 to 605"). With the deck component 600 oriented as shown in FIG. 20, the post sleeve 600 comprises a top side 618 and a bottom side 619. The deck component 600 comprises flanges 606 and 607 that extend from the side wall 604, and flanges 608 and 609 that extend from the side wall 603. The flanges 606 and 607 can abut the side wall 604 at an exterior surface of the side wall 604 or within a slot within the side wall 604. The flanges 608 and 609 can abut the side wall 603 at an exterior surface of the side wall 603 or within a slot within the side wall 603.

The side wall 602 comprises an interior surface 610 and an exterior surface 617. The side wall 603 comprises an interior surface 614 and an exterior surface 615. The side wall 604 comprises an interior surface 612 and an exterior surface 611. The side wall 605 comprises an interior surface 613 and an exterior surface 616. A post (not shown) can be positioned within a hollow portion of the post sleeve 601. The post sleeve 601 can be hollow from the top side 618 to the bottom side 619. Alternatively, a portion of the post sleeve 601 between the top side 618 and the bottom side 619 can be solid. A post can be installed into the post sleeve 601 from the top side 618 or from the bottom side 619. A post sleeve cover (not shown) could be installed within the post sleeve 601 at the top side 618.

As an example, the post sleeve 601 and the flanges 606, 607, 608, and 609 (or more simply, "flanges 606 to 609") can be formed by extruding a metal billet through a die as a single extruded deck component comprising the post sleeve 601 and the flanges 606 to 609. The flanges 606 to 609 formed by extrusion can be milled to lower the top surfaces of the flanges 606 to 609 below the top surface of the post sleeve 601 and to raise the bottom surfaces of the flanges 606 to 609 above the bottom surface of the post sleeve 601. Milling the flanges 606 to 609 formed by extrusion allows the flanges 606 and 607 to be positioned within one box-frame-segment 35 shown in FIG. 20 and the flanges 608 and 609 to be positioned within another box-frame-segment 35 shown in FIG. 20.

As another example, the post sleeve 601 and the flanges 606 to 609 can be formed by casting a metal as a single cast deck component comprising the post sleeve 601 and the flanges 606 to 609. The mold used to form the single cast deck component can be formed to minimize or eliminate the need to mill the flanges 606 to 609 to fit within the box-frame-segment 35.

As yet another example, the post sleeve 601 can be formed by extruding or casting a metal and the flanges 606 to 609 can be formed by extruding, casting or rolling a metal. In this example, the deck component 600 can be formed by affixing the flanges 606 to 609 to the post sleeve 601. The flanges 606 and 607 can be affixed to the post sleeve 601 by welding the flanges 606 and 607 to the exterior surface 611 of the post sleeve 601. The flanges 608 and 609 can be affixed to the post sleeve 601 by welding the flanges 608 and 609 to the exterior surface 615 of the post sleeve 601. FIG. 19 shows weld sides 60 of the flanges 606 to 609 for box-frame segments configured like the box-frame segment 35.

Welding the weld sides 60 of the flanges 606 and 608 without welding the opposing sides of the flanges 606 and 608 allows the flanges 606 and 608 to be installed within the box-frame-segment 35 flush against the surfaces 62 of the box-frame-segment 35. Similarly, welding the weld sides 60 of the flanges 607 and 609 without welding the opposing sides of the flanges 607 and 609 allows the flanges 607 and 609 to be installed within the box-frame-segment 35 flush against the surfaces 61 of the box-frame-segment 35.

The welds on the flanges 606 to 609 can stop short of the tops and bottoms of the flanges 606 to 609 so that the welds do not interfere with positioning the flanges 606 to 609 within the box-frame-segment 35. For example, the welds for attaching the flanges 606 and 608 may stop short of the tops of flanges 606 and 608 so that the welds do not interfere with the vertical element 511 of the box-frame-segment 35.

The flanges 606 and 607 can be positioned within one of the box-frame-segments 35. The flanges 608 and 609 can be positioned within the other box-frame-segment 35. The edge 37 being square cut allows for the edge 37 to contact the exterior surface of a side wall, such as the exterior surface 611 or 615. The edge 38 being square cut allows for the edge 38 to contact the exterior surface of the side wall of another deck component comprising a post sleeve. The flanges of the other post sleeve can be positioned within the box-frame-segment 35 at the edge 38.

The flange 607 comprises attachment holes 621 and 622. The flange 609 comprises attachment holes 623 and 624. The attachment holes 621, 622, 623, and 624 can comprise through-holes. The flanges 607 and 609 can comprise a different number of attachment holes. The flanges 606 and 608 may not comprise any attachment holes because it may preferable to not mill attachment holes within the exterior sides 41 of the box-frame-segments 35 for aesthetic reasons. In an alternative arrangement, attachment holes could be milled into the flanges 606 and 608 for placement of fasteners through attachment holes milled into the exterior sides 41.

After the flanges 606 and 607 are positioned within the box-frame-segment 35, fasteners 50 (shown in FIG. 22) can affix the deck component 600 to the box-frame-segments 35 in which the flanges 606 and 607 have been installed. The attachment holes 621 and 622 can be used as guides to drill corresponding attachment holes within the box-frame-segment 35. The fasteners 50 that affix the deck component 600 to the box-frame-segment 35 can comprise self-tapping screws or another type of fastener. The attachment holes in the box-frame-segment 35 for receiving fasteners placed through attachment holes 621 and 622 could be drilled before the flanges 606 and 607 are positioned within the box-frame-segment 35.

Similarly, after the flanges 608 and 609 are positioned within the box-frame-segment 35, fasteners 50 (shown in FIG. 22) can affix the deck component 600 to the box-frame-segment 35 in which the flanges 608 and 609 have been installed. The attachment holes 623 and 624 can be used as guides to drill corresponding attachment holes within the box-frame-segment 35. The fasteners 50 that affix the deck component 600 to the box-frame-segment 35 can comprise self-tapping screws or another type of fastener. The attachment holes in the box-frame-segment 35 for receiving fasteners placed through attachment holes 623 and 624 could be drilled before the flanges 608 and 609 are positioned within the box-frame-segment 35.

The reinforcement shelf 51 can support the flange 606 or 608. The flange guide 53 can guide the flange 606 or 608 during installation of the flange 606 or 608 into the box-frame-segments 35.

Figures 21, 22:
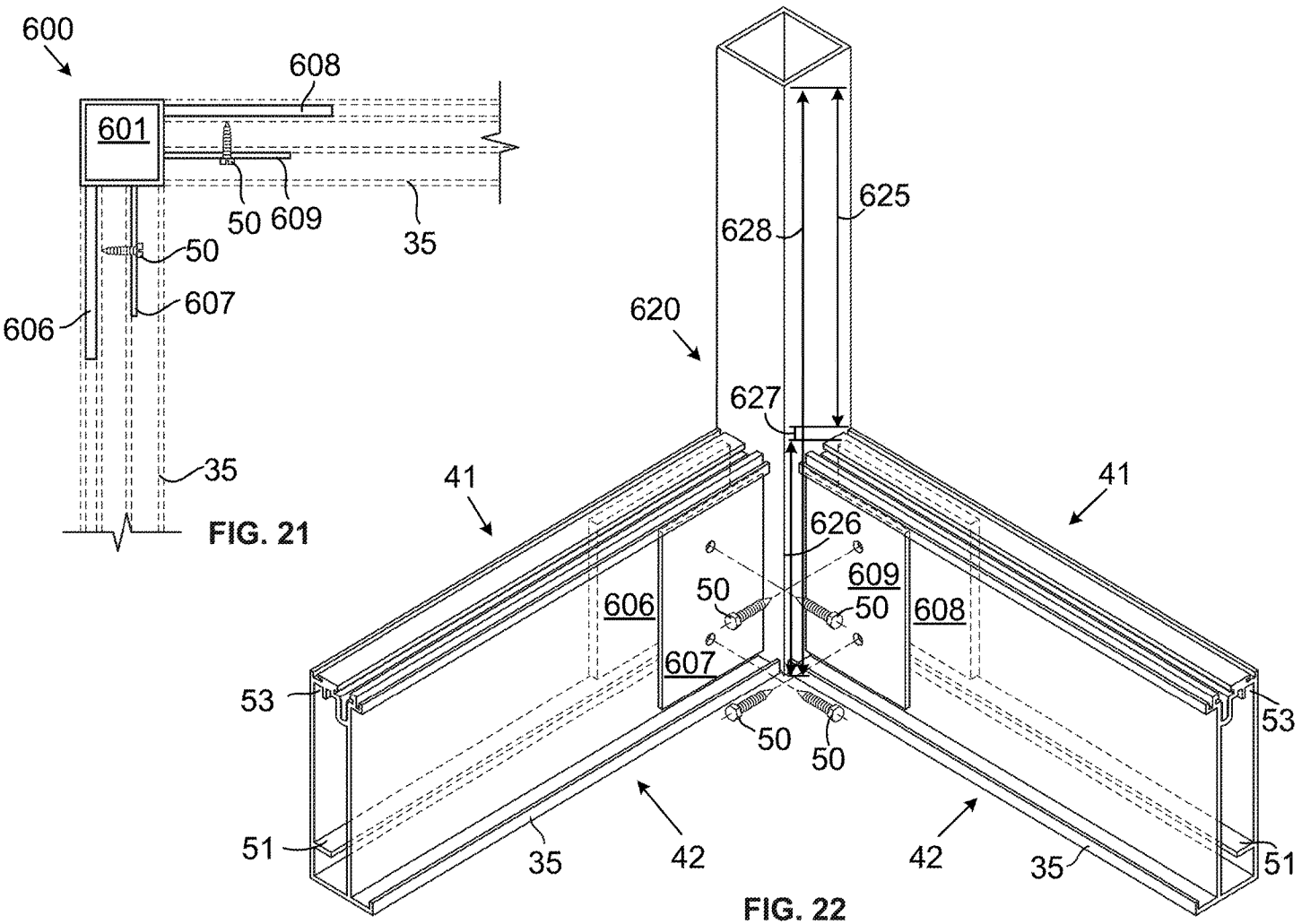
FIG. 21 is a plan view of the post sleeve shown in FIG. 19 with the box-frame-segments shown in FIG. 20 attached to the post sleeve.
FIG. 22 is an isometric view of the post sleeve and the box-frame-segments shown in FIG. 21.

Next, FIG. 21 is a plan view of the deck component 600 with the flanges 606 and 607 positioned within one box-frame-segment 35 and the flanges 608 and 609 positioned within another box-frame-segment 35, and fasteners 50 that affix the deck component 600 to the box-frame-segments 35.

Next, FIG. 22 is an isometric view of the deck component 600 with the flanges 606 and 607 positioned within one box-frame-segment 35 and the flanges 608 and 609 positioned within another box-frame-segment 35, and fasteners 50 that affix the deck component 600 to the box-frame-segments 35.

The deck component 600 can be manufactured with various dimensions. The following three paragraphs list example dimensions with respect to the deck component 600. A dimension 625 of the post sleeve extension 620 can be based on the type of structure that will include the deck component 600 and other factors, such as a particular building code applicable to a geographical location where the deck component 600 will be used.

A first example structure including the deck component 600 is a multi-story structure in which the post sleeve extension supports at least one other level of the multi-story structure. For embodiments in which the deck component 600 is used in the first example structure or another structure, the dimension 625 can be 2.438 meters (i.e., 8 feet), 2.743 meters (i.e., 9 feet), or some other dimension that provides for a desired span between box-frame segments 35 of adjacent levels of the multi-story structure.

A second example structure including the deck component 600 is a structure, such as a deck, including a guard rail (e.g., a railing). For embodiments in which the deck component 600 is used in the second example structure or another structure, the dimension 625 can be based on a building code, such as the 2012 International Residential Code (IRC) developed by or for the International Code Council (ICC), Washington, D.C., United States. Rule 311.7.8 of the 2012 IRC requires that guard rails at open-sided walking surfaces shall not be less than 91.44 cm (i.e., 36 inches) high measured vertically above the adjacent walking surface or adjacent fixed seating. Dimension 625 spans from the top side 618 of the post sleeve 601 to a position on the post sleeve 601 at which the top of the box-frame segment 35 contacts the post sleeve 601 (i.e., an upper box-frame-segment contact point). Dimension 626 spans from the bottom of the post sleeve 601 to the top of flange 608. Dimension 627 spans from the top of the flange 608 to the upper box-frame-segment contact point of the post sleeve 601. Dimension 628 spans from the top side 618 to the bottom side 619 of the post sleeve 601. Table 1 shows examples of dimensions 625, 626, 627, and 628 and examples thickness dimensions of flooring (e.g., deck boards) that may be positioned on and supported by the box-frame segments 35. In examples, A to D, the dimension 625 equals 91.44 cm (36.00 inches) plus the floor thickness. This permits the post sleeve 601 to extend 36 inches above the floor. Dimensions 675, 676, 677, and 678 referenced in Table 1 are discussed with respect to FIG. 26.

TABLE 1

| Example | Floor thickness | Dim. 625/ Dim. 675 | Dim. 626/ Dim. 676 | Dim. 627/ Dim. 677 | Dim. 628/ Dim. 678 |
|---|---|---|---|---|---|
| A | 3.18 cm (1.25 in.) | 94.62 cm (37.25 in.) | 12.70 cm (5.00 in.) | 0.64 cm (0.25 in.) | 107.96 cm (42.50 in.) |
| B | 3.81 cm (1.50 in.) | 95.25 cm (37.50 in.) | 12.70 cm (5.00 in.) | 0.64 cm (0.25 in.) | 108.59 cm (42.75 in.) |
| C | 3.18 cm (1.25 in.) | 94.62 cm (37.25 in.) | 20.32 cm (8.00 in.) | 0.97 cm (0.38 in.) | 115.91 cm (45.63 in.) |
| D | 3.18 cm (1.25 in.) | 94.62 cm (37.25 in.) | 20.32 cm (8.00 in.) | 0.64 cm (0.25 in.) | 115.58 cm (45.50 in.) |
| E | 3.18 cm (1.25 in.) | 247.02 cm (97.25 in) | 20.32 cm (8.00 in.) | 0.97 cm (0.38 in.) | 268.31 cm (105.63 in.) |

A width of the exterior surface of the side walls 602 to 605 can be 5.08 cm (i.e., 2 inches) and the post sleeve 601 can comprise a rectangular cross section. A thickness of the side walls 602 to 605 can be 0.3175 cm (i.e., 0.125 inches) such that a length of the interior surface of the side walls can be 4.445 cm (i.e., 1.75 inches), or 0.3048 cm (i.e., 0.12 inches) such that a length of the interior surface of the side walls can be 4.470 cm (i.e., 1.76 inches). The flanges 606 and 608 can extend away from the exterior surface 5.08 cm (i.e., 2 inches), have heights of 10.16 cm (i.e., 4 inches) and have thicknesses of 0.635 cm (i.e., 0.25 inches). The flanges 607 and 609 can extend away from the exterior surface 5.715 cm (i.e., 2.25 inches), have heights of 10.795 cm (i.e., 4.25 inches) and have thicknesses of 0.47625 cm (i.e., 0.60875 inches). A shortest distance between two flanges abutting from the same exterior surface can be 1.74625 cm (i.e., 0.6875 inches). A distance from a top of the flanges 606 and 608 to the top of the post sleeve 601 can be 0.635 cm (i.e., 0.25 inches) plus dimension 625. A distance from a bottom of the flanges 606 and 608 to the bottom of the post sleeve 601 can be 2.54 cm (i.e., 1 inch). A distance from a top of the flanges 607 and 609 to the top of the post sleeve 601 can be 0.9525 cm (i.e., 0.375 inches). A distance from a bottom of the flanges 607 and 609 to bottom of the post sleeve 601 can be 1.5875 cm (i.e., 0.625 inches). Other examples of one or more the measurements in this and the preceding two paragraphs are possible.

Figures 23, 24:
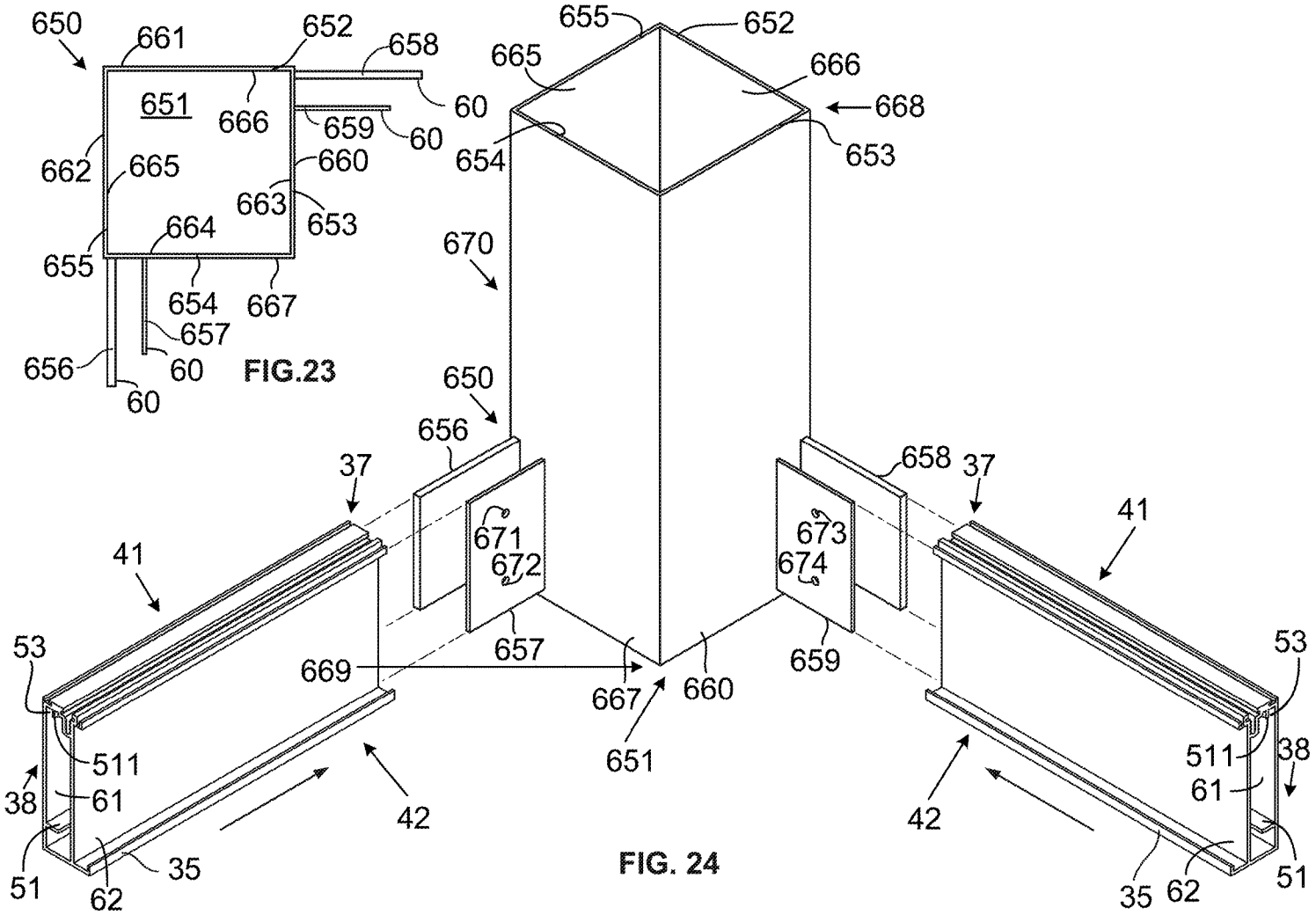
FIG. 23 is a plan view of an example post sleeve.
FIG. 24 is an isometric view of the post sleeve shown in FIG. 23 and attachable box-frame-segments.
Figure 38:
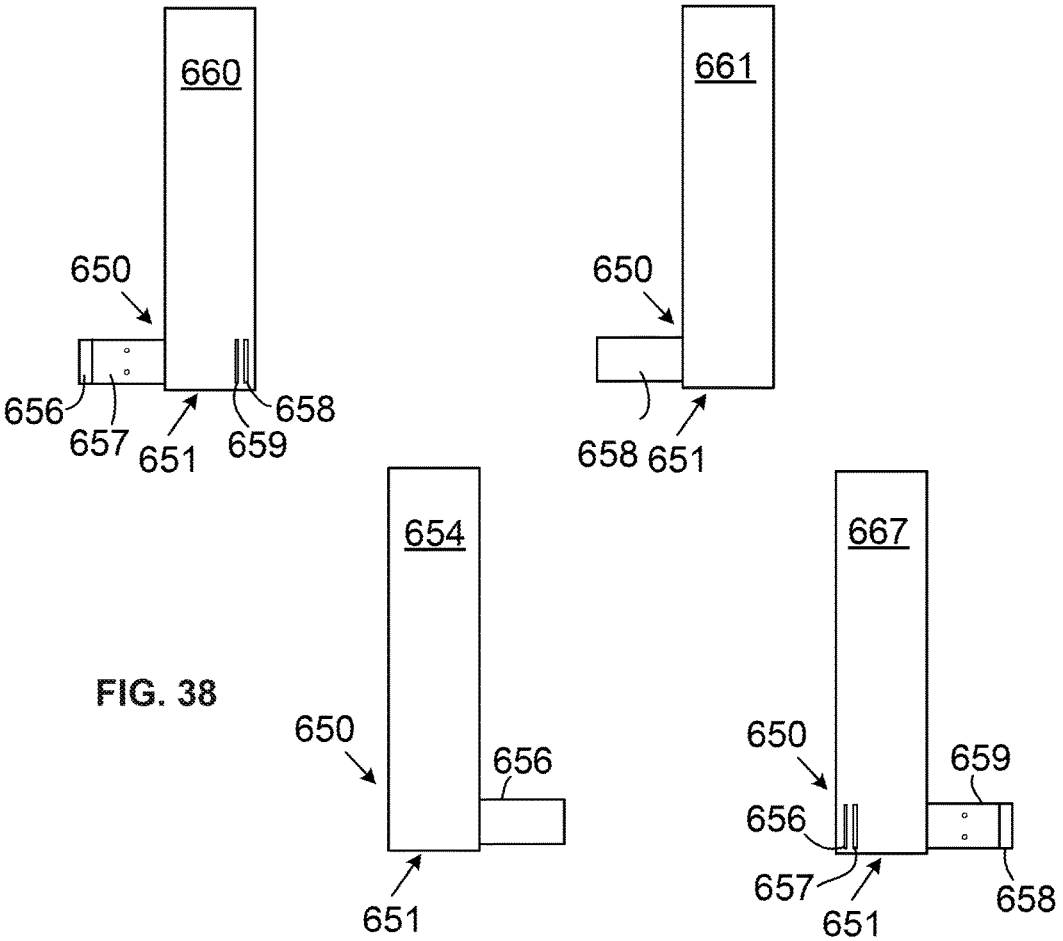

FIG. 23 is a plan view of a deck component 650. The deck component 650 may be used within a single story structure, such as a single story deck that attaches to a house via a ledger board or on a cantilevered deck. Alternatively, the deck component 650 may also be used in a multi-story structure, such as a multi-story deck. FIG. 24 is an isometric drawing showing two box-frame-segments 35 and additional details of the deck component 650. FIG. 38 shows elevation views of the deck component 650.

The deck component 650 comprises a post sleeve 651 with a post sleeve extension 670 that extends vertically above the box-frame-segments 35 when attached to the deck component 650. The post sleeve 651 comprises side walls 652, 653, 654, and 655 (or more simply, "side walls 652 to 655"). With the deck component 650 oriented as shown in FIG. 24, the post sleeve 650 comprises a top side 668 and a bottom side 669. The deck component 650 comprises flanges 656 and 657 that extend from the side wall 654, and flanges 658 and 659 that extend from the side wall 653. The flanges 656 and 657 can abut the side wall 604 at an exterior surface of the side wall 654 or within a slot within the side wall 604. The flanges 658 and 659 can abut the side wall 663 at an exterior surface of the side wall 603 or within a slot within the side wall 603.

The side wall 652 comprises an interior surface 666 and an exterior surface 661. The side wall 653 comprises an interior surface 663 and an exterior surface 660. The side wall 654 comprises an interior surface 664 and an exterior surface 667. The side wall 655 comprises an interior surface 665 and an exterior surface 662. A post (not shown) can be positioned within a hollow portion of the post sleeve 651. The post sleeve 651 can be hollow from the top side 668 to the bottom side 669. Alternatively, a portion of the post sleeve 651 between the top side 668 and the bottom side 669 can be solid. A post can be installed into the post sleeve 651 from the top side 668 or from the bottom side 669. A post sleeve cover (not shown) could be installed within the post sleeve 651 at the top side 668.

As an example, the post sleeve 651 and the flanges 656, 657, 658, and 659 (or more simply, "flanges 656 to 609") can be formed by extruding a metal billet through a die as a single extruded deck component comprising the post sleeve 651 and the flanges 656 to 659. The flanges 656 to 659 formed by extrusion can be milled to lower the top surfaces of the flanges 656 to 659 below the top surface of the post sleeve 651 and to raise the bottom surfaces of the flanges 656 to 659 above the bottom surface of the post sleeve 651. Milling the flanges 656 to 659 formed by extrusion allows the flanges 656 and 657 to be positioned within one box-frame-segment 35 shown in FIG. 24 and the flanges 658 and 659 to be positioned within another box-frame-segment 35 shown in FIG. 24.

As another example, the post sleeve 651 and the flanges 656 to 659 can be formed by casting a metal as a single cast deck component comprising the post sleeve 651 and the flanges 656 to 659. The mold used to form the single cast deck component can be formed to minimize or eliminate the need to mill the flanges 656 to 659 to fit within the box-frame-segment 35.

As yet another example, the post sleeve 651 can be formed by extruding or casting a metal and the flanges 656 to 659 can be formed by extruding, casting or rolling a metal. In this example, the deck component 650 can be formed by affixing the flanges 656 to 659 to the post sleeve 651. The flanges 656 and 657 can be affixed to the post sleeve 651 by welding the flanges 656 and 657 to the exterior surface 667 of the post sleeve 651. The flanges 658 and 659 can be affixed to the post sleeve 651 by welding the flanges 658 and 659 to the exterior surface 660 of the post sleeve 651. FIG. 23 shows weld sides 60 of the flanges 656 to 659 for box-frame segments configured like the box-frame segment 35.

Welding the weld sides 60 of the flanges 656 and 658 without welding the opposing sides of the flanges 656 and 658 allows the flanges 656 and 658 to be installed within the box-frame-segment 35 flush against the surfaces 62 of the box-frame-segment 35. Similarly, welding the weld sides 60 of the flanges 657 and 659 without welding the opposing sides of the flanges 657 and 659 allows the flanges 657 and 659 to be installed within the box-frame-segment 35 flush against the surfaces 61 of the box-frame-segment 35.

The welds on the flanges 656 to 659 can stop short of the tops and bottoms of the flanges 656 to 659 so that the welds do not interfere with positioning the flanges 656 to 659 within the box-frame-segment 35. For example, the welds for attaching the flanges 656 and 658 may stop short of the tops of flanges 656 and 658 so that the welds do not interfere with the vertical element 511 of the box-frame-segment 35.

The flanges 656 and 657 can be positioned within one of the box-frame-segments 35. The flanges 658 and 659 can be positioned within the other box-frame-segment 35. The edge 37 being square cut allows for the edge 37 to contact the exterior surface of a side wall, such as the exterior surface 660 or 667. The edge 38 being square cut allows for the edge 38 to contact the exterior surface of the side wall of another deck component comprising a post sleeve. The flanges of the other post sleeve can be positioned within the box-frame-segment 35 at the edge 38.

The flange 657 comprises attachment holes 671 and 672. The flange 679 comprises attachment holes 673 and 674. The attachment holes 671, 672, 673, and 674 can comprise through-holes. The flanges 657 and 659 can comprise a different number of attachment holes. The flanges 656 and 658 may not comprise any attachment holes because it may preferable to not mill attachment holes within the exterior sides 41 of the box-frame-segments 35 for aesthetic reasons. In an alternative arrangement, attachment holes could be milled into the flanges 656 and 658 for placement of fasteners through attachment holes milled into the exterior sides 41.

After the flanges 656 and 657 are positioned within the box-frame-segment 35, fasteners 50 (shown in FIG. 26) can affix the deck component 650 to the box-frame-segments 35 in which the flanges 656 and 657 have been installed. The attachment holes 671 and 672 can be used as guides to drill corresponding attachment holes within the box-frame-segment 35. The fasteners 50 that affix the deck component 650 to the box-frame-segment 35 can comprise self-tapping screws or another type of fastener. The attachment holes in the box-frame-segment 35 for receiving fasteners placed through attachment holes 671 and 672 could be drilled before the flanges 676 and 677 are positioned within the box-frame-segment 35.

Similarly, after the flanges 658 and 659 are positioned within the box-frame-segment 35, fasteners 50 (shown in FIG. 26) can affix the deck component 650 to the box-frame-segment 35 in which the flanges 658 and 659 have been installed. The attachment holes 673 and 674 can be used as guides to drill corresponding attachment holes within the box-frame-segment 35. The fasteners 50 that affix the deck component 650 to the box-frame-segment 35 can comprise self-tapping screws or another type of fastener. The attachment holes in the box-frame-segment 35 for receiving fasteners placed through attachment holes 673 and 674 could be drilled before the flanges 658 and 659 are positioned within the box-frame-segment 35.

The reinforcement shelf 51 can support the flange 656 or 658. The flange guide 53 can guide the flange 656 or 658 during installation of the flange 656 or 658 into the box-frame-segments 35.

Figures 25, 26:
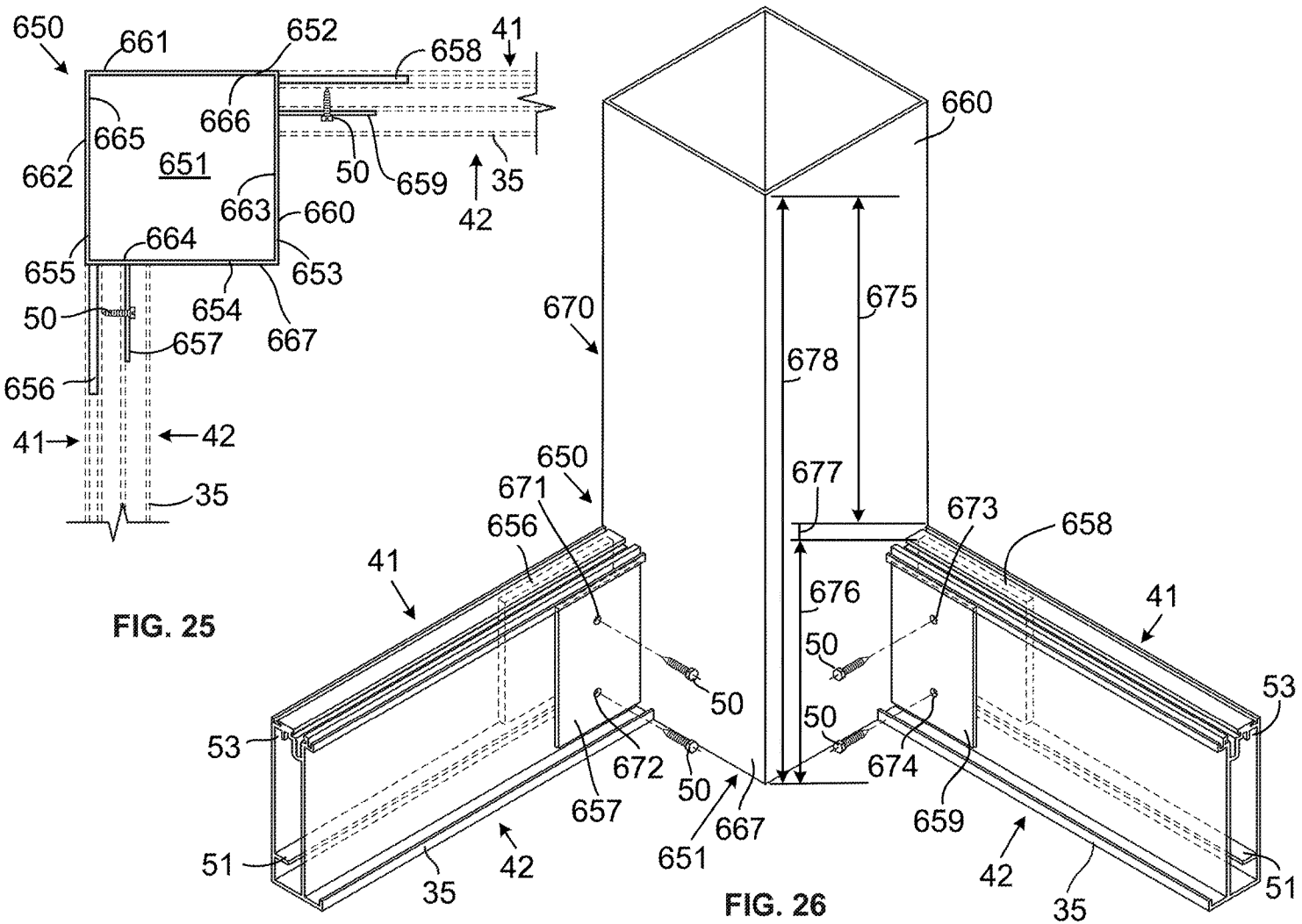
FIG. 25 is a plan view of the post sleeve shown in FIG. 23 with the box-frame-segments shown in FIG. 24 attached to the post sleeve.
FIG. 26 is an isometric view of the post sleeve and the box-frame-segments shown in FIG. 25.

Next, FIG. 25 is a plan view of the deck component 650 with the flanges 656 and 657 positioned within one box-frame-segment 35 and the flanges 658 and 659 positioned within another box-frame-segment 35, and fasteners 50 that affix the deck component 650 to the box-frame-segments 35.

Next, FIG. 26 is an isometric view of the deck component 650 with the flanges 656 and 657 positioned within one box-frame-segment 35 and the flanges 658 and 659 positioned within another box-frame-segment 35, and fasteners 50 that affix the deck component 650 to the box-frame-segments 35.

The deck component 650 can be manufactured with various dimensions. The following three paragraphs list example dimensions with respect to the deck component 650. A dimension 675 of the post sleeve extension 670 can be based on the type of structure that will include the deck component 650 and other factors, such as a particular building code applicable to a geographical location where the deck component 650 will be used.

A first example structure including the deck component 650 is a multi-story structure in which the post sleeve extension supports at least one other level of the multi-story structure. For embodiments in which the deck component 650 is used in the first example structure or another structure, the dimension 675 can be 2.438 meters (i.e., 8 feet), 2.743 meters (i.e., 9 feet), or some other dimension that provides for a desired span between box-frame segments 35 of adjacent levels of the multi-story structure.

A second example structure including the deck component 650 is a structure, such as a deck, including a guard rail. For embodiments in which the deck component 650 is used in the second example structure or another structure, the dimension 675 can be based on a building code, such as the 2012 International Residential Code (IRC) discussed previously. Dimension 675 spans from the top side 668 of the post sleeve 651 to a position on the post sleeve 651 at which the top of the box-frame segment 35 contacts the post sleeve 651 (i.e., an upper box-frame-segment contact point). Dimension 676 spans from the bottom of the post sleeve 651 to the top of flange 658. Dimension 677 spans from the top of the flange 678 to the upper box-frame-segment contact point of the post sleeve 651. Dimension 678 spans from the top side 668 to the bottom side 669 of the post sleeve 651. Table 1 provides examples of dimensions 675, 676, 677, and 678.

A width of the exterior surface of the side walls 652 to 655 can be 10.16 cm (i.e., 4 inches) and the post sleeve 651 can comprise a rectangular cross section. A thickness of the side walls 652 to 655 can be 0.3175 cm (i.e., 0.125 inches) such that a length of the interior surface of the side walls can be 9.525 cm (i.e., 3.75 inches), or 0.508 cm (i.e., 0.20 inches) such that a length of the interior surface of the side walls can be 9.144 cm (i.e., 3.60 inches). The flanges 656 and 658 can extend away from the exterior surface 5.08 cm (i.e., 2 inches), have heights of 10.16 cm (i.e., 4 inches) and have thicknesses of 0.635 cm (i.e., 0.25 inches). The flanges 657 and 659 can extend away from the exterior surface 5.715 cm (i.e., 2.25 inches), have heights of 10.795 cm (i.e., 4.25 inches) and have thicknesses of 0.47625 cm (i.e., 0.60875 inches). A shortest distance between two flanges abutting from the same exterior surface can be 1.74625 cm (i.e., 0.6875 inches). A distance from a top of the flanges 656 and 658 to the top of the post sleeve 651 can be 0.635 cm (i.e., 0.25 inches) plus dimension 675. A distance from a bottom of the flanges 656 and 658 to the bottom of the post sleeve 651 can be 2.54 cm (i.e., 1 inch). A distance from a top of the flanges 657 and 659 to the top of the post sleeve 651 can be 0.9525 cm (i.e., 0.375 inches). A distance from a bottom of the flanges 657 and 609 to bottom of the post sleeve 651 can be 1.5875 cm (i.e., 0.625 inches). Other examples of one or more the measurements in this and the preceding two paragraphs are possible.

Figure 27:
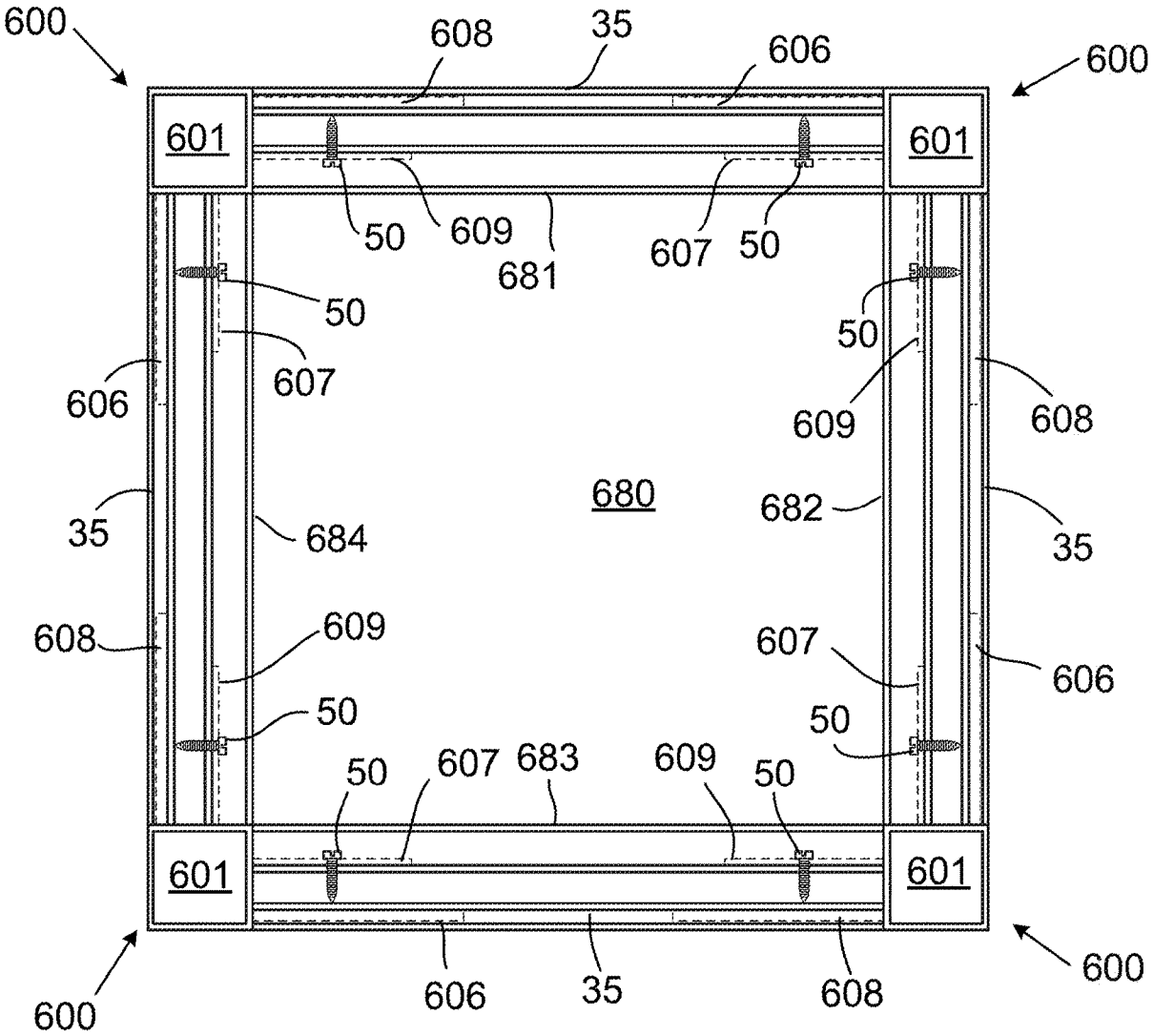
FIG. 27 and FIG. 28 are plan views of a box-frame perimeter comprising multiple post sleeves and box-frame-segments.

Next, FIG. 27 is a plan view of a box-frame-perimeter 680. The box-frame-perimeter 280 comprises four deck components 600 and four box-frame-segments 35. Each of the box-frame segments 35 of the box-frame-perimeter 680 connects to two of the deck components 600. Each of the box-frame-segments 35 of the box-frame-perimeter 680 includes a box-frame-segment attachment 681, 682, 683, or 684 attached. Each of the box-frame-segment attachments 681, 682, 683, or 684 can comprise one or more box-frame-segment attachments. Each box-frame-segment attachment of the box-frame-segment attachments 681, 682 683, or 684 can be configured like the box-frame-segment attachment 526 show in FIG. 18. Joists (not shown) can be attached to two opposing box-frame-segment attachments, such as the box-frame-segment attachments 682 and 684. Deck boards (not shown) can be affixed to the box-frame-perimeter 680.

A box-frame perimeter including deck components 600 could include other deck components including a post sleeve (e.g., a post sleeve with a post sleeve extension). For example, a box-frame perimeter could comprise a deck component 700 (shown in FIG. 29 and FIG. 30) to connect the upper box-frame segment 35 shown in FIG. 27 and another deck component 700 to connect the lower box-frame-segment 35 shown in FIG. 27 if a span of the upper and lower box-frame-segments 35 require additional posts to support the box-frame-segments due to the length of a span of the upper and lower box-frame-segments shown in FIG. 27. In this regard, the upper and lower box-frame-segments 35 can be cut into multiple box-frame-segments with square cut edges for connection to a deck component 600 and a deck component 700, or a deck component 730 shown in FIG. 31 and FIG. 32.

Figure 28:
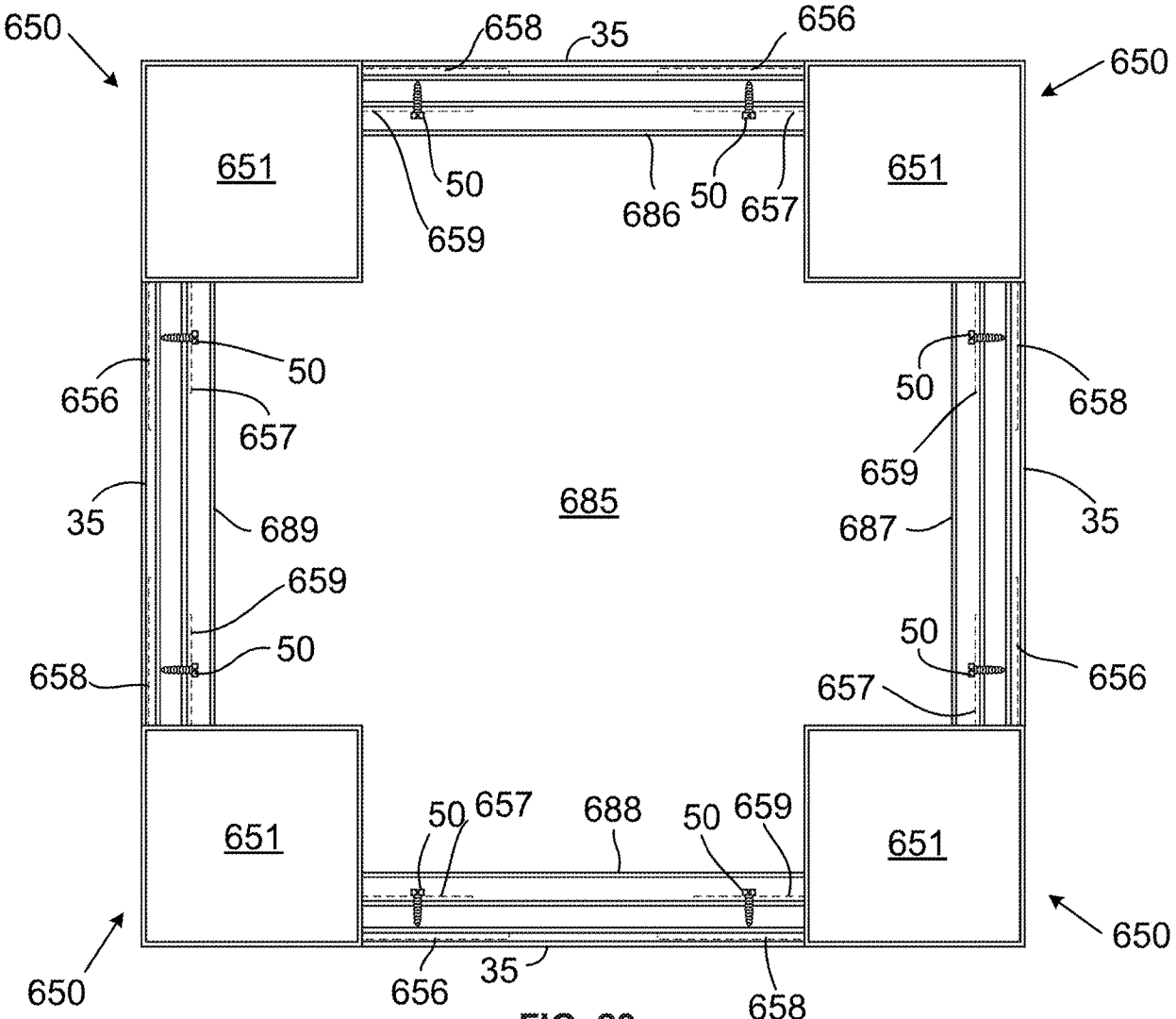

Next, FIG. 28 is a plan view of a box-frame-perimeter 685. The box-frame-perimeter 685 comprises four deck components 650 and four box-frame-segments 35. Each of the box-frame segments 35 of the box-frame-perimeter 685 connects to two of the deck components 650. Each of the box-frame-segments 35 of the box-frame-perimeter 685 includes a box-frame-segment attachment 686, 687, 688, or 689 attached. Each of the box-frame-segment attachments 686, 687, 688, or 689 can comprise one or more box-frame-segment attachments. Each box-frame-segment attachment of the box-frame-segment attachments 686, 687, 688, or 689 can be configured like the box-frame-segment attachment 526 show in FIG. 18. Joists (not shown) can be attached to two opposing box-frame-segment attachments, such as the box-frame-segment attachments 687 and 689. Deck boards (not shown) can be affixed to the box-frame-perimeter 685.

A box-frame perimeter including deck components 700 could include other deck components including a post sleeve. For example, a box-frame perimeter could comprise a deck component 800 (shown in FIG. 33 and FIG. 34) to connect the upper box-frame segment 35 shown in FIG. 28 and another deck component 800 to connect the lower box-frame-segment 35 shown in FIG. 28 if a span of the upper and lower box-frame-segments 35 require additional posts to support the box-frame-segments due to the length of a span of the upper and lower box-frame-segments shown in FIG. 28. In this regard, the upper and lower box-frame-segments 35 can be cut into multiple box-frame-segments with square cut edges for connection to a deck component 700 and a deck component 800, or a deck component 830 shown in FIG. 35 and FIG. 36.

Next, FIG. 29, FIG. 30, FIG. 31, FIG. 32, FIG. 33, and FIG. 34 (or more simply, FIG. 29 to FIG. 34) show additional example embodiments of deck components comprising a post sleeve, a post sleeve extension, and flanges on multiple side walls of the post sleeve. The dimensions of the post sleeves, post sleeve extensions, and flanges shown in FIG. 29 to FIG. 34 can be the same as or different than the example dimensions discussed with respect to the deck component 600.

Figure 29:
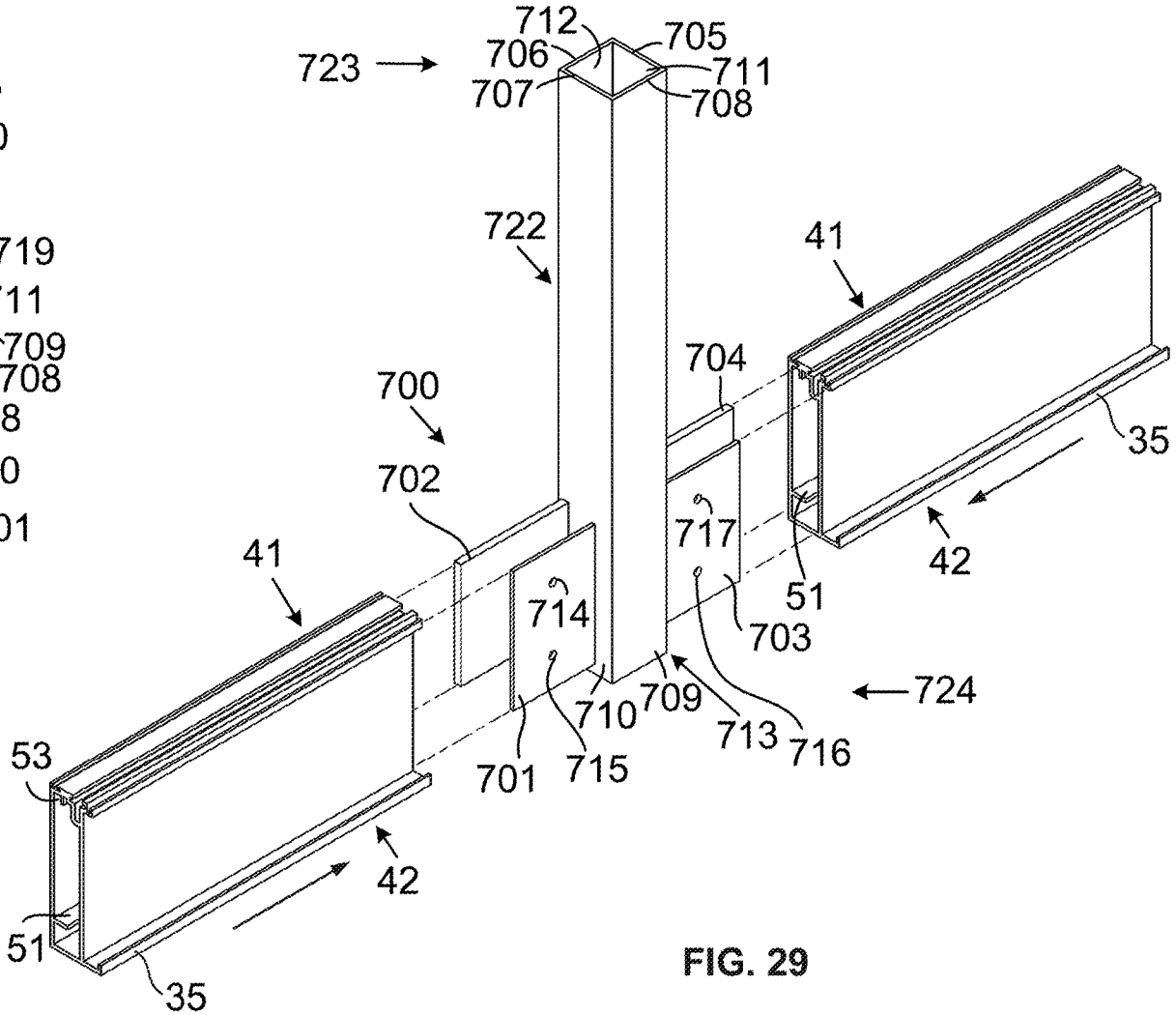
FIG. 29 is an isometric view of a post sleeve and two box-frame-segments.
Figure 30:
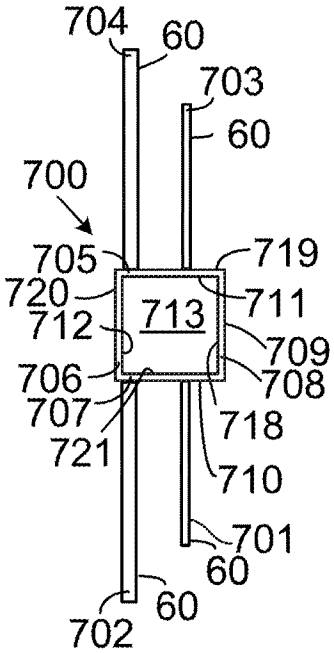
FIG. 30 is a plan view of the post sleeve shown in FIG. 29.
Figure 32:
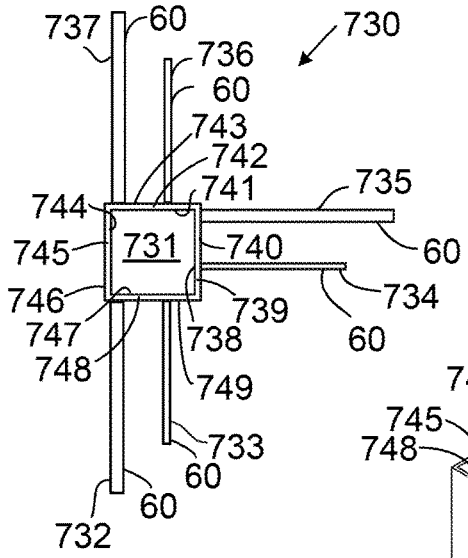
FIG. 32 is a plan view of the post sleeve shown in FIG. 31.
Figure 31:
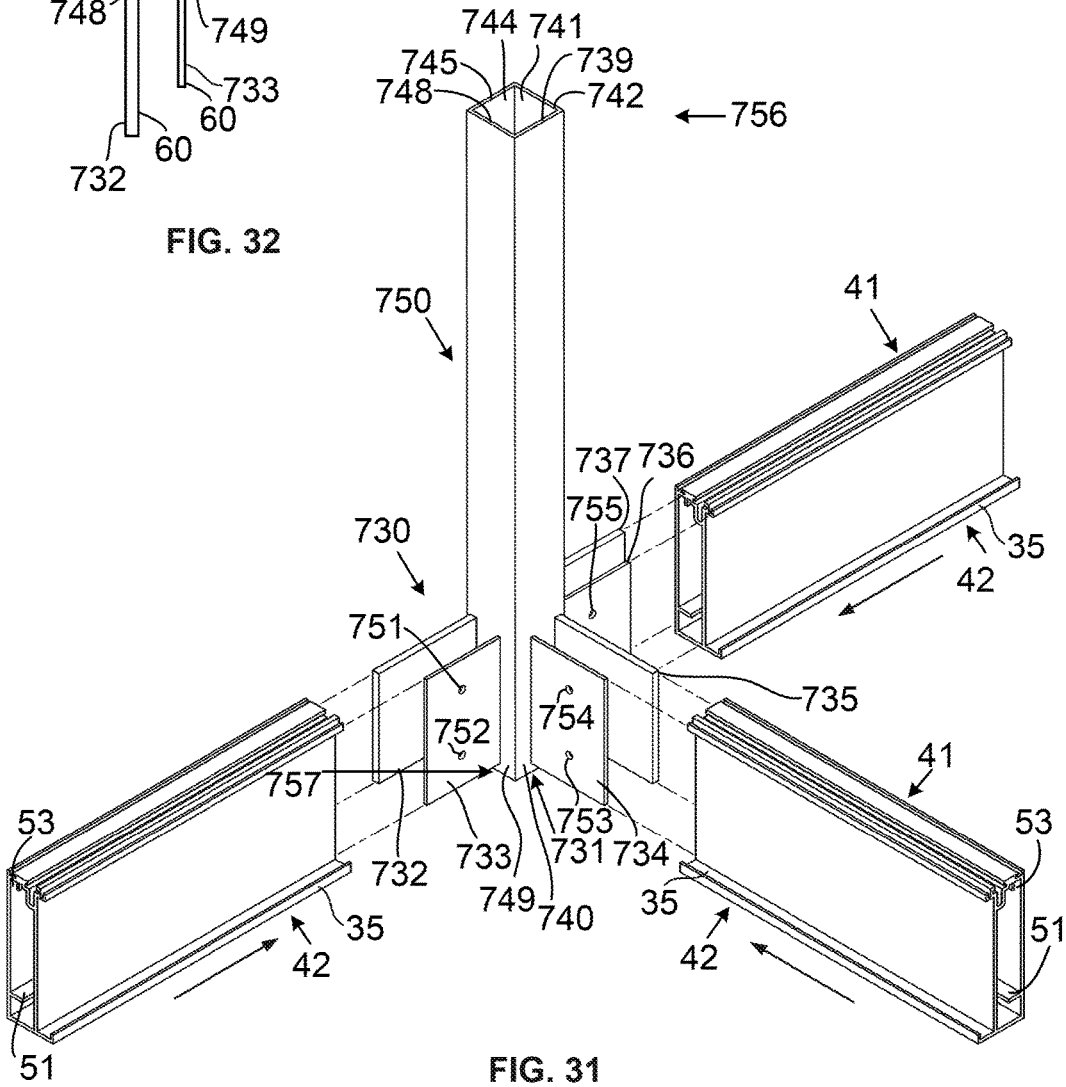
FIG. 31 is an isometric view of a post sleeve and two box-frame-segments.

In particular, FIG. 29 shows a deck component 700 with flanges on two opposing side walls of four side walls of a post sleeve 713 with a post sleeve extension 722, and FIG. 31 shows a deck component 730 with flanges on three of four side walls of a post sleeve 731 with a post sleeve extension 750. The flanges on the deck components 700 and 730 are configured for being positioned within box-frame-segments 35. The exterior surfaces of the side walls for the deck components 10, 700, and 730 are flat so that a square-cut edge of the box-frame-segment 35 can be positioned flush against a side wall (i.e., in contact with each other). FIG. 30, and FIG. 32, show plan views of deck components 700 and 730, respectively.

The deck component 700 includes a post sleeve 713 with a post sleeve extension 722 that extends vertically above the box-frame-segments 35 when attached to the deck component 700. The post sleeve 713 comprises side walls 705, 706, 707, and 708 (or more simply, "side walls 705 to 708"). With the deck component 700 oriented as shown in FIG. 29, the post sleeve 713 comprises a top side 723 and a bottom side 724. The deck component 700 comprises flanges 701 and 702 that extend from the side wall 707, and flanges 703 and 704 that extend from the side wall 705. The flanges 701 and 702 can abut the side wall 707 at an exterior surface of the side wall 707 or within a slot within the side wall 707. The flanges 703 and 704 can abut the side wall 705 at an exterior surface of the side wall 705 or within a slot within the side wall 705.

The side wall 705 comprises an interior surface 711 and an exterior surface 719. The side wall 706 comprises an interior surface 712 and an exterior surface 720. The side wall 707 comprises an interior surface 721 and an exterior surface 710. The side wall 708 comprises an interior surface 718 and an exterior surface 709. A post (not shown) can be positioned within a hollow portion of the post sleeve 713. The post sleeve 713 can be hollow from the top side 723 to the bottom side 724. Alternatively, a portion of the post sleeve 713 between the top side 723 and the bottom side 724 can be solid. A post can be installed into the post sleeve 713 from the top side 723 or from the bottom side 724. A post sleeve cover (not shown) could be installed within the post sleeve 713 at the top side 723.

As an example, the post sleeve 713 and the flanges 701, 702, 703, and 704 (or more simply, the flanges 701 to 704) can be formed by extruding a metal billet through a die as a single extruded deck component comprising the post sleeve 713 and the flanges 701 to 704. The flanges 701 to 704 formed by extrusion can be milled to lower the top surfaces of the flanges 701 to 704 below a top surface of the post sleeve 713 and to raise the bottom surfaces of the flanges 701 to 704 above a bottom surface of the post sleeve 713. Milling the flanges 701 to 704 formed by extrusion allows the flanges 701 and 702 to be positioned within one box-frame-segment 35 shown in FIG. 29 and the flanges 703 and 704 to be positioned within another box-frame-segment 35 shown in FIG. 29.

As another example, the post sleeve 713 and the flanges 701 to 704 can be formed by casting a metal as a single cast deck component comprising the post sleeve 713 and the flanges 701 to 704. The mold used to form the single cast deck component can be formed to minimize or eliminate the need to mill the flanges 701 to 704 to fit within the box-frame-segment 35.

As yet another example, the post sleeve 713 can be formed by extruding or casting a metal and the flanges 701 to 704 can be formed by extruding, casting or rolling a metal. In this example, the deck component 700 can be formed by affixing the flanges 701 to 704 to the post sleeve 713. The flanges 701 and 702 can be affixed to the post sleeve 713 by welding the flanges 701 and 702 to the exterior surface 710 of the side wall 707. The flanges 703 and 704 can be affixed to the post sleeve 713 by welding the flanges 703 and 704 to the exterior surface of the side wall 705. Welding the flanges 701 to 704 on the weld sides 60 can prevent weld beads from interfering with installation of the box-frame-segments 35 to the deck component 700.

Figure 39:
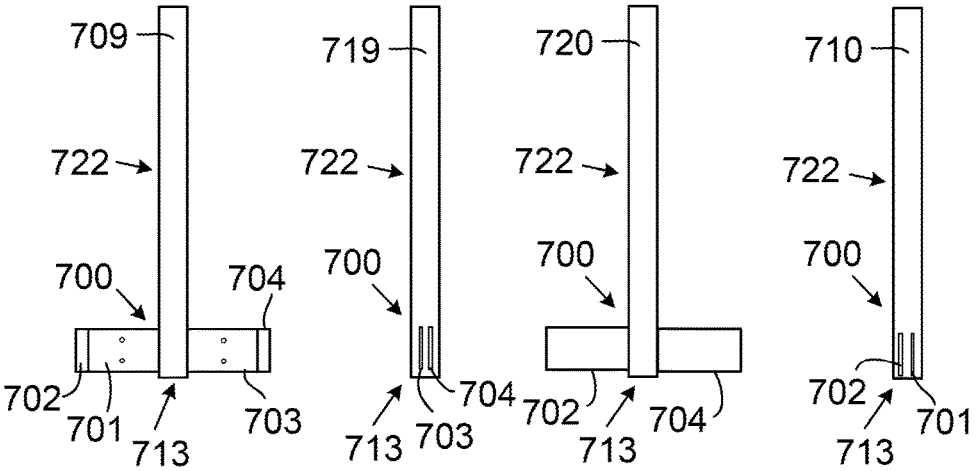

The flange 701 comprises attachment holes 714 and 715 for affixing the flange 701 to one of the box-frame-segments 35 shown in FIG. 29 using fasteners 50 (not shown). The flange 703 comprises attachment holes 716 and 717 for affixing the flange 703 to another of the box-frame-segments 35 shown in FIG. 29 using fasteners 50 (not shown). Alternatively, each of the flanges 701 and 703 may comprise only one attachment hole or some other number of attachment holes. FIG. 39 shows elevation views of the deck component 700.

Turning to FIG. 31, the deck component 730 includes a post sleeve 731 with a post sleeve extension 750 that extends vertically above the box-frame-segments 35 when attached to the deck component 730. The post sleeve 731 comprises side walls 739, 742, 745, and 748. With the deck component 730 oriented as shown in FIG. 31, the post sleeve 731 comprises a top side 756 and a bottom side 757. The deck component 730 comprises flanges 732 and 733 that extend from the side wall 748, flanges 734 and 735 that extend from the side wall 739, and flanges 736 and 737 that extend from the side wall 742. The flanges 732 and 733 can abut the side wall 748 at an exterior surface of the side wall 748 or within a slot within the side wall 748. The flanges 734 and 735 can abut the side wall 739 at an exterior surface of the side wall 739 or within a slot within the side wall 739. The flanges 736 and 737 can abut the side wall 742 at an exterior surface of the side wall 742 or within a slot within the side wall 742.

The side wall 739 comprises an interior surface 738 and an exterior surface 740. The side wall 742 comprises an interior surface 741 and an exterior surface 743. The side wall 745 comprises an interior surface 744 and an exterior surface 746. The side wall 748 comprises an interior surface 747 and an exterior surface 749. A post (not shown) can be positioned within a hollow portion of the post sleeve 731. The post sleeve 731 can be hollow from the top side 756 to the bottom side 757. Alternatively, a portion of the post sleeve 731 between the top side 756 and the bottom side 757 can be solid. A post can be installed into the post sleeve 731 from the top side 756 or from the bottom side 757. A post sleeve cover (not shown) could be installed within the post sleeve 731 at the top side 756.

As an example, the post sleeve 731 and the flanges 732, 733, 734, 735, 736, and 737 (or more simply, "the flanges 732 to 737") can be formed by extruding a metal billet through a die as a single extruded deck component comprising the post sleeve 731 and the flanges 732 to 737. The flanges 732 to 737 formed by extrusion can be milled to lower the top surfaces of the flanges 732 to 737 below a top surface of the post sleeve 731 and to raise the bottom surfaces of the flanges 732 to 737 above a bottom surface of the post sleeve 731. Milling the flanges 732 to 737 formed by extrusion allows the flanges 732 and 733 to be positioned within one box-frame-segment 35 shown in FIG. 31, the flanges 734 and 735 to be positioned within another box-frame-segment 35 shown in FIG. 31, and the flanges 736 and 737 to be positioned within yet another box-frame-segment 35 shown in FIG. 31.

As another example, the post sleeve 731 and the flanges 732 to 737 can be formed by casting a metal as a single cast deck component comprising the post sleeve 731 and the flanges 732 to 737. The mold used to form the single cast deck component can be formed to minimize or eliminate the need to mill the flanges 732 to 737 to fit within the box-frame-segments 35.

As yet another example, the post sleeve 731 can be formed by extruding or casting a metal and the flanges 732 to 737 can be formed by extruding, casting or rolling a metal. In this example, the deck component 730 can be formed by affixing the flanges 732 to 737 to the post sleeve 731. The flanges 732 and 733 can be affixed to the post sleeve 731 by welding the flanges 732 and 733 to the exterior surface 749 of the post sleeve 731. The flanges 734 and 735 can be affixed to the post sleeve 731 by welding the flanges 734 and 735 to the exterior surface 740 of the side wall 739. The flanges 736 and 737 can be affixed to the post sleeve 731 by welding the flanges 736 and 737 to the exterior surface 743 of the side wall 742. Welding the flanges 732 to 737 on the weld sides 60 can prevent weld beads from interfering with installation of the box-frame-segments 35 to the deck component 730.

Figure 40:
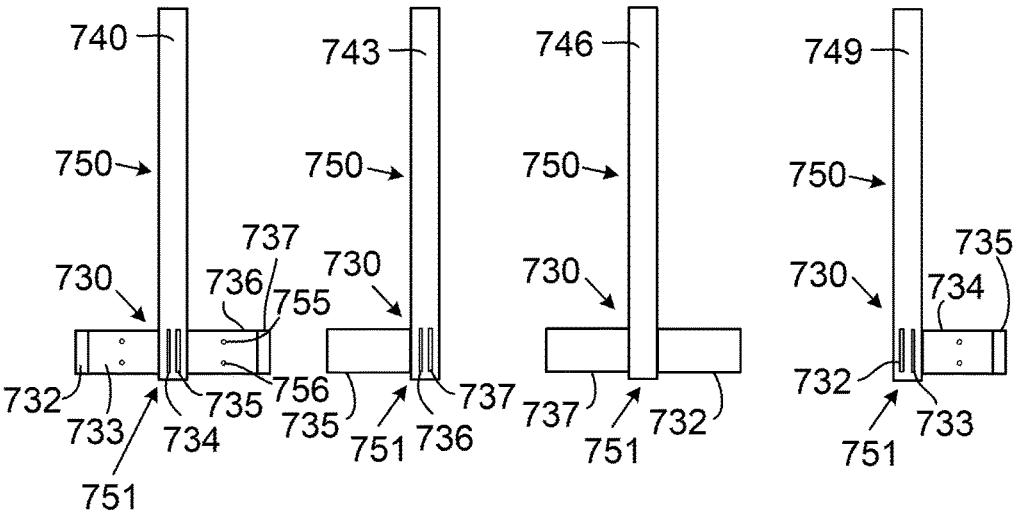

The flange 733 comprises attachment holes 751 and 752 for affixing the flange 733 to one of the box-frame-segments 35 shown in FIG. 31 using fasteners 50 (not shown). The flange 734 comprises attachment holes 753 and 754 for affixing the flange 734 to another of the box-frame-segments 35 shown in FIG. 31 using fasteners 50 (not shown). The flange 736 comprises attachment holes 755 and 756 (shown in FIG. 40) for affixing the flange 736 to yet another of the box-frame-segments 35 shown in FIG. 31 using fasteners 50 (not shown). Alternatively, each of the flanges 733, 734 and 736 may comprise only one attachment hole or some other number of attachment holes. FIG. 40 shows elevation views of the deck component 730.

Figure 33:
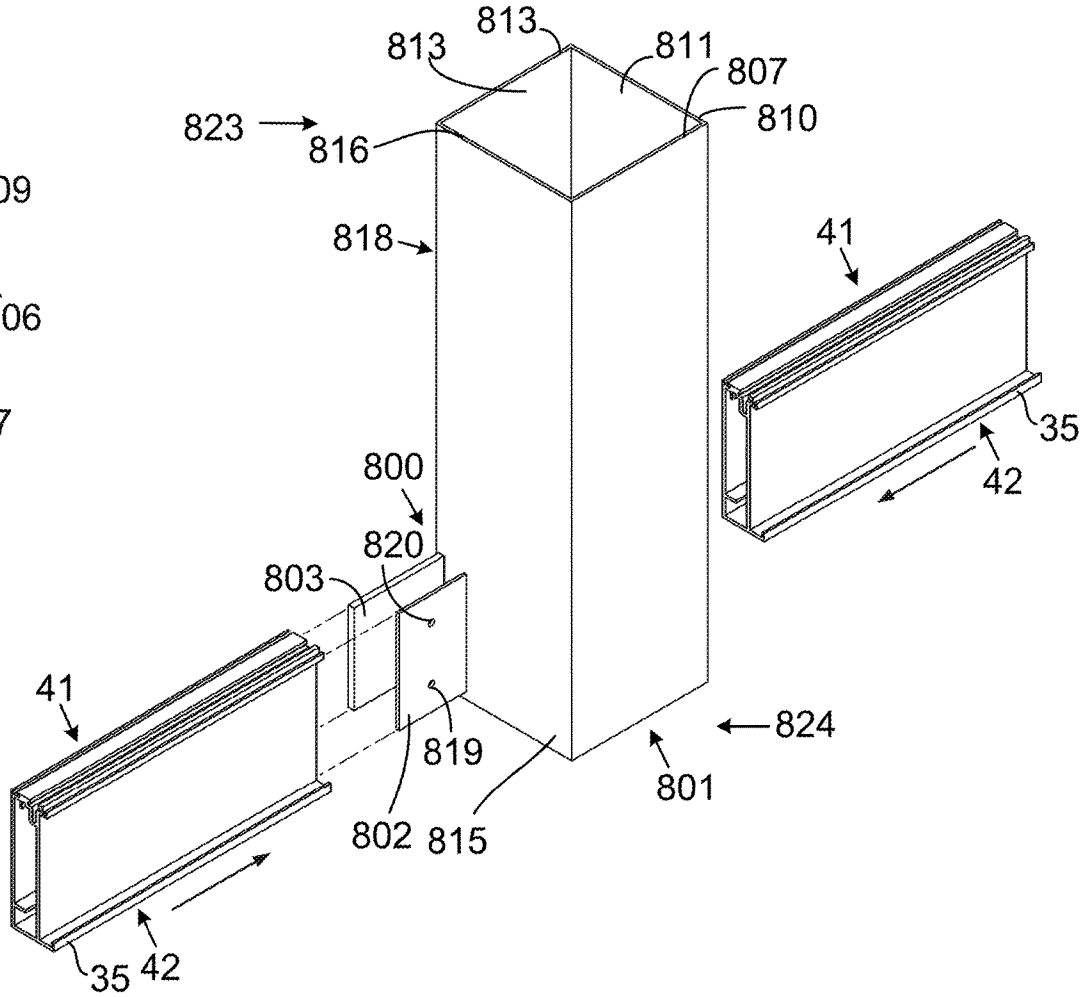
FIG. 33 is an isometric view of a post sleeve and two box-frame-segments.
Figure 34:
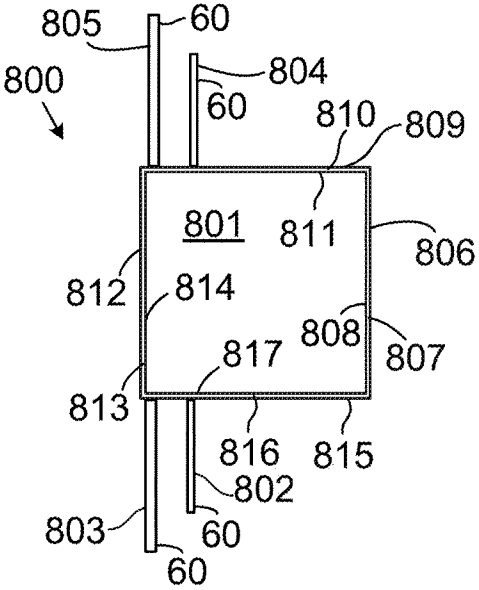
FIG. 34 is a plan view of the post sleeve shown in FIG. 33.

Turning to FIG. 33, the deck component 800 includes a post sleeve 801 with a post sleeve extension 818 that extends vertically above the box-frame-segments 35 when attached to the deck component 800. The post sleeve 801 comprises side walls 807, 810, 813, and 816. With the deck component 800 oriented as shown in FIG. 33, the post sleeve 801 comprises a top side 823 and a bottom side 824. The deck component 800 comprises flanges 802 and 803 that extend from the side wall 816, and flanges 804 and 805 that extend from the side wall 810. The flanges 802 and 803 can abut the side wall 816 at an exterior surface of the side wall 816 or within a slot within the side wall 816. The flanges 804 and 805 can abut the side wall 810 at an exterior surface of the side wall 810 or within a slot within the side wall 810.

The side wall 807 comprises an interior surface 808 and an exterior surface 806. The side wall 810 comprises an interior surface 811 and an exterior surface 809. The side wall 813 comprises an interior surface 814 and an exterior surface 812. The side wall 816 comprises an interior surface 817 and an exterior surface 815. A post (not shown) can be positioned within a hollow portion of the post sleeve 801. The post sleeve 801 can be hollow from the top side 823 to the bottom side 824. Alternatively, a portion of the post sleeve 801 between the top side 823 and the bottom side 824 can be solid. A post can be installed into the post sleeve 801 from the top side 823 or from the bottom side 824. A post sleeve cover (not shown) could be installed within the post sleeve 801 at the top side 823.

As an example, the post sleeve 801 and the flanges 802, 803, 804, and 805 (or more simply, the flanges 802 to 805) can be formed by extruding a metal billet through a die as a single extruded deck component comprising the post sleeve 801 and the flanges 802 to 805. The flanges 802 to 805 formed by extrusion can be milled to lower the top surfaces of the flanges 802 to 805 below a top surface of the post sleeve 801 and to raise the bottom surfaces of the flanges 802 to 805 above a bottom surface of the post sleeve 801. Milling the flanges 802 to 805 formed by extrusion allows the flanges 802 and 803 to be positioned within one box-frame-segment 35 shown in FIG. 33 and the flanges 804 and 805 to be positioned within another box-frame-segment 35 shown in FIG. 33.

As another example, the post sleeve 801 and the flanges 802 to 805 can be formed by casting a metal as a single cast deck component comprising the post sleeve 801 and the flanges 802 to 805. The mold used to form the single cast deck component can be formed to minimize or eliminate the need to mill the flanges 802 to 805 to fit within the box-frame-segment 35.

As yet another example, the post sleeve 801 can be formed by extruding or casting a metal and the flanges 802 to 805 can be formed by extruding, casting or rolling a metal. In this example, the deck component 800 can be formed by affixing the flanges 802 to 805 to the post sleeve 801. The flanges 802 and 803 can be affixed to the post sleeve 801 by welding the flanges 802 and 803 to the exterior surface 815. The flanges 804 and 805 can be affixed to the post sleeve 801 by welding the flanges 804 and 805 to the exterior surface 809. Welding the flanges 802 to 805 on the weld sides 60 can prevent weld beads from interfering with installation of the box-frame-segments 35 to the deck component 800.

Figure 41:
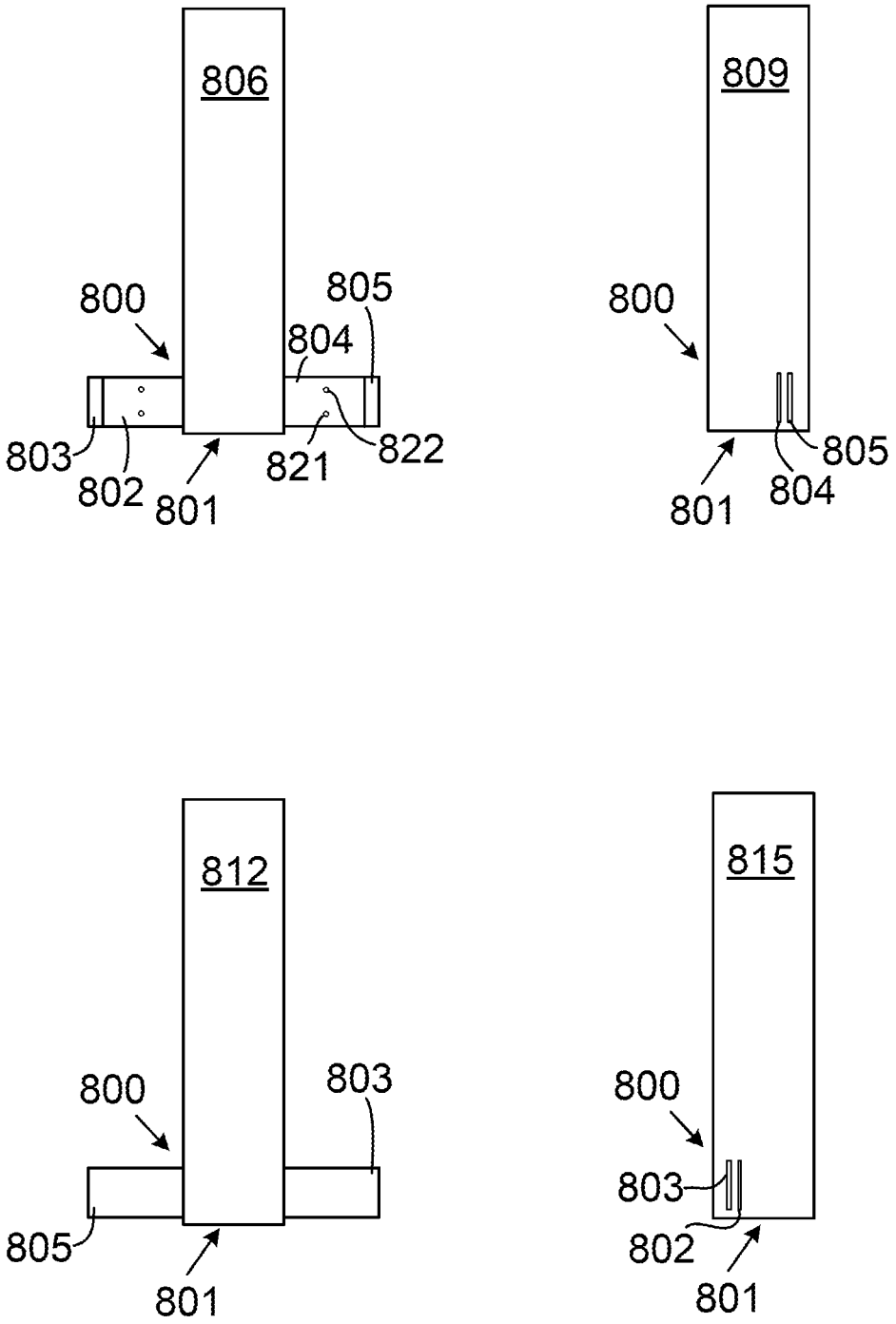

The flange 802 comprises attachment holes 819 and 820 for affixing the flange 802 to one of the box-frame-segments 35 shown in FIG. 33 using fasteners 50 (not shown). The flange 804 also comprises attachment holes 821 and 822 (shown in FIG. 41) for affixing the flange 804 to another of the box-frame-segments 35 shown in FIG. 33 using fasteners 50 (not shown). Alternatively, each of the flanges 803 and 804 may comprise only one attachment hole or some other number of attachment holes. FIG. 41 shows elevation views of the deck component 800.

Figure 35:
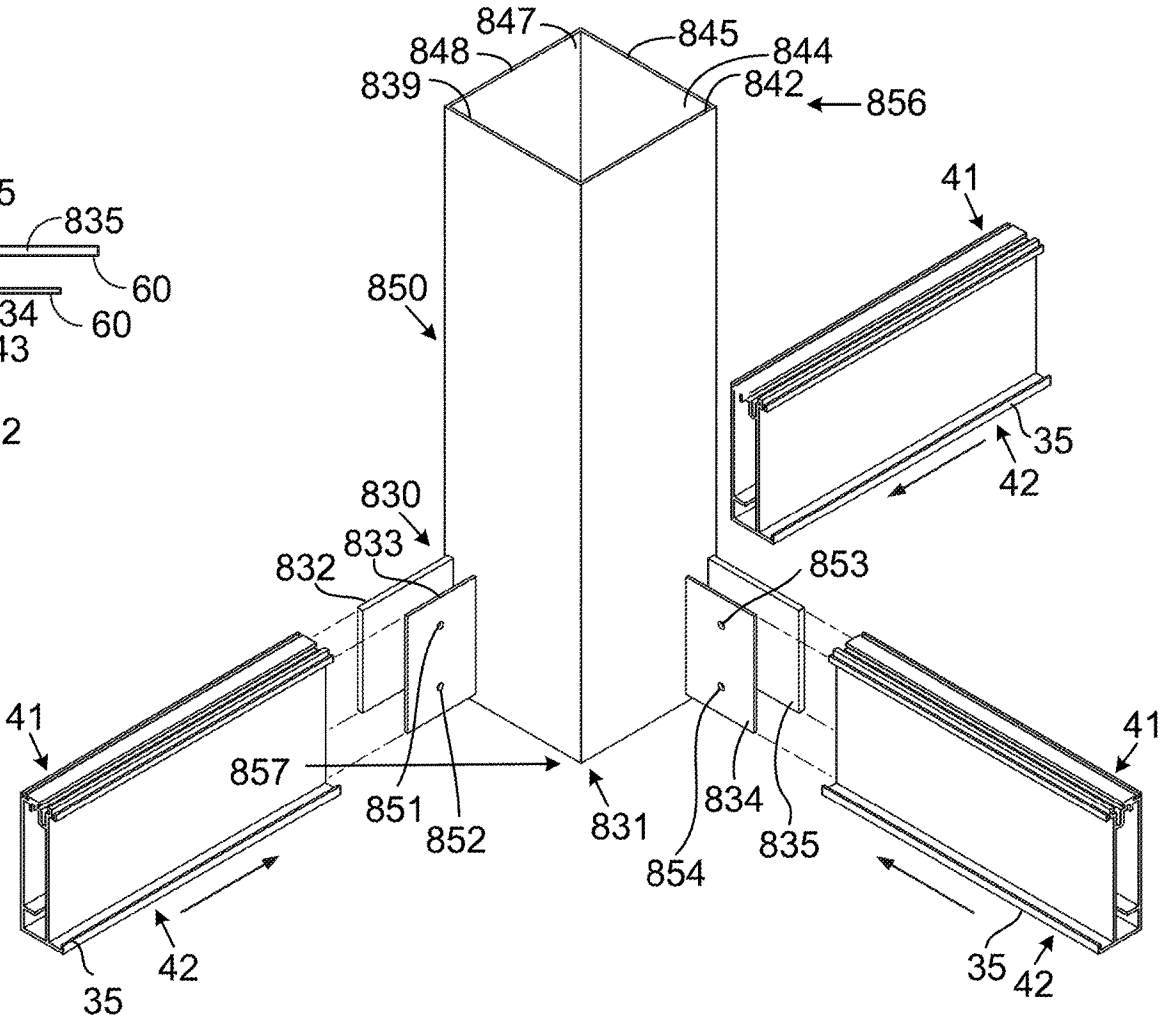
FIG. 35 is an isometric view of an example post sleeve and two box-frame-segments.
Figure 36:
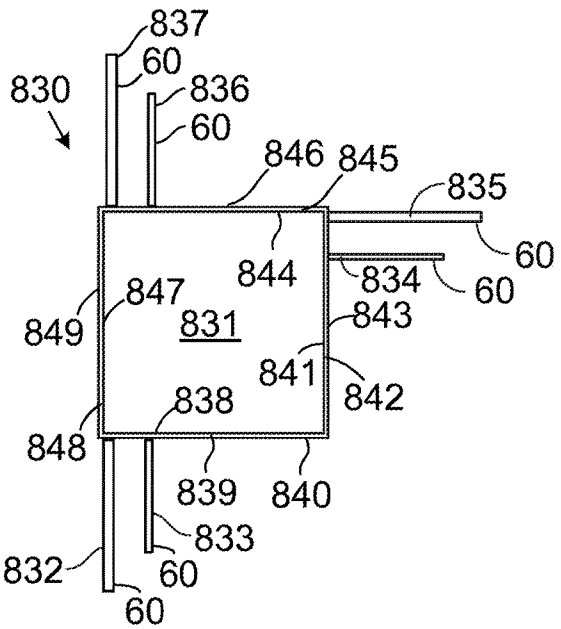
FIG. 36 is a plan view of the post sleeve shown in FIG. 35.

Turning to FIG. 35, the deck component 830 includes a post sleeve 831 with a post sleeve extension 850 that extends vertically above the box-frame-segments 35 when attached to the deck component 830. The post sleeve 831 comprises side walls 839, 842, 845, and 848. With the deck component 830 oriented as shown in FIG. 35, the post sleeve 831 comprises a top side 856 and a bottom side 857. The deck component 830 comprises flanges 832 and 833 that extend from the side wall 839, flanges 834 and 835 that extend from the side wall 842, and flanges 836 and 837 that extend from the side wall 845. The flanges 832 and 833 can abut the side wall 839 at an exterior surface of the side wall 839 or within a slot within the side wall 839. The flanges 834 and 835 can abut the side wall 842 at an exterior surface of the side wall 842 or within a slot within the side wall 842. The flanges 836 and 837 can abut the side wall 845 at an exterior surface of the side wall 845 or within a slot within the side wall 845.

The side wall 839 comprises an interior surface 838 and an exterior surface 840. The side wall 842 comprises an interior surface 841 and an exterior surface 843. The side wall 845 comprises an interior surface 844 and an exterior surface 846. The side wall 848 comprises an interior surface 847 and an exterior surface 849. A post (not shown) can be positioned within a hollow portion of the post sleeve 831. The post sleeve 831 can be hollow from the top side 856 to the bottom side 857. Alternatively, a portion of the post sleeve 831 between the top side 856 and the bottom side 857 can be solid. A post can be installed into the post sleeve 831 from the top side 856 or from the bottom side 857. A post sleeve cover (not shown) could be installed within the post sleeve 831 at the top side 856.

As an example, the post sleeve 831 and the flanges 832, 833, 834, 835, 836, and 837 (or more simply, "the flanges 832 to 837") can be formed by extruding a metal billet through a die as a single extruded deck component comprising the post sleeve 831 and the flanges 832 to 837. The flanges 832 to 837 formed by extrusion can be milled to lower the top surfaces of the flanges 832 to 837 below a top surface of the post sleeve 831 and to raise the bottom surfaces of the flanges 832 to 837 above a bottom surface of the post sleeve 831. Milling the flanges 832 to 837 formed by extrusion allows the flanges 832 and 833 to be positioned within one box-frame-segment 35 shown in FIG. 35, the flanges 834 and 835 to be positioned within another box-frame-segment 35 shown in FIG. 35, and the flanges 836 and 837 to be positioned within yet another box-frame-segment 35 shown in FIG. 35.

As another example, the post sleeve 831 and the flanges 832 to 837 can be formed by casting a metal as a single cast deck component comprising the post sleeve 831 and the flanges 832 to 837. The mold used to form the single cast deck component can be formed to minimize or eliminate the need to mill the flanges 832 to 837 to fit within the box-frame-segments 35.

As yet another example, the post sleeve 831 can be formed by extruding or casting a metal and the flanges 832 to 837 can be formed by extruding, casting or rolling a metal. In this example, the deck component 830 can be formed by affixing the flanges 832 to 837 to the post sleeve 831. The flanges 832 and 833 can be affixed to the post sleeve 831 by welding the flanges 832 and 833 to the exterior surface 840. The flanges 834 and 835 can be affixed to the post sleeve 831 by welding the flanges 834 and 835 to the exterior surface 843. The flanges 836 and 837 can be affixed to the post sleeve 831 by welding the flanges 836 and 837 to the exterior surface 846. Welding the flanges 832 to 837 on the weld sides 60 can prevent weld beads from interfering with installation of the box-frame-segments 35 to the deck component 830.

Figure 42:
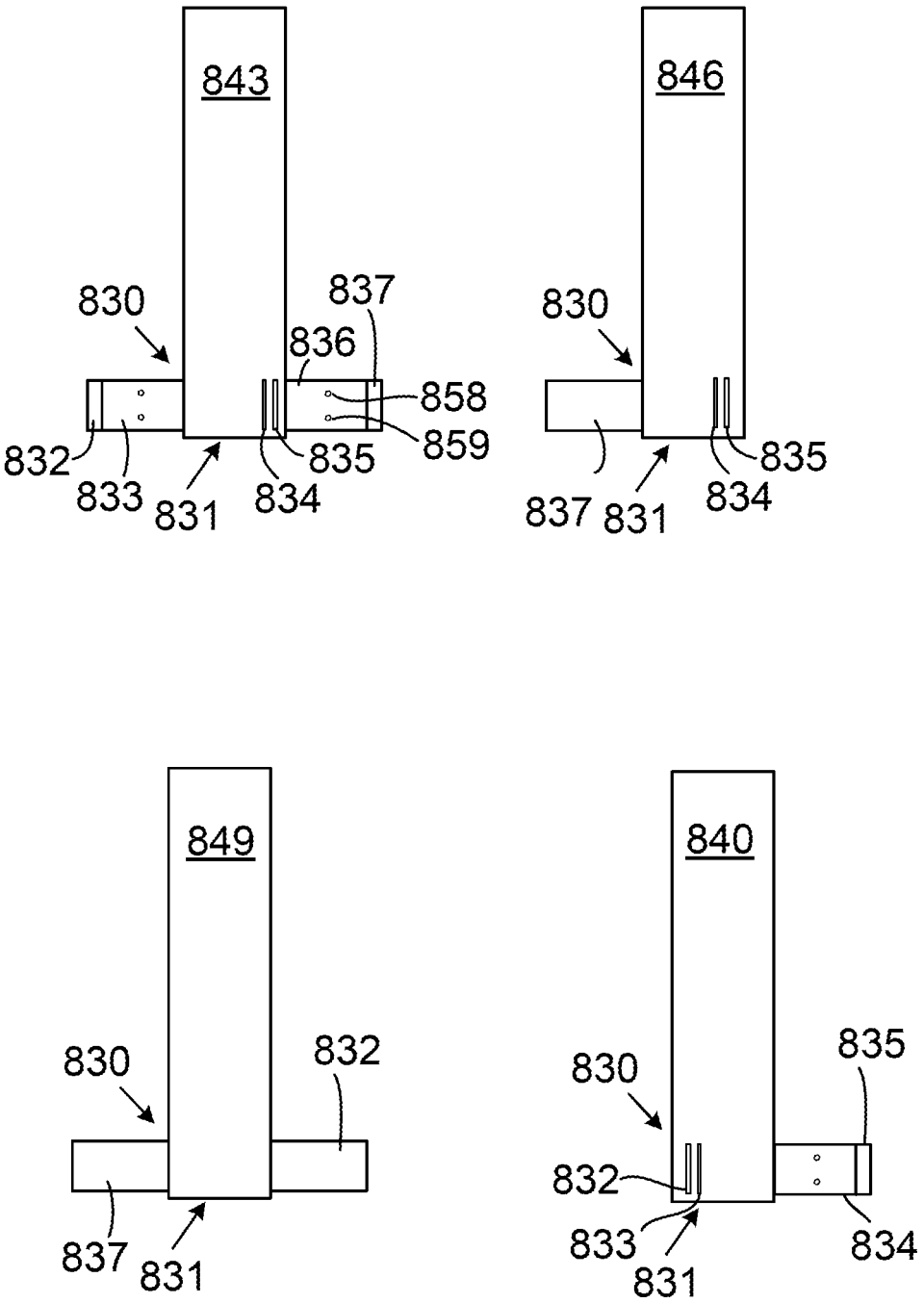

The flange 833 comprises attachment holes 851 and 852 for affixing the flange 833 to one of the box-frame-segments 35 shown in FIG. 35 using fasteners 50 (not shown). The flange 834 comprises attachment holes 853 and 854 for affixing the flange 834 to another of the box-frame-segments 35 shown in FIG. 35 using fasteners 50 (not shown). The flange 836 comprises attachment holes 858 and 859 (shown in FIG. 42) for affixing the flange 836 to yet another of the box-frame-segments 35 shown in FIG. 35 using fasteners 50 (not shown). Alternatively, each of the flanges 833, 834 and 836 may comprise only one attachment hole or some other number of attachment holes. FIG. 42 shows elevation views of the deck component 830.

The drawings of this applications show post sleeves having two flanges on two or three side walls. Any of the post sleeves shown in the figures can be modified to have two flanges on each of the four sidewalls of the post sleeve.

C. Guard Rails and Deck Boards

Figure 43:
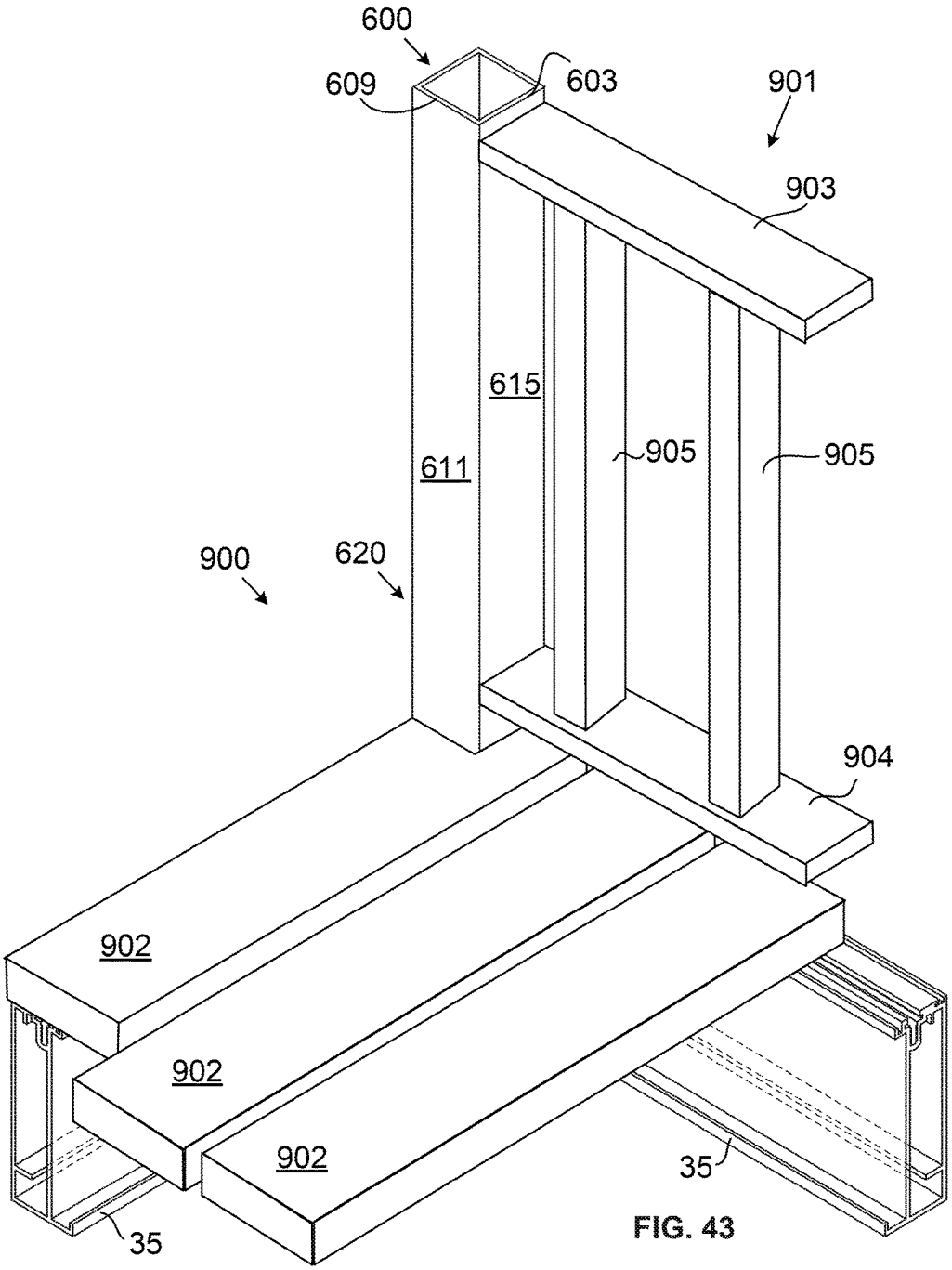
FIG. 43 shows components of an example deck including a guard rail and deck boards.

FIG. 43 shows a portion of an example deck 900. The deck 900 comprises a guard rail 901, deck boards 902, the deck component 600, and the box-frame-segments 35 attached to the deck component 600 (as shown in FIG. 22). The guard rail 901 comprises multiple guard rail components, some of which are shown in FIG. 43. In particular, the guard rail 901 comprises a top rail 903, a bottom rail 904, and balusters 905. The top rail 903 and the bottom rail 904 can span between and attach to post sleeve extensions of two post sleeves. FIG. 43 depicts the top rail 903 and the bottom rail 904 being attached to the side wall 603 of the deck component 600. Any of a variety of brackets and fasteners could be used to attach the top and bottom rails to a post sleeve extension, such as the top rail 903 and the bottom rail 904 that are attached to the post sleeve extension 620. The balusters 905 are positioned between the top rail 903 and the bottom rail 904. The balusters 905 can be attached to one or both of the top rail 903 and the bottom rail 904, or otherwise retained by the top rail 903 and the bottom rail 904.

The box-frame-segments 35 provide support for the deck boards 902. A box-frame-segment attachment, such as the one of the box-frame-segment attachments 681, 682, 683, or 684 (shown in FIG. 27) can be attached to the box-frame-segments 35 shown in FIG. 43 prior to the deck boards 905 being attached as part of the deck 900. Joists attached to the box-frame-segments 35 can also provide support for the deck boards 902.

The deck 900 can comprise one or more other deck components with post sleeve extensions to which guard rail components, such as a top rail and a bottom rail, attach. Decks that use the other deck components with post sleeve extensions can have guard rail components attached thereto.

D. Post Sleeve Extenders

Figure 44:
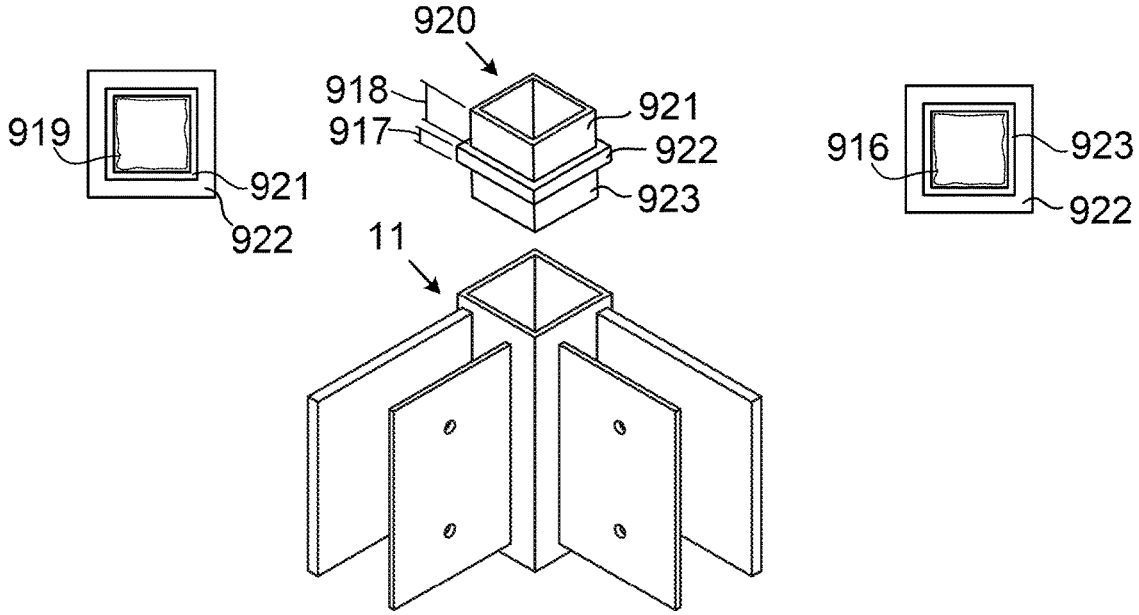
FIG. 44 depicts an example post sleeve and post sleeve extender.
Figure 45:
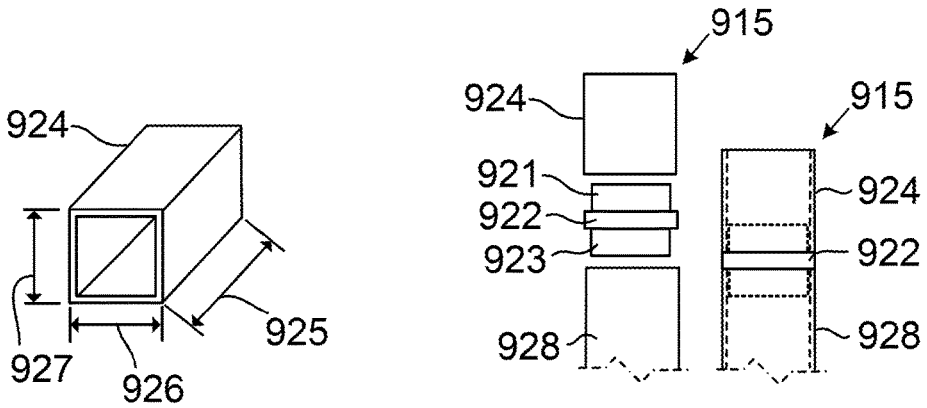
FIG. 45 depicts an example multi-piece post sleeve.

FIG. 19 to FIG. 43 show a variety of example deck components that comprise a post sleeve with a post sleeve extension. The post sleeves of those example deck components can comprise a one piece post sleeve. Alternatively, the post sleeves of those example deck components can comprise a multi-piece post sleeve that comprises a post sleeve base, a post sleeve extender, and a post sleeve extension. FIG. 44 and FIG. 45 depict examples pieces of a multi-piece post sleeve.

FIG. 44 shows the post sleeve 11 and a post sleeve extender 920. The post sleeve extender 920 comprises a post sleeve extender retainer (PSER) 921 (e.g., an upper PSER), a flange 922, and a post sleeve extender retainer 923 (e.g., a lower PSER). The PSER 921 and PSER 923 can comprise a rectangular metal tube (e.g., an aluminum square tube). The flange 922 can comprise a metal plate (e.g., an aluminum plate). The flange 922 and the PSER 921 can be welded together via the weld bead 919. The flange 922 and the PSER 923 can be welded together via the weld bead 916. Other ways of attaching the PSER 921 and the PSER 922 to the flange 923 are also possible. Furthermore, the post sleeve extender 920 could be manufactured via casting the post sleeve extender 920 in a mold.

FIG. 45 shows components of the multi-piece post sleeve 915 unassembled to the left side of the components of the multi-piece post sleeve 915 when assembled. Those components include a post sleeve base 928, the post sleeve extender 920, and a post sleeve extension 924. As an example, the post sleeve base 928 can comprise any post sleeve shown in any of FIG. 19 to FIG. 43 or the post sleeve 11 shown in FIG. 44.

The PSER 923 is configured for positioning within an upper end of a post sleeve, such as the post sleeve 11 shown in FIG. 44 or the post sleeve base 928 shown in FIG. 45.

FIG. 44 and FIG. 45 show example dimensions 917, 918, 925, 926, and 927. The dimension 917 represents a thickness of the flange 922. As an example, the dimension 917 can be 1.91 cm (i.e., 0.75 inches). The dimension 918 represents a height of the PSER 921. As an example, the dimension 921 can be 7.62 cm (i.e., 3.0 inches). The height of the PSER 923 can be, but does not have to be, the same as the height of the PSER 921. The dimension 925 represents a height of the post sleeve extension 924. As an example, the dimension 925 can be 91.44 cm (i.e., 36 inches) for an embodiment in which the multi-piece post sleeve 915 is being used in a deck with a guard rail, or 243.84 cm (i.e., 96 inches) for an embodiment in which multi-piece post sleeve 915 is used in a multi-story deck. The dimension 926 and the dimension 927 represent the lengths (e.g., the width and the depth) of the exterior side walls of the post sleeve extension 924. As an example, the dimensions 926 and 927 can both be 5.08 cm (i.e., 2 inches) or 10.16 cm (i.e., 4 inches). As an example, the thickness of the walls of the PSER 921, the PSER 922, and the post sleeve extension 924 can be 0.3048 cm (i.e., 0.120 inches), 0.3175 cm (i.e., 0.125 inches), or 0.508 cm (i.e., 0.20 inches). Other examples of the dimensions 917, 918, 925, 926, and 927 and the thickness of the walls of the PSER 921, the PSER 923, and the post sleeve extension 924 are also possible.

III. Conclusion

It should be understood that the arrangements described herein or shown in the drawings are for purposes of example only. As such, those skilled in the art will appreciate that other arrangements and elements can be used instead, and some elements can be omitted altogether according to the desired results.

While various aspects and embodiments are described herein, other aspects and embodiments will be apparent to those skilled in the art. The various aspects and embodiments disclosed herein are for purposes of illustration and are not intended to be limiting, with the true scope being indicated by the claims, along with the full scope of equivalents to which such claims are entitled. It is also to be understood that the terminology used herein for the purpose of describing particular embodiments only, and is not intended to be limiting.

In this description, the articles "a," "an," and "the" are used to introduce elements of the example embodiments. The intent of using those articles is that there is one or more of the introduced elements.

In this description, the intent of using the conjunction "or" within a list of at least two elements and the intent of using the terms "at least one of" and "one or more of" immediately preceding a list of at least two elements is to cover each embodiment including a listed component independently and each embodiment comprising a combination of the listed components. For example, an embodiment described as comprising "A, B, or C," or "at least one of A, B, or C," or "one or more of A, B, or C" is intended to cover each of the following possible embodiments: (i) an embodiment comprising A, but not B and not C, (ii) an embodiment comprising B, but not A and not C, (iii) an embodiment comprising C, but not A and not B, (iv) an embodiment comprising A and B, but not C, (v) an embodiment comprising A and C, but not B, (v) an embodiment comprising B and C, but not A, and (vi) an embodiment comprising A, B, and C. For the embodiments comprising component A, the embodiments can comprise one A or multiple A. For the embodiments comprising component B, the embodiments can comprise one B or multiple B. For the embodiments comprising component C, the embodiments can comprise one C or multiple C. The use of ordinal numbers such as "first," "second," "third" and so on is to distinguish respective elements rather than to denote a particular order of those elements unless the context of using those terms explicitly indicates otherwise.

I claim:

1. A deck component comprising:

a post sleeve including a post sleeve base, a post sleeve extension, a first side wall, a second side wall, a third side wall, and a fourth side wall, wherein the post sleeve base includes at least a first portion of each of the first side wall, the second side wall, the third side wall, and the fourth side wall, wherein the first side wall abuts the second side wall and the third side wall, wherein the second side wall abuts the first side wall and the fourth side wall, wherein the third side wall abuts the first side wall and the fourth side wall, wherein the fourth side wall abuts the second side wall and the third side wall, and wherein a top of the post sleeve and a bottom of the post sleeve are open;

a first flange extending from the first portion of the first side wall;

a second flange extending from the first portion of the first side wall;

a third flange extending from one of the first portion of the second side wall, the first portion of the third side wall, or the first portion of the fourth side wall; and a fourth flange extending from the one of the first portion of the second side wall, the first portion of the third side wall, or the first portion of the fourth side wall, wherein the post sleeve further includes a contact point that is both (1) between the top of the post sleeve and the bottom of the post sleeve, and (2) above the first flange, the second flange, the third flange, and the fourth flange, wherein the post sleeve extension extends from the contact point to the top of the post sleeve and the post sleeve base is between the contact point and the bottom of the post sleeve, and wherein a length of the post sleeve extension is at least twice a length of the post sleeve base.

2. The deck component of claim 1, wherein the post sleeve, the first flange, the second flange, the third flange, and the fourth flange are formed from a single metal extrusion or are a single metal casting.

3. The deck component of claim 1, wherein the post sleeve base comprises a single metal extrusion or a single metal casting, and wherein the first flange, the second flange, the third flange, and the fourth flange are welded to the post sleeve base.

4. The deck component of claim 1, wherein the first flange is parallel to the second flange, and wherein the third flange is parallel to the fourth flange.

5. The deck component of claim 1, wherein the first side wall comprises a top edge, a bottom edge, a first side edge, and a second side edge, wherein the first flange and the second flange are offset from the first side edge of the first side wall and from the second side edge of the first side wall, wherein the one of the second side wall, the third side wall, or the fourth side wall comprises a top edge, a bottom edge, a first side edge, and a second side edge, and wherein the third flange and the fourth flange are offset from first side edge of the one of the second side wall, the third side wall, or the fourth side wall and from the second side edge of the one of the second side wall, the third side wall, or the fourth side wall.

6. The deck component of claim 5, wherein the first flange and the second flange are offset from top edge of the first side wall and from the bottom edge of the first side wall, and wherein the third flange and the fourth flange are offset from the top edge of the one of the second side wall, the third side wall, or the fourth side wall and from the bottom edge of the one of the second side wall, the third side wall, or the fourth side wall.

7. The deck component of claim 1, wherein the one of the second side wall, the third side wall, or the fourth side wall comprises the second side wall, but none of the third side wall and none of the fourth side wall.

8. The deck component of claim 1, wherein the one of the second side wall, the third side wall, or the fourth side wall comprises the third side wall, but neither of the second side wall and the fourth side wall.

9. The deck component of claim 1, wherein the first flange is thicker than the second flange, and the third flange is thicker than the fourth flange.

10. The deck component of claim 1, wherein the one of the second side wall, the third side wall, or the fourth side wall is the second side wall, wherein the deck component further comprises:

(i) a fifth flange abutting an exterior surface of the third side wall or the fourth side wall and a sixth flange abutting the exterior surface of the third side wall or the fourth side wall, or (ii) a fifth flange abutting an exterior surface of the third side wall, a sixth flange abutting the exterior surface of the third side wall, a seventh flange abutting an exterior surface of the fourth side wall, and an eighth flange abutting the exterior surface of the fourth side wall.

11. The deck component of claim 1, wherein each of the first flange, the second flange, the third flange, and the fourth flange comprises a first flange surface, a second flange surface, a third flange surface, a fourth flange surface, a fifth flange surface, and an edge at which the first flange, the second flange, the third flange, and the fourth flange abuts the first side wall, wherein the first flange surface is opposite the second flange surface, wherein the third flange surface is opposite the edge, wherein the fourth flange surface is opposite the fifth flange surface, wherein the third flange surface and the edge extend from the first flange surface to the second flange surface, and from the fourth flange surface to the fifth flange surface, wherein the first flange surface and the second flange surface extend from the third flange surface to the edge and from the fourth flange surface to the fifth flange surface, wherein fourth flange surface and the fifth flange surface extend from first flange surface to the second flange surface and from the third flange surface to the edge, and wherein each of the first flange surface, the second flange surface, the third flange surface, the fourth flange surface, and the fifth flange surface is rectangular.

12. The deck component of claim 11, wherein a surface area of each of the fourth flange surface and the fifth flange surface is at least ten times larger than a surface area of each of the first flange surface, the second flange surface, and the third flange surface.

13. The deck component of claim 1, further comprising:

a first box-frame-segment removably attached to the post sleeve via at least one of the first flange or the second flange; and a second box-frame-segment removably attached to the post sleeve via at least one of the third flange or the fourth flange, wherein each of the first box-frame-segment and the second box-frame-segment comprises:

a first top horizontal element;

a second top horizontal element;

a third horizontal element;

a first base horizontal element, a first vertical element extending from the first base horizontal element to the second top horizontal element;

a second vertical element extending from the first top horizontal element to the third horizontal element;

a first locking tab extending upward from the third horizontal element to form a locking tab slot between the second vertical element and the first locking tab; and a second locking tab extending from and above the first base horizontal element.

14. The deck component of claim 13, wherein at least one of the first box-frame-segment or the second box-frame-segment comprises a perimeter-trim-piece slot within the second top horizontal element adapted for retaining a removably retainable perimeter-trim-piece.

15. The deck component of claim 13, wherein at least one of the first box-frame-segment or the second box-frame-segment comprise a deck-clip slot adapted to retain a deck, and wherein the deck-clip slot provides access to screw splines for retaining a deck-clip screw positioned in the deck-clip slot of the at least one of the first box-frame-segment or the second box-frame-segment.

16. The deck component of claim 1, wherein the first flange abuts an exterior surface of the first side wall, wherein the second flange abuts the exterior surface of the first side wall, wherein the third flange abuts an exterior surface of the one of the second side wall, the third side wall, or the fourth side wall, and wherein the fourth flange abuts the exterior surface of the one of the second side wall, the third side wall, or the fourth side wall.

17. The deck component of claim 1, wherein the post sleeve extension includes at least a second portion of each of the first side wall, the second side wall, the third side wall, and the fourth side wall.

18. The deck component of claim 17, wherein the post sleeve includes an upper box-frame-segment contact point at which a top horizontal element of a box-frame-segment removably attachable to at least one of the first flange, the second flange, the third flange, or the fourth flange makes contact with the post sleeve when attached to the at least one of the first flange, the second flange, the third flange, or the fourth flange, and wherein the post sleeve extension extends above the upper box-frame contact point.

19. The deck component of claim 1, further comprising:

a post sleeve extender disposable between the post sleeve base and the post sleeve extension, wherein the post sleeve extension comprises a fifth side wall, a sixth side wall, a seventh side wall, and an eighth side wall, wherein the fifth side wall abuts the sixth side wall and the seventh side wall, wherein the sixth side wall abuts the fifth side wall and the eighth side wall, wherein the seventh side wall abuts the fifth side wall and the eighth side wall, and wherein the eighth side wall abuts the sixth side wall and the seventh side wall.

20. The deck component of claim 19, wherein the post sleeve extender comprises a first retainer, a second retainer, and a flange between the first retainer and the second retainer; and wherein the first retainer is configured for placement into the post sleeve base, wherein the flange is configured to stop the first retainer from going deeper into the post sleeve base upon a bottom side of the flange contacting a top edge of the post sleeve base, wherein the second retainer is configured for retaining the post sleeve extension placed around the second retainer, and wherein a top side of the flange prevents the post sleeve extension placed around the second retainer from contacting the first retainer.

21. A deck comprising the deck component of claim 1, the deck further comprising:

an upper guard rail, a lower guard rail, multiple balusters between the upper and lower guard rails, and multiple fasteners configured for attaching the upper and lower guard rails to the post sleeve extension.

* * * * *